US008695900B2

(12) United States Patent
Hunnicutt et al.

(10) Patent No.: US 8,695,900 B2
(45) Date of Patent: Apr. 15, 2014

(54) SPRINKLER WITH VARIABLE ARC AND FLOW RATE AND METHOD

(75) Inventors: Steven Brian Hunnicutt, Vail, AZ (US); Thomas Richard Bednar, Pewaukee, WI (US)

(73) Assignee: Rain Bird Corporation, Azusa, CA (US)

( * ) Notice: Subject to any disclaimer, the term of this patent is extended or adjusted under 35 U.S.C. 154(b) by 1023 days.

(21) Appl. No.: 12/720,261

(22) Filed: Mar. 9, 2010

(65) Prior Publication Data

US 2010/0301135 A1 Dec. 2, 2010

Related U.S. Application Data

(63) Continuation-in-part of application No. 12/475,242, filed on May 29, 2009, now Pat. No. 8,272,583.

(51) Int. Cl.

| | |
|---|---|
| ***B05B 1/26*** | (2006.01) |
| ***B05B 1/30*** | (2006.01) |
| ***B05B 1/32*** | (2006.01) |
| ***B44D 5/10*** | (2006.01) |

(52) U.S. Cl.

USPC ..... 239/582.1; 239/224; 239/456; 239/460; 239/507; 239/513; 239/581.2

(58) Field of Classification Search

USPC ..... 239/210, 222.17, 224, 237, 240, 451, 239/453, 456, 457, 460, 501, 507, 512, 513, 239/514, 524, 581.2, 581.3, 582.1

See application file for complete search history.

(56) References Cited

U.S. PATENT DOCUMENTS

| | | | |
|---|---|---|---|
| 458,607 | A | 9/1891 | Weiss |
| 1,523,609 | A | 1/1922 | Roach |
| 1,432,386 | A | 10/1922 | Curney |

(Continued)

FOREIGN PATENT DOCUMENTS

| | | |
|---|---|---|
| AU | 783999 | 1/2006 |
| CA | 2427450 | 6/2004 |

(Continued)

OTHER PUBLICATIONS

U.S. Appl. No. 12/248,644, filed Oct. 9, 2008.

(Continued)

*Primary Examiner* — Ryan Reis

(74) *Attorney, Agent, or Firm* — Fitch, Even, Tabin & Flannery, LLP

(57) ABSTRACT

A variable arc sprinkler head or nozzle may be set to numerous positions to adjust the arcuate span of the sprinkler. The sprinkler head includes an arc adjustment valve having two portions that helically engage each other to define an opening that may be adjusted at the top of the sprinkler to a desired arcuate length. The arcuate length may be adjusted by pressing down and rotating a deflector to directly actuate the valve. The sprinkler head may include a lock-out feature to prevent adjustment. A method of irrigation is also provided involving moving the deflector between an arc adjustment position and an operational, irrigation position. The sprinkler head may also include a flow rate adjustment valve that may be adjusted by actuation of an outer wall of the sprinkler. Rotation of the outer wall causes a flow control member to move axially to or away from an inlet.

9 Claims, 43 Drawing Sheets

(56) References Cited

U.S. PATENT DOCUMENTS

| | | | |
|---|---|---|---|
| 2,075,589 | A | 4/1933 | Munz |
| 2,130,810 | A | 9/1938 | Munz |
| 2,348,776 | A | 4/1941 | Bentley |
| 2,634,163 | A | 4/1953 | Double |
| 2,723,879 | A | 11/1955 | Martin |
| 2,785,013 | A | 3/1957 | Stearns |
| 2,914,257 | A | 1/1959 | Wiant |
| 2,875,783 | A | 3/1959 | Schippers |
| 2,935,266 | A | 5/1960 | Coleondro et al. |
| 2,990,123 | A | 6/1961 | Hyde |
| 2,990,128 | A | 6/1961 | Hyde |
| 3,029,030 | A | 4/1962 | Dey |
| 3,109,591 | A | 11/1963 | Moen |
| 3,940,066 | A | 2/1976 | Hunter |
| 3,948,285 | A | 4/1976 | Flynn |
| 3,955,764 | A | 5/1976 | Phaup |
| 4,026,471 | A | 5/1977 | Hunter |
| 4,119,275 | A | 10/1978 | Hunter |
| 4,131,234 | A | 12/1978 | Pescetto |
| 4,189,099 | A | 2/1980 | Bruninga |
| 4,198,000 | A | 4/1980 | Hunter |
| 4,253,608 | A | 3/1981 | Hunter |
| 4,272,024 | A | 6/1981 | Kah, Jr. |
| 4,353,506 | A | 10/1982 | Hayes |
| 4,353,507 | A | 10/1982 | Kah, Jr. |
| 4,398,666 | A | 8/1983 | Hunter |
| 4,417,691 | A | 11/1983 | Lockwood |
| 4,456,181 | A | 6/1984 | Burnham |
| 4,471,908 | A | 9/1984 | Hunter |
| 4,479,611 | A | 10/1984 | Galvis |
| 4,501,391 | A | 2/1985 | Hunter |
| 4,566,632 | A | 1/1986 | Sesser |
| 4,568,024 | A | 2/1986 | Hunter |
| 4,579,284 | A | 4/1986 | Arnold |
| 4,579,285 | A | 4/1986 | Hunter |
| 4,618,100 | A | 10/1986 | White |
| 4,624,412 | A | 11/1986 | Hunter |
| 4,625,917 | A | 12/1986 | Torney |
| RE32,386 | E | 3/1987 | Hunter |
| 4,660,766 | A | 4/1987 | Nelson et al. |
| 4,669,663 | A | 6/1987 | Meyer |
| 4,676,438 | A | 6/1987 | Sesser |
| 4,681,260 | A | 7/1987 | Cochran |
| 4,681,263 | A | 7/1987 | Cockman |
| 4,699,321 | A | 10/1987 | Bivens et al. |
| 4,708,291 | A | 11/1987 | Grundy |
| 4,718,605 | A | 1/1988 | Hunter |
| 4,720,045 | A | 1/1988 | Meyer |
| 4,739,934 | A | 4/1988 | Gewelber |
| D296,464 | S | 6/1988 | Marmol et al. |
| 4,752,031 | A | 6/1988 | Merrick |
| 4,763,838 | A | 8/1988 | Holcomb |
| 4,784,325 | A | 11/1988 | Walker |
| 4,796,809 | A | 1/1989 | Hunter |
| 4,796,811 | A | 1/1989 | Davisson |
| 4,815,662 | A | 3/1989 | Hunter |
| 4,834,289 | A | 5/1989 | Hunter |
| 4,836,449 | A | 6/1989 | Hunter |
| 4,836,450 | A | 6/1989 | Hunter |
| 4,840,312 | A | 6/1989 | Tyler |
| 4,842,201 | A | 6/1989 | Hunter |
| 4,867,378 | A | 9/1989 | Kah, Jr. |
| 4,898,332 | A | 2/1990 | Hunter et al. |
| 4,901,924 | A | 2/1990 | Kah, Jr. |
| 4,932,590 | A | 6/1990 | Hunter |
| 4,944,456 | A | 7/1990 | Zakai |
| 4,948,052 | A | 8/1990 | Hunter |
| 4,955,542 | A | 9/1990 | Kah, Jr. |
| 4,961,534 | A | 10/1990 | Tyler et al. |
| 4,967,961 | A | 11/1990 | Hunter |
| 4,971,250 | A | 11/1990 | Hunter |
| D312,865 | S | 12/1990 | Davisson |
| 4,986,474 | A | 1/1991 | Schisler et al. |
| 5,031,840 | A | 7/1991 | Grundy et al. |
| 5,050,800 | A | 9/1991 | Lamar |
| 5,052,621 | A | 10/1991 | Katzer et al. |
| 5,058,806 | A | 10/1991 | Rupar |
| 5,078,321 | A | 1/1992 | Davis |
| 5,083,709 | A | 1/1992 | Iwanowski |
| RE33,823 | E | 2/1992 | Nelson |
| 5,086,977 | A | 2/1992 | Kah, Jr. |
| 5,090,619 | A | 2/1992 | Barthold |
| 5,098,021 | A | 3/1992 | Kah, Jr. |
| 5,104,045 | A | 4/1992 | Kah, Jr. |
| 5,123,597 | A | 6/1992 | Bendall |
| 5,141,024 | A | 8/1992 | Hicks |
| 5,148,990 | A * | 9/1992 | Kah, Jr. ..... 239/222.17 |
| 5,148,991 | A | 9/1992 | Kah, Jr. |
| 5,152,458 | A | 10/1992 | Curtis |
| 5,158,232 | A | 10/1992 | Tyler et al. |
| 5,174,501 | A | 12/1992 | Hadar |
| 5,199,646 | A | 4/1993 | Kah, Jr. |
| 5,205,491 | A | 4/1993 | Hadar |
| 5,224,653 | A | 7/1993 | Nelson et al. |
| 5,226,599 | A | 7/1993 | Lindermeir et al. |
| 5,226,602 | A | 7/1993 | Cochran et al. |
| 5,234,169 | A | 8/1993 | McKenzie |
| 5,240,182 | A | 8/1993 | Lemme |
| 5,240,184 | A | 8/1993 | Lawson |
| 5,267,689 | A | 12/1993 | Forer |
| 5,288,022 | A | 2/1994 | Sesser |
| 5,299,742 | A | 4/1994 | Han |
| 5,322,223 | A | 6/1994 | Hadar |
| 5,335,857 | A | 8/1994 | Hagon |
| 5,360,167 | A | 11/1994 | Grundy et al. |
| 5,370,311 | A | 12/1994 | Chen |
| 5,372,307 | A | 12/1994 | Sesser |
| 5,375,768 | A | 12/1994 | Clark |
| 5,398,872 | A | 3/1995 | Joubran |
| 5,417,370 | A | 5/1995 | Kah, Jr. |
| 5,423,486 | A | 6/1995 | Hunter |
| 5,435,490 | A | 7/1995 | Machut |
| 5,439,174 | A | 8/1995 | Sweet |
| RE35,037 | E | 9/1995 | Kah |
| 5,456,411 | A | 10/1995 | Scott et al. |
| 5,503,139 | A | 4/1996 | McMahon |
| 5,526,982 | A | 6/1996 | McKenzie |
| 5,544,814 | A | 8/1996 | Spenser |
| 5,556,036 | A | 9/1996 | Chase |
| 5,588,594 | A | 12/1996 | Kah, Jr. |
| 5,588,595 | A | 12/1996 | Sweet et al. |
| 5,598,977 | A | 2/1997 | Lemme |
| 5,611,488 | A | 3/1997 | Frolich |
| 5,620,141 | A | 4/1997 | Chiang |
| 5,640,983 | A | 6/1997 | Sherman |
| 5,642,861 | A | 7/1997 | Ogi et al. |
| 5,653,390 | A | 8/1997 | Kah, Jr. |
| 5,662,545 | A | 9/1997 | Zimmerman et al. |
| 5,671,885 | A | 9/1997 | Davisson |
| 5,671,886 | A | 9/1997 | Sesser |
| 5,676,315 | A | 10/1997 | Han |
| D388,502 | S | 12/1997 | Kah, III |
| 5,695,123 | A | 12/1997 | Le |
| 5,699,962 | A | 12/1997 | Scott et al. |
| 5,711,486 | A | 1/1998 | Clark et al. |
| 5,718,381 | A | 2/1998 | Katzer et al. |
| 5,720,435 | A | 2/1998 | Hunter |
| 5,722,593 | A | 3/1998 | McKenzie |
| 5,758,827 | A | 6/1998 | Van Le et al. |
| 5,762,270 | A | 6/1998 | Kearby et al. |
| 5,765,757 | A | 6/1998 | Bendall |
| 5,765,760 | A | 6/1998 | Kuo |
| 5,769,322 | A | 6/1998 | Smith |
| 5,785,248 | A | 7/1998 | Staylor et al. |
| 5,820,029 | A | 10/1998 | Marans |
| 5,823,439 | A | 10/1998 | Hunter et al. |
| 5,823,440 | A | 10/1998 | Clark |
| 5,826,797 | A | 10/1998 | Kah, III |
| 5,845,849 | A | 12/1998 | Mitzlaff |
| 5,875,969 | A | 3/1999 | Grundy |
| 5,918,812 | A | 7/1999 | Beutler |
| 5,927,607 | A | 7/1999 | Scott |
| 5,971,297 | A | 10/1999 | Sesser |
| 5,988,523 | A | 11/1999 | Scott |

(56) References Cited

U.S. PATENT DOCUMENTS 5,992,760 A 11/1999 Kearby et al.
6,007,001 A 12/1999 Hilton
6,019,295 A 2/2000 McKenzie
6,029,907 A 2/2000 McKenzie
6,042,021 A 3/2000 Clark
6,050,502 A 4/2000 Clark
6,076,744 A 6/2000 O'Brien
6,076,747 A 6/2000 Ming-Yuan
6,085,995 A 7/2000 Kah, Jr. et al.
6,102,308 A 8/2000 Steingass
6,109,545 A 8/2000 Kah, Jr.
6,138,924 A 10/2000 Hunter et al.
6,145,758 A 11/2000 Ogi et al.
6,155,493 A 12/2000 Kearby
6,158,675 A 12/2000 Ogi
6,182,909 B1 2/2001 Kah, Jr. et al.
6,186,413 B1 2/2001 Lawson
6,223,999 B1 5/2001 Lemelshtrich
6,227,455 B1 5/2001 Scott et al.
6,230,988 B1 5/2001 Chao
6,230,989 B1 5/2001 Haverstraw
6,237,862 B1 5/2001 Kah, III et al.
6,241,158 B1 6/2001 Clark et al.
6,244,521 B1 6/2001 Sesser
6,264,117 B1 7/2001 Roman
6,286,767 B1 9/2001 Hui-Chen
6,332,581 B1 12/2001 Chin et al.
6,336,597 B1 1/2002 Kah, Jr.
6,341,733 B1 1/2002 Sweet
6,345,541 B1 2/2002 Hendey
6,367,708 B1 4/2002 Olson
D458,342 S 6/2002 Johnson
6,443,372 B1 9/2002 Hsu
6,454,186 B2 9/2002 Haverstraw et al.
6,457,656 B1 10/2002 Scott
6,464,151 B1 10/2002 Cordua
6,478,237 B2 11/2002 Kearby
6,488,218 B1 12/2002 Townsend et al.
6,491,235 B1 12/2002 Scott et al.
6,494,384 B1 12/2002 Meyer
6,499,672 B1 * 12/2002 Sesser ..... 239/222.11
6,530,531 B2 3/2003 Butler
6,601,781 B2 8/2003 Kah, III et al.
6,607,147 B2 8/2003 Schneider et al.
6,622,940 B2 9/2003 Huang
6,637,672 B2 10/2003 Cordua
6,651,904 B2 11/2003 Roman
6,651,905 B2 11/2003 Sesser et al.
6,688,539 B2 2/2004 Vander Griend
6,695,223 B2 2/2004 Beutler et al.
6,715,699 B1 4/2004 Greenberg
6,719,218 B2 4/2004 Cool
6,732,952 B2 5/2004 Kah, Jr.
6,736,332 B2 5/2004 Sesser
6,736,336 B2 5/2004 Wong
6,769,633 B1 8/2004 Huang
6,814,304 B2 * 11/2004 Onofrio ..... 239/201
6,814,305 B2 11/2004 Townsend
6,817,543 B2 11/2004 Clark
6,820,825 B1 11/2004 Wang
6,827,291 B2 12/2004 Townsend
6,834,816 B2 * 12/2004 Kah, Jr. ..... 239/451
6,840,460 B2 1/2005 Clark
6,848,632 B2 2/2005 Clark
6,854,664 B2 2/2005 Smith
6,869,026 B2 3/2005 McKenzie et al.
6,871,795 B2 3/2005 Anuskiewicz
6,880,768 B2 4/2005 Lau
6,883,727 B2 * 4/2005 De Los Santos ..... 239/240
6,921,030 B2 7/2005 Renquist
6,942,164 B2 9/2005 Walker
6,945,471 B2 9/2005 McKenzie et al.
6,957,782 B2 10/2005 Clark et al.
6,997,393 B1 2/2006 Angold et al.
7,017,831 B2 3/2006 Santiago et al.
7,017,837 B2 3/2006 Taketomi
7,028,920 B2 4/2006 Hekman et al.
7,028,927 B2 4/2006 Mermet
7,032,836 B2 4/2006 Sesser et al.
7,032,844 B2 4/2006 Cordua
7,040,553 B2 5/2006 Clark
7,044,403 B2 5/2006 Kah, III et al.
7,070,122 B2 7/2006 Burcham
7,090,146 B1 8/2006 Ericksen et al.
7,100,842 B2 9/2006 Meyer et al.
7,104,472 B2 9/2006 Renquist
7,111,795 B2 9/2006 Thong
7,143,957 B2 12/2006 Nelson
7,143,962 B2 12/2006 Kah, Jr.
7,152,814 B1 12/2006 Schapper et al.
7,156,322 B1 1/2007 Heitzman
7,159,795 B2 1/2007 Sesser et al.
7,168,634 B2 * 1/2007 Onofrio ..... 239/222.17
7,232,081 B2 6/2007 Kah, Jr. et al.
7,234,651 B2 6/2007 Mousavi et al.
7,240,860 B2 7/2007 Griend
7,287,711 B2 10/2007 Crooks
7,293,721 B2 11/2007 Roberts
7,303,147 B1 12/2007 Danner et al.
7,303,153 B2 12/2007 Han
7,322,533 B2 1/2008 Grizzle
7,337,988 B2 3/2008 McCormick
RE40,440 E 7/2008 Sesser
7,392,956 B2 7/2008 McKenzie
7,429,005 B2 9/2008 Schapper
7,478,526 B2 1/2009 McAfee
7,533,833 B2 5/2009 Wang
7,581,687 B2 9/2009 Feith
7,584,906 B2 9/2009 Lev
7,597,273 B2 10/2009 McAfee
7,607,588 B2 10/2009 Nobili
7,611,077 B2 11/2009 Sesser et al.
7,621,467 B1 11/2009 Garcia
7,654,474 B2 2/2010 Cordua
7,686,235 B2 3/2010 Roberts
7,686,236 B2 3/2010 Alexander
7,703,706 B2 4/2010 Walker
D615,152 S 5/2010 Kah
7,766,259 B2 8/2010 Feith
D628,272 S 11/2010 Kah
7,828,229 B2 11/2010 Kah
7,850,094 B2 12/2010 Richmond et al.
7,861,948 B1 1/2011 Crooks
D636,459 S 4/2011 Kah
7,926,746 B2 4/2011 Melton
7,971,804 B2 7/2011 Roberts
RE42,596 E 8/2011 Sesser
8,006,919 B2 8/2011 Renquist et al.
8,047,456 B2 11/2011 Kah, Jr. et al.
8,056,829 B2 11/2011 Gregory
8,074,897 B2 * 12/2011 Hunnicutt et al. ..... 239/222.17
8,205,811 B2 6/2012 Cordua
8,272,583 B2 9/2012 Hunnicutt et al.
2001/0023901 A1 9/2001 Haverstraw et al.
2002/0070289 A1 6/2002 Hsu
2002/0130202 A1 9/2002 Kah, Jr. et al.
2002/0153434 A1 10/2002 Cordua
2003/0006304 A1 1/2003 Cool
2003/0015606 A1 1/2003 Cordua
2003/0042327 A1 3/2003 Beutler
2003/0071140 A1 4/2003 Roman
2003/0075620 A1 4/2003 Kah, Jr.
2004/0108391 A1 6/2004 Onofrio
2005/0006501 A1 1/2005 Englefield
2005/0161534 A1 7/2005 Kah
2005/0194464 A1 9/2005 Bruninga
2005/0194479 A1 9/2005 Curtis
2006/0038046 A1 2/2006 Curtis
2006/0086832 A1 4/2006 Roberts
2006/0086833 A1 4/2006 Roberts
2006/0108445 A1 5/2006 Pinch
2006/0144968 A1 7/2006 Lev
2006/0237198 A1 10/2006 Crampton
2006/0273202 A1 12/2006 Su

(56) References Cited

U.S. PATENT DOCUMENTS

| | | | | |
|---|---|---|---|---|
| 2006/0281375 | A1 | 12/2006 | Jordan | |
| 2007/0012800 | A1 | 1/2007 | McAfee | |
| 2007/0034711 | A1 | 2/2007 | Kah, Jr. | |
| 2007/0034712 | A1 | 2/2007 | Kah, Jr. | |
| 2007/0181711 | A1 | 8/2007 | Sesser et al. | |
| 2007/0235565 | A1 | 10/2007 | Kah, Jr. et al. | |
| 2007/0246567 | A1 | 10/2007 | Roberts | |
| 2008/0169363 | A1 | 7/2008 | Walker | |
| 2008/0217427 | A1 | 9/2008 | Wang | |
| 2008/0257982 | A1 | 10/2008 | Kah et al. | |
| 2008/0276391 | A1 | 11/2008 | Jung | |
| 2008/0277499 | A1 | 11/2008 | McAfee | |
| 2009/0008484 | A1 | 1/2009 | Feith | |
| 2009/0014559 | A1 | 1/2009 | Marino | |
| 2009/0072048 | A1 | 3/2009 | Renquist et al. | |
| 2009/0078788 | A1 | 3/2009 | Holmes | |
| 2009/0108099 | A1 | 4/2009 | Porter | |
| 2009/0140076 | A1* | 6/2009 | Cordua | 239/457 |
| 2009/0173803 | A1 | 7/2009 | Kah, Jr. et al. | |
| 2009/0173904 | A1 | 7/2009 | Roberts | |
| 2009/0188988 | A1 | 7/2009 | Walker | |
| 2010/0090024 | A1 | 4/2010 | Hunnicutt | |
| 2010/0108787 | A1 | 5/2010 | Walker | |
| 2010/0176217 | A1 | 7/2010 | Richmond | |
| 2010/0257670 | A1 | 10/2010 | Hodel | |
| 2010/0276512 | A1 | 11/2010 | Nies | |
| 2010/0301135 | A1 | 12/2010 | Hunnicutt | |
| 2010/0301142 | A1 | 12/2010 | Hunnicutt et al. | |
| 2011/0024522 | A1 | 2/2011 | Anuskiewicz | |
| 2011/0024526 | A1 | 2/2011 | Feith | |
| 2011/0089250 | A1 | 4/2011 | Zhao | |
| 2011/0121097 | A1 | 5/2011 | Walker et al. | |
| 2011/0248093 | A1 | 10/2011 | Kim | |
| 2011/0248094 | A1 | 10/2011 | Robertson | |
| 2011/0248097 | A1 | 10/2011 | Kim | |
| 2011/0309161 | A1 | 12/2011 | Renquist | |
| 2012/0012670 | A1 | 1/2012 | Kah | |
| 2012/0061489 | A1 | 3/2012 | Hunnicutt et al. | |
| 2012/0153051 | A1 | 6/2012 | Kah | |
| 2012/0292403 | A1 | 11/2012 | Hunnicutt | |

FOREIGN PATENT DOCUMENTS

| | | | |
|---|---|---|---|
| CN | 2794646 | | 7/2006 |
| CN | 2805823 | | 8/2006 |
| DE | 1283591 | B | 11/1968 |
| DE | 3335805 | A1 | 2/1985 |
| EP | 463742 | | 1/1992 |
| EP | 489679 | | 6/1992 |
| EP | 518579 | | 12/1992 |
| EP | 572747 | | 12/1993 |
| EP | 646417 | | 4/1995 |
| EP | 0724913 | A2 | 7/1996 |
| EP | 0761312 | A1 | 12/1997 |
| EP | 1016463 | | 7/2000 |
| EP | 1043077 | | 10/2000 |
| EP | 1043075 | A1 | 11/2000 |
| EP | 1173286 | | 1/2002 |
| EP | 1250958 | | 10/2002 |
| EP | 1270082 | | 1/2003 |
| EP | 1289673 | | 3/2003 |
| EP | 1426112 | | 6/2004 |
| EP | 1440735 | | 7/2004 |
| EP | 1452234 | | 9/2004 |
| EP | 1502660 | | 2/2005 |
| EP | 1508378 | | 2/2005 |
| EP | 1818104 | | 8/2007 |
| EP | 1944090 | | 7/2008 |
| EP | 2251090 | A2 | 11/2010 |
| EP | 2255884 | A1 | 12/2010 |
| GB | 1234723 | | 6/1971 |
| GB | 2330783 | | 5/1999 |
| WO | 9520988 | | 8/1995 |
| WO | 9727951 | | 8/1997 |
| WO | WO9735668 | | 10/1997 |
| WO | 0007428 | | 12/2000 |
| WO | 0131996 | | 5/2001 |
| WO | 0162395 | | 8/2001 |
| WO | 02078857 | | 10/2002 |
| WO | 02098570 | | 12/2002 |
| WO | 03086643 | | 10/2003 |
| WO | 2004052721 | | 6/2004 |
| WO | WO2005099905 | | 10/2005 |
| WO | 2005115554 | | 12/2005 |
| WO | 2005123263 | | 12/2005 |
| WO | 2006108298 | | 10/2006 |
| WO | 2007131270 | | 11/2007 |
| WO | 2008130393 | | 10/2008 |
| WO | 2009036382 | | 3/2009 |
| WO | 2010036241 | | 4/2010 |
| WO | 2010126769 | | 11/2010 |

OTHER PUBLICATIONS

U.S. Appl. No. 13/300,946, filed Nov. 21, 2011.
U.S. Appl. No. 12/475,242, filed May 29, 2009.
U.S. Appl. No. 12/720,261, filed Mar. 9, 2010.
U.S. Appl. No. 12/952,369, filed Nov. 23, 2010.
U.S. Appl. No. 13/495,402, filed Jun. 13, 2012.
U.S. Appl. No. 13/560,423, filed Jul. 27, 2012.
Office Action for U.S. Appl. No. 13/300,946, maiied on Oct. 12, 2012.
Office Action for U.S. Appl. No. 13/300,946, mailed on Jun. 7, 2012.
Office Action for U.S. Appl. No. 13/562,825, mailed on Oct. 15, 2012.
U.S. Appl. No. 12/475,242, filed May 29, 2009, entitled "Sprinkler with Variable Arc and Flow Rate and Method".
Mar. 29, 2011 Office Action, U.S. Appl. No. 12/475,242.
U.S. Appl. No. 12/248,644, filed Oct. 9, 2008, entitled "Sprinkler with Variable Arc and Flow Rate".
Sep. 30, 2010 Office Action, U.S. Appl. No. 12/248,644.
Jan. 5, 2011 Office Action, U.S. Appl. No. 12/248,644.
U.S. Appl. No. 12/952,369, filed Nov. 23, 2010, entitled "Sprinkler with Variable Arc and Flow Rate and Method," which is a continuation-in-part of U.S. Appl. No. 12/720,261.
Office Action mailed Jul. 20, 2011 in U.S. Appl. No. 12/475,242.
Interview Summary mailed Sep. 26, 2011 in U.S. Appl. No. 12/475,242.
Response to Office Action filed Oct. 18, 2011 in U.S. Appl. No. 12/475,242.
Response to Office Action filed Apr. 29, 2011 in U.S. Appl. No. 12/475,242.
Office Action mailed Aug. 24, 2011 in U.S. Appl. No. 11/947,571.
Response to Office Action filed Nov. 24, 2010 in U.S. Appl. No. 11/947,571.
Office Action mailed Apr. 5, 2011 in U.S. Appl. No. 11/947,571.
Response to Office Action filed Jul. 5, 2011 in U.S. Appl. No. 11/947,571.
Advisory Action mailed Jul. 14, 2011 in U.S. Appl. No. 11/947,571.
United States Patent and Trademark Office, May 24, 2013 Office Action in U.S. Appl. No. 12/720,261.
U.S. Appl. No. 12/686,895, filed Jan. 13, 2010.
U.S. Appl. No. 61/681,798, filed Aug. 10, 2012.
U.S. Appl. No. 61/681,802, filed Aug. 10, 2012.
U.S. Appl. No. 13/828,582, filed Mar. 14, 2013.
United States Patent and Trademark Office, Dec. 4, 2012 Office Action in U.S. Appl. No. 12/686,895.
United States Patent and Trademark Office, Apr. 10, 2013 Office Action in U.S. Appl. No. 13/562,825.
U.S. Appl. No. 13/562,825, filed Jul. 31, 2012.
Office action dated Sep. 3, 2013 for U.S. Appl. No. 13/300,946.
Jun. 25, 2012 Response to Office Action, U.S. Appl. No. 13/300,946.
USPTO Office Action in U.S. Appl. No. 13/300,946, Mailed Jun. 7, 2012.
USPTO Office Action in U.S. Appl. No. 13/300,946, Mailed Oct. 12, 2012.

(56) References Cited

OTHER PUBLICATIONS

USPTO Office Action in U.S. Appl. No. 13/562,825, Mailed Oct. 15, 2012.
Aug. 5, 2010 EPO Search Report and Opinion, EPO Application No. 10164085.2.
U.S. Appl. No. 12/757,912, filed Apr. 19, 2010.
U.S. Appl. No. 12/859,159, filed Aug. 18, 2010.
U.S. Appl. No. 13/069,334, filed Mar. 22, 2011.
U.S. Appl. No. 13/523,846, filed Jun. 14, 2012.

* cited by examiner

SPRINKLER WITH VARIABLE ARC AND FLOW RATE AND METHOD

CROSS REFERENCE TO RELATED APPLICATION

This application is a continuation-in-part of U.S. application Ser. No. 12/475,242, filed May 29, 2009, which is incorporated by reference herein in its entirety.

FIELD

This invention relates to irrigation sprinklers and, more particularly, to an irrigation sprinkler head and method for distribution of water through an adjustable arc and with an adjustable flow rate.

BACKGROUND

Sprinklers are commonly used for the irrigation of landscape and vegetation. In a typical irrigation system, various types of sprinklers are used to distribute water over a desired area, including rotating stream type and fixed spray pattern type sprinklers. One type of irrigation sprinkler is the rotating deflector or so-called micro-stream type having a rotatable vaned deflector for producing a plurality of relatively small water streams swept over a surrounding terrain area to irrigate adjacent vegetation.

Rotating stream sprinklers of the type having a rotatable vaned deflector for producing a plurality of relatively small outwardly projected water streams are known in the art. In such sprinklers, one or more jets of water are generally directed upwardly against a rotatable deflector having a vaned lower surface defining an array of relatively small flow channels extending upwardly and turning radially outwardly with a spiral component of direction. The water jet or jets impinge upon this underside surface of the deflector to fill these curved channels and to rotatably drive the deflector. At the same time, the water is guided by the curved channels for projection outwardly from the sprinkler in the form of a plurality of relatively small water streams to irrigate a surrounding area. As the deflector is rotatably driven by the impinging water, the water streams are swept over the surrounding terrain area, with the range of throw depending on the flow rate of water through the sprinkler, among other things.

In rotating stream sprinklers and in other sprinklers, it is desirable to control the arcuate area through which the sprinkler distributes water. In this regard, it is desirable to use a sprinkler head that distributes water through a variable pattern, such as a full circle, half-circle, or some other arc portion of a circle, at the discretion of the user. Traditional variable arc sprinkler heads suffer from limitations with respect to setting the water distribution arc. Some have used interchangeable pattern inserts to select from a limited number of water distribution arcs, such as quarter-circle or half-circle. Others have used punch-outs to select a fixed water distribution arc, but once a distribution arc was set by removing some of the punch-outs, the arc could not later be reduced. Many conventional sprinkler heads have a fixed, dedicated construction that permits only a discrete number of arc patterns and prevents them from being adjusted to any arc pattern desired by the user.

Other conventional sprinkler types allow a variable arc of coverage but only for a limited arcuate range. Because of the limited adjustability of the water distribution arc, use of such conventional sprinklers may result in overwatering or underwatering of surrounding terrain. This is especially true where multiple sprinklers are used in a predetermined pattern to provide irrigation coverage over extended terrain. In such instances, given the limited flexibility in the types of water distribution arcs available, the use of multiple conventional sprinklers often results in an overlap in the water distribution arcs or in insufficient coverage. Thus, certain portions of the terrain are overwatered, while other portions are not watered at all. Accordingly, there is a need for a variable arc sprinkler head that allows a user to set the water distribution arc along a substantial continuum of arcuate coverage, rather than several models that provide a limited arcuate range of coverage.

It is also desirable to control or regulate the throw radius of the water distributed to the surrounding terrain. In this regard, in the absence of a flow rate adjustment device, the irrigation sprinkler will have limited variability in the throw radius of water distributed from the sprinkler, given relatively constant water pressure from a source. The inability to adjust the throw radius results both in the wasteful watering of terrain that does not require irrigation or insufficient watering of terrain that does require irrigation. A flow rate adjustment device is desired to allow flexibility in water distribution and to allow control over the distance water is distributed from the sprinkler, without varying the water pressure from the source. Some designs provide only limited adjustability and, therefore, allow only a limited range over which water may be distributed by the sprinkler.

In addition, in previous designs, adjustment of the distribution arc has been regulated through the use of a hand tool, such as a screwdriver. The hand tool may be used to access a slot in the top of the sprinkler cap, which is rotated to increase or decrease the length of the distribution arc. The slot is generally at one end of a shaft that rotates and causes an arc adjustment valve to open or close a desired amount. Users, however, may not have a hand tool readily available when they desire to make such adjustments. It would be therefore desirable to allow arc adjustment from the top of the sprinkler without the need of a hand tool. It would also be desirable to allow the user to depress and rotate the top of the sprinkler to directly actuate the arc adjustment valve, rather than through an intermediate rotating shaft.

Accordingly, a need exists for a truly variable arc sprinkler that can be adjusted to a substantial range of water distribution arcs. In addition, a need exists to increase the adjustability of flow rate and throw radius of an irrigation sprinkler without varying the water pressure, particularly for rotating stream sprinkler heads of the type for sweeping a plurality of relatively small water streams over a surrounding terrain area. Further, a need exists for a sprinkler head that allows a user to directly actuate an arc adjustment valve, rather than through a rotating shaft requiring a hand tool, and to adjust the throw radius by actuating or rotating an outer wall portion of the sprinkler head. Moreover, there is a need for improved concentricity of the arc adjustment valve, an improved seal about the valve, uniformity of water flowing through the valve, and a lower cost of assembly. Also, because sprinklers may become clogged with grit or other debris, there is a need for a variable arc sprinkler that allows for convenient flushing of debris from the sprinkler.

In addition, a need exists for a lock-out feature to maintain the arc adjustment angle set by the user. An unintentional or slight contact with the sprinkler may accidentally change the arc adjustment angle. Alternatively, an unauthorized individual may seek to spitefully alter the spray angle by simple manipulation of the sprinkler. Accordingly, a need exists for a lock-out feature to prevent these occurrences.

DESCRIPTION OF THE PREFERRED EMBODIMENTS

Figure 1:
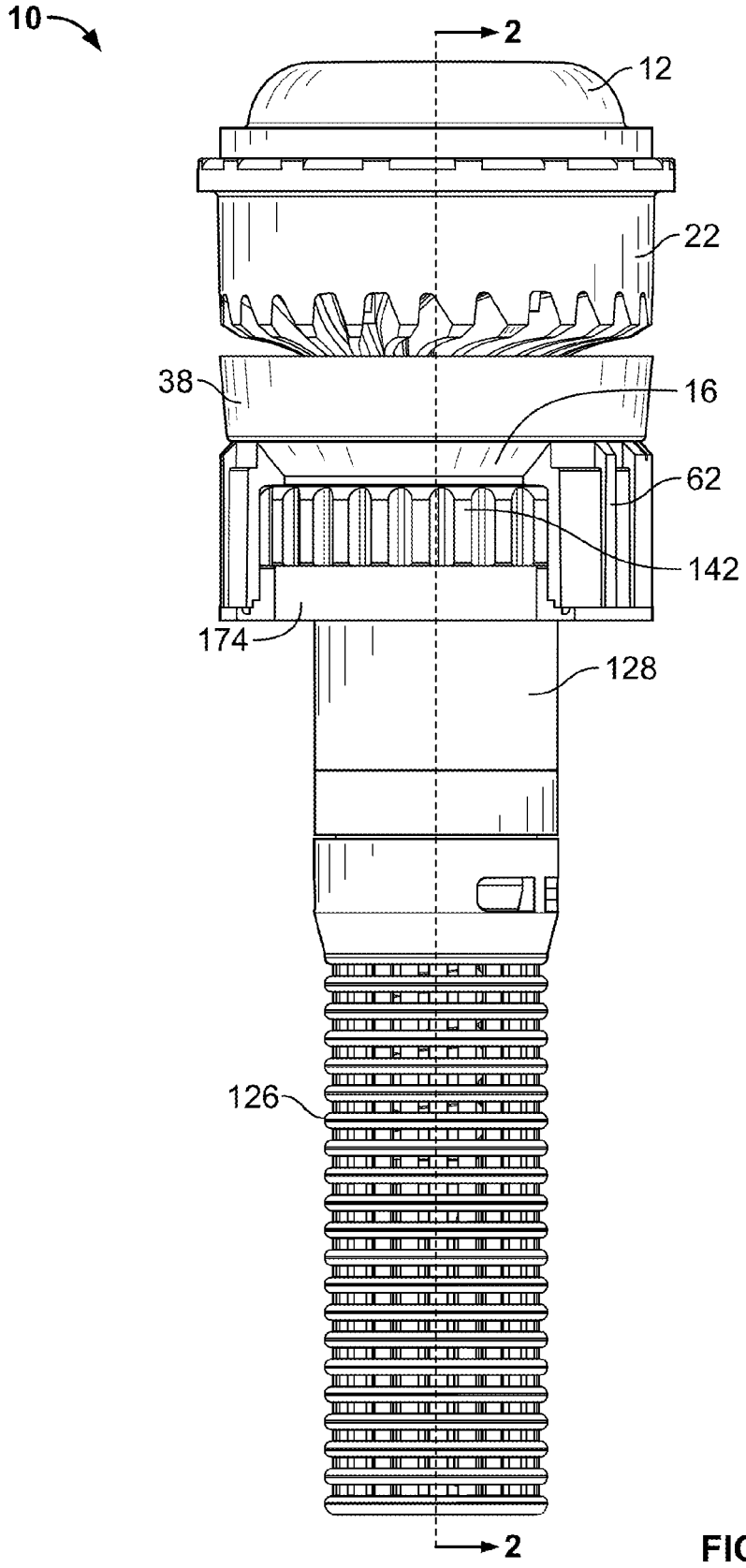
FIG. 1 is a perspective view of a first embodiment of a sprinkler head embodying features of the present invention.

FIGS. 1-4 show a first preferred embodiment of the sprinkler head or nozzle 10. The sprinkler head 10 possesses an arc adjustability capability that allows a user to generally set the arc of water distribution to virtually any desired angle. The arc adjustment feature does not require a hand tool to access a slot at the top of the sprinkler head 10 to rotate a shaft. Instead, the user may depress part or all of the cap 12 and rotate the cap 12 to directly set an arc adjustment valve 14. The sprinkler head 10 also preferably includes a flow rate adjustment feature, which is shown in FIGS. 1-4, to regulate flow rate. The flow rate adjustment feature is accessible by rotating an outer wall portion of the sprinkler head 10, as described further below.

As described in more detail below, the sprinkler head 10 allows a user to depress and rotate a cap 12 to directly actuate the arc adjustment valve 14, i.e., to open and close the valve. The user depresses the cap 12 to directly engage and rotate one of the two nozzle body portions that forms the valve 14 (valve sleeve 64). The valve 14 preferably operates through the use of two helical engagement surfaces that cam against one another to define an arcuate slot 20. Although the sprinkler head 10 preferably includes a shaft 34, the user does not need to use a hand tool to effect rotation of the shaft 34 to open and close the arc adjustment valve 14. The shaft 34 is not rotated to cause opening and closing of the valve 14. Indeed, in certain forms, the shaft 34 may be fixed against rotation, such as through use of splined engagement surfaces.

The sprinkler head 10 also preferably uses a spring 186 mounted to the shaft 34 to energize and tighten the seal of the closed portion of the arc adjustment valve 14. More specifically, the spring 186 operates on the shaft 34 to bias the first of the two nozzle body portions that forms the valve 14 (valve sleeve 64) downwardly against the second portion (nozzle cover 62). In one preferred form, the shaft 34 translates up and down a total distance corresponding to one helical pitch. The vertical position of the shaft 34 depends on the orientation of the two helical engagement surfaces with respect to one another. By using a spring 186 to maintain a forced engagement between valve sleeve 64 and nozzle cover 62, the sprinkler head 10 provides a tight seal of the closed portion of the arc adjustment valve 14, concentricity of the valve 20, and a uniform jet of water directed through the valve 14. In addition, mounting the spring 186 at one end of the shaft 34 results in a lower cost of assembly. Further, as described below, the spring 186 also provides a tight seal of other portions of the nozzle body 16, i.e., the nozzle cover 62 and collar 128.

As can be seen in FIGS. 1-4, the sprinkler head 10 generally comprises a compact unit, preferably made primarily of lightweight molded plastic, which is adapted for convenient thread-on mounting onto the upper end of a stationary or pop-up riser (not shown). In operation, water under pressure is delivered through the riser to a nozzle body 16. The water preferably passes through an inlet 134 controlled by an adjustable flow rate feature that regulates the amount of fluid flow through the nozzle body 16. The water is then directed through an arcuate slot 20 that is generally adjustable between about 0 and 360 degrees and controls the arcuate span of water distributed from the sprinkler head 10. Water is directed generally upwardly through the arcuate slot 20 to produce one or more upwardly directed water jets that impinge the underside surface of a deflector 22 for rotatably driving the deflector 22. Although the arcuate slot 20 is generally adjustable through an entire 360 degree arcuate range, water flowing through the slot 20 may not be adequate to impart sufficient force for desired rotation of the deflector 22, when the slot 20 is set at relatively low angles.

Figure 4:
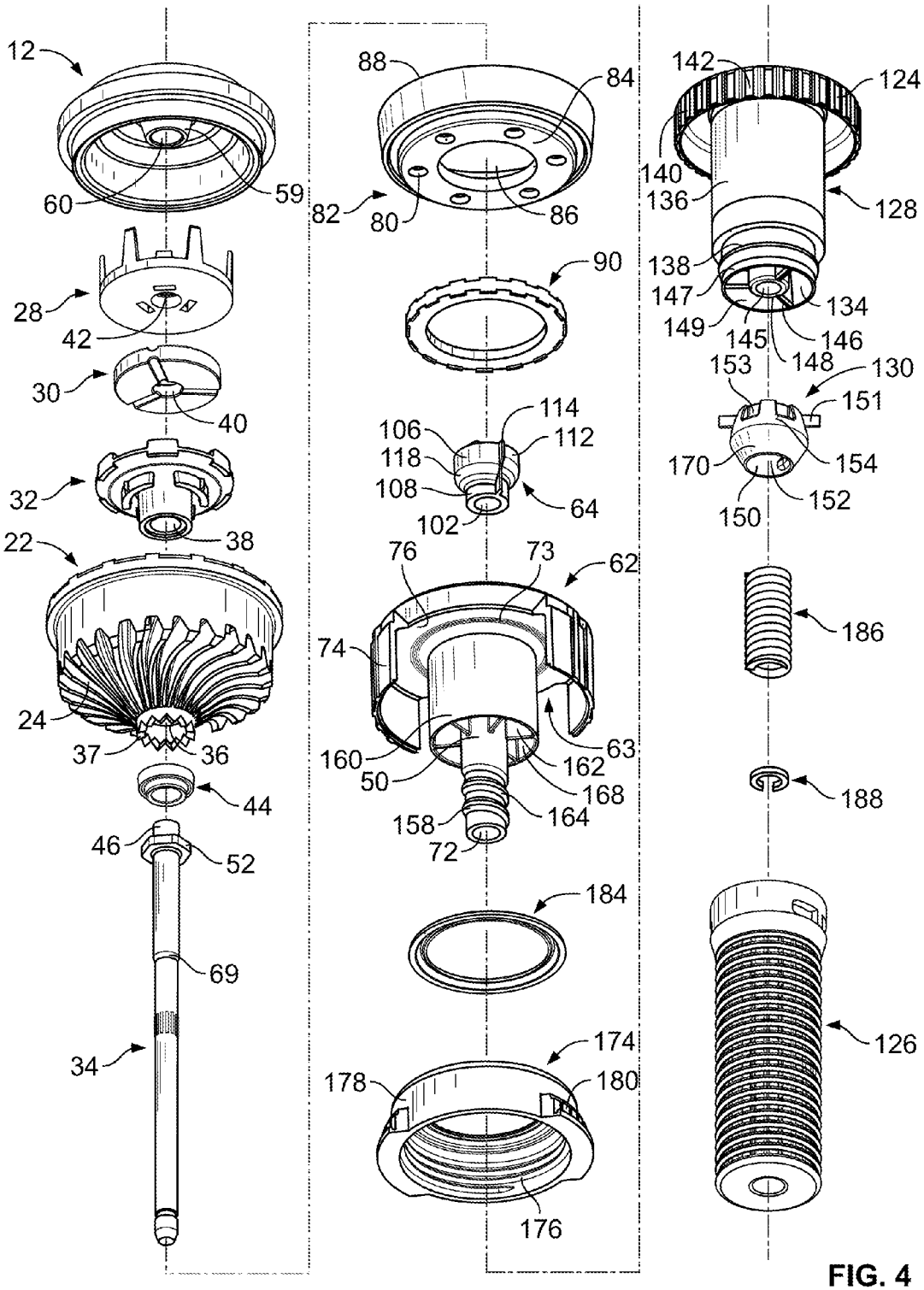
FIG. 4 is a bottom exploded perspective view of the sprinkler head of FIG. 1.

The rotatable deflector 22 has an underside surface that is contoured to deliver a plurality of fluid streams generally radially outwardly therefrom through an arcuate span. As shown in FIG. 4, the underside surface of the deflector 22 preferably includes an array of spiral vanes 24. The spiral vanes 24 subdivide the water jet or jets into the plurality of relatively small water streams which are distributed radially outwardly therefrom to surrounding terrain as the deflector 22 rotates. The vanes 24 define a plurality of intervening flow channels extending upwardly and spiraling along the underside surface to extend generally radially outwardly with selected inclination angles. During operation of the sprinkler head 10, the upwardly directed water jet or jets impinge upon the lower or upstream segments of these vanes 24, which subdivide the water flow into the plurality of relatively small flow streams for passage through the flow channels and radially outward projection from the sprinkler head 10. A deflector like the type shown in U.S. Pat. No. 6,814,304, which is assigned to the assignee of the present application and is incorporated herein by reference in its entirety, is preferably used. Other types of deflectors, however, may also be used The deflector 22 has a bore 36 for insertion of a shaft 34 therethrough. As can be seen in FIG. 4, the bore 36 is defined at its lower end by circumferentially-arranged, downwardly-protruding teeth 37. As described further below, these teeth 37 are sized to engage corresponding teeth 66 in valve sleeve 64. This engagement allows a user to depress the cap 12 and thereby directly engage and drive the valve sleeve 64 for opening and close the valve 20 (without the need for a rotating shaft). Also, the deflector 22 may optionally include a screwdriver slot and/or a coin slot in its top surface (not shown) to allow other methods for adjusting the valve 20 (without the need for rotating the shaft). Optionally, the deflector 22 may also include a knurled external surface along its top circumference to provide for better gripping by a user making an arc adjustment.

The deflector 22 also preferably includes a speed control brake to control the rotational speed of the deflector 22, as more fully described in U.S. Pat. No. 6,814,304. In the preferred form shown in FIGS. 3-5, the speed control brake includes a brake disk 28, a brake pad 30, and a friction plate 32. The friction plate 32 is rotatable with the deflector 22 and, during operation of the sprinkler head 10, is urged against the brake pad 30, which, in turn, is retained against the brake disk 28. Water is directed upwardly and strikes the deflector 22, pushing the deflector 22 and friction plate 32 upwards and causing rotation. In turn, the rotating friction plate 32 engages the brake pad 30, resulting in frictional resistance that serves to reduce, or brake, the rotational speed of the deflector 22. Although the speed control brake is shown and preferably used in connection with sprinkler head 10 described and claimed herein, other brakes or speed reducing mechanisms are available and may be used to control the rotational speed of the deflector 22.

The deflector 22 is supported for rotation by shaft 34. Shaft 34 lies along and defines a central axis C-C of the sprinkler head 10, and the deflector 22 is rotatably mounted on an upper end of the shaft 34. As can be seen from FIGS. 3-4, the shaft 34 extends through a bore 36 in the deflector 22 and through bores 38, 40, and 42 in the friction plate 32, brake pad 30, and brake disk 28, respectively. The sprinkler head 10 also preferably includes a seal member 44, such as an o-ring or lip seal, about the shaft 34 at the deflector bore 36 to prevent the ingress of upwardly-directed fluid into the interior of the deflector 22.

A cap 12 is mounted to the top of the deflector 22. The cap 12 prevents grit and other debris from coming into contact with the components in the interior of the deflector 22, such as the speed control brake components, and thereby hindering the operation of the sprinkler head 10. The cap 12 preferably includes a cylindrical interface 59 protruding from its underside and defining a cylindrical recess 60 for insertion of the upper end 46 of the shaft 34. The recess 60 provides space for the shaft upper end 46 during an arc adjustment, i.e., when the user pushes down and rotates the cap 12 to the desired arcuate span, as described further below.

Figure 3:
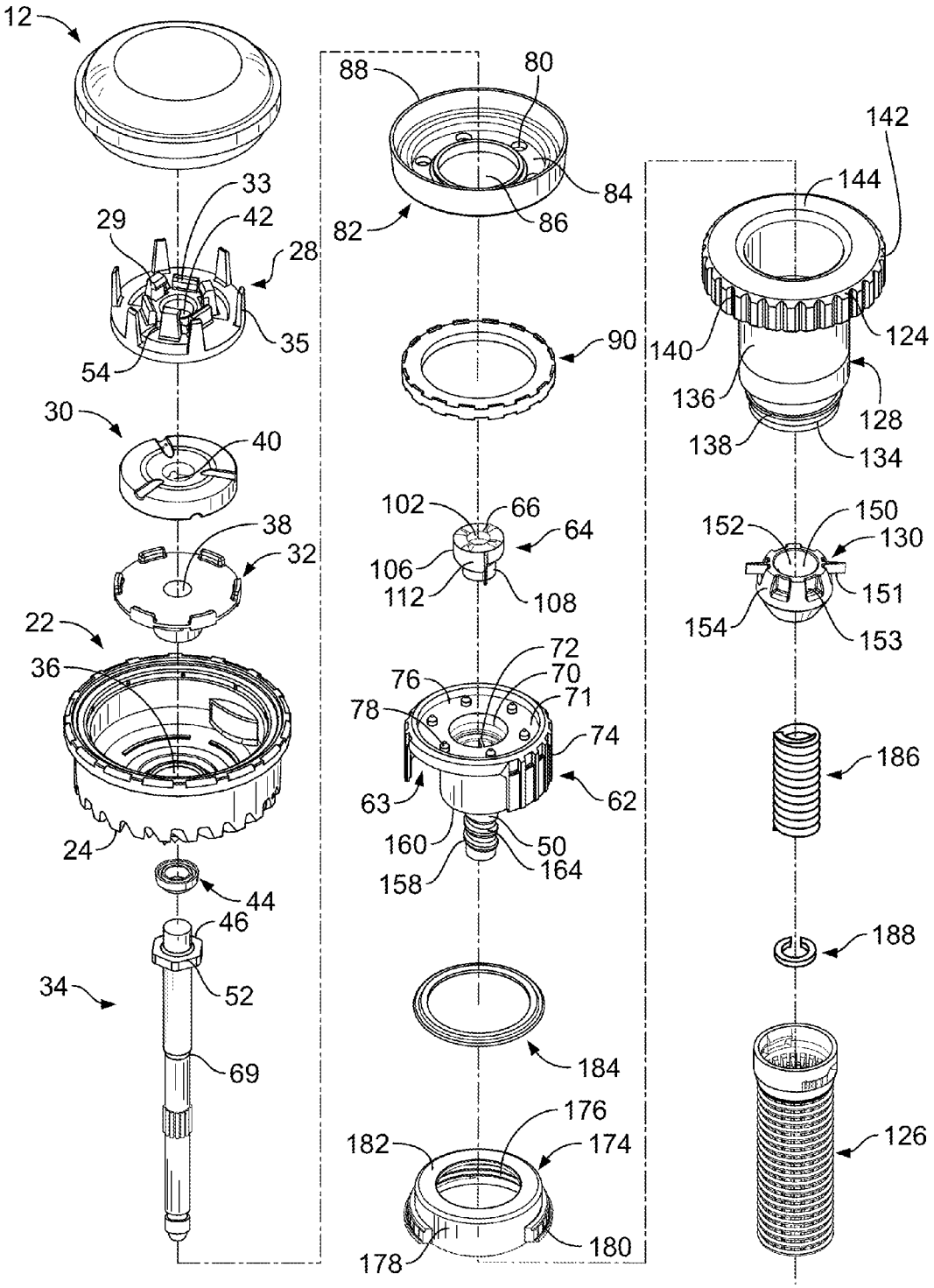
FIG. 3 is a top exploded perspective view of the sprinkler head of FIG. 1.
Figure 5:
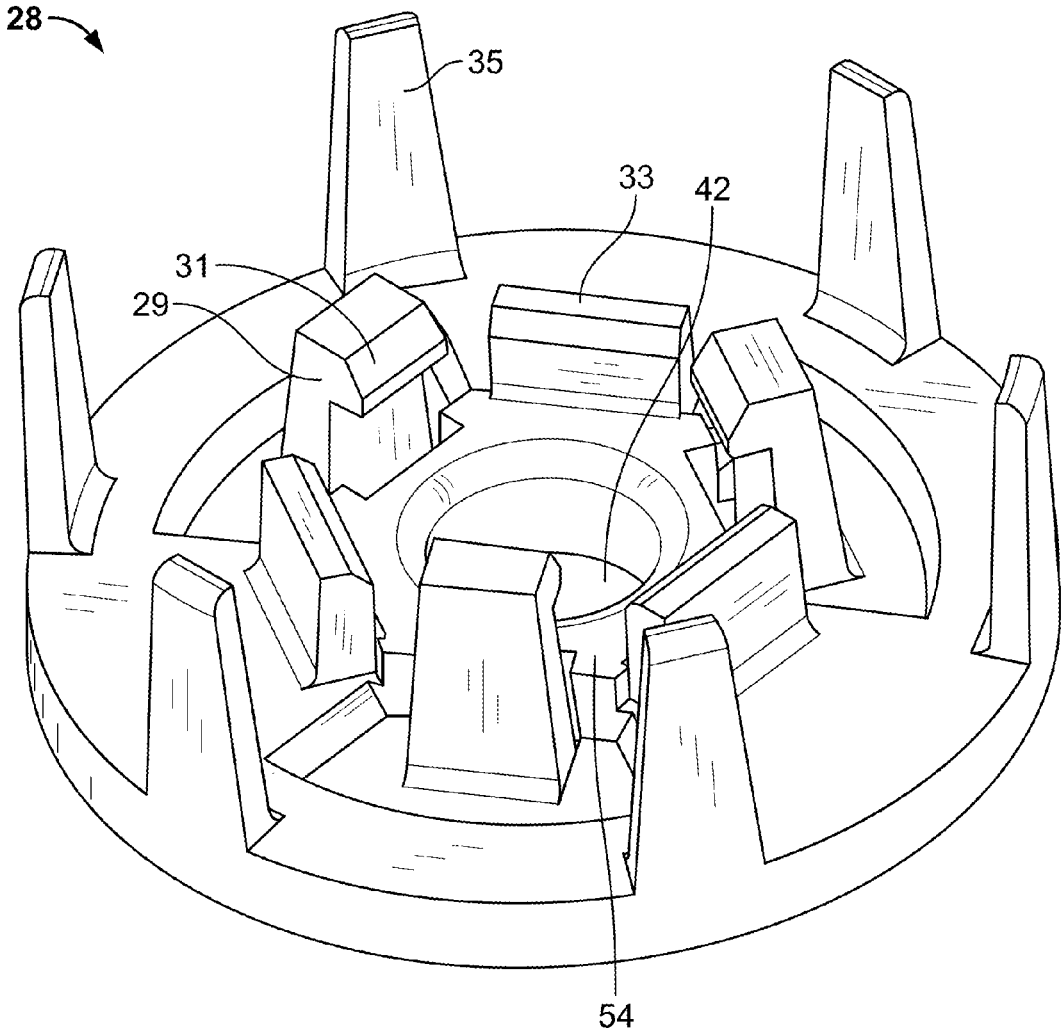
FIG. 5 is a perspective view of a brake disk of the sprinkler head of FIG. 1.

As shown in FIGS. 3-4, the shaft 34 also preferably includes a lock flange 52 for engagement with a lock seat 54 of the brake disk 28 (FIG. 5) when the shaft 34 is mounted. The flange 52 is preferably hexagonal in shape for engagement with a correspondingly hexagonally shaped lock seat 54, although other shapes may be used. The engagement of the flange 52 within the lock seat 54 prevents rotation of the brake disk 28 during operation of the sprinkler head 10. The brake disk 28 further preferably includes barbs 29 with hooked flanges 31 that are spaced about the hexagonal lock seat 54. These barbs 29 help retain the brake disk 28 to the shaft 34 during push down arc adjustment of the sprinkler head 10. As shown in FIG. 5, in one preferred form, three barbs 29 alternate with three posts 33 about the hexagonal lock seat 54. The brake disk 28 also preferably includes elastic members 35 that return the cap 12 and deflector 22 to their normal elevated position following an arc adjustment by the user, as described further below.

The sprinkler head 10 preferably provides feedback to indicate to a user that a manual arc adjustment has been completed. It provides this feedback both when the user is performing an arc adjustment while the sprinkler head 10 is irrigating, i.e., a "wet adjust," and when the user is performing an arc adjustment while the sprinkler head 10 is not irrigating, i.e., a "dry adjust." During a "wet adjust," the user pushes the cap 12 down to an arc adjustment position. In this position, the deflector teeth 37 directly engage the corresponding teeth 66 in the valve sleeve 64, and the user rotates to the desired arcuate setting and releases the cap 12. Following release, water directed upwardly against the deflector 22 causes the deflector 22 to return to its normal elevated, disengaged, and operational position. This return to the operational position from the adjustment position provides feedback to the user that the arc adjustment has been completed.

During a "dry adjust," however, water does not return the deflector 22 to the normal elevated position because water is not flowing through the sprinkler head 10 at all. In this circumstance, the elastic members 35 of the brake disk 28 return the deflector 22 to the elevated position. The elastic members 35 are operatively coupled to the shaft 34 and are sized and positioned to provide a spring force that biases the cap 12 away from the brake disk 28. When the user depresses the cap 12 for arc adjustment, the user causes the elastic members 35 to become compressed. Following push down, rotation, and release of the cap 12, the elastic members 35 exert an upward force against the underside of the cap 12 to return the cap 12 and deflector 22 to their normal elevated position. As shown in FIG. 5, in one preferred form, there are six elastic members 35 spaced equidistantly about the outer circumference of the brake disk 28. Other types and arrangements of elastic members may also be used. For example, the elastic members 35 may be replaced with one or more coil springs that provide the requisite biasing force.

The variable arc capability of sprinkler head 10 results from the interaction of two portions of the nozzle body 16 (nozzle cover 62 and valve sleeve 64). More specifically, as shown in FIGS. 2, 6, 7, and 12, the nozzle cover 62 and the valve sleeve 64 have corresponding helical engagement surfaces. The valve sleeve 64 may be rotatably adjusted with respect to the nozzle cover 62 to close the arc adjustment valve 14, i.e., to adjust the length of arcuate slot 20, and this rotatable adjustment also results in upward or downward translation of the valve sleeve 64. In turn, this camming action results in upward or downward translation of the shaft 34 with the valve sleeve 64. The arcuate slot 20 may be adjusted to any desired water distribution arc by the user through push down and rotation of the cap 12.

Figure 6:
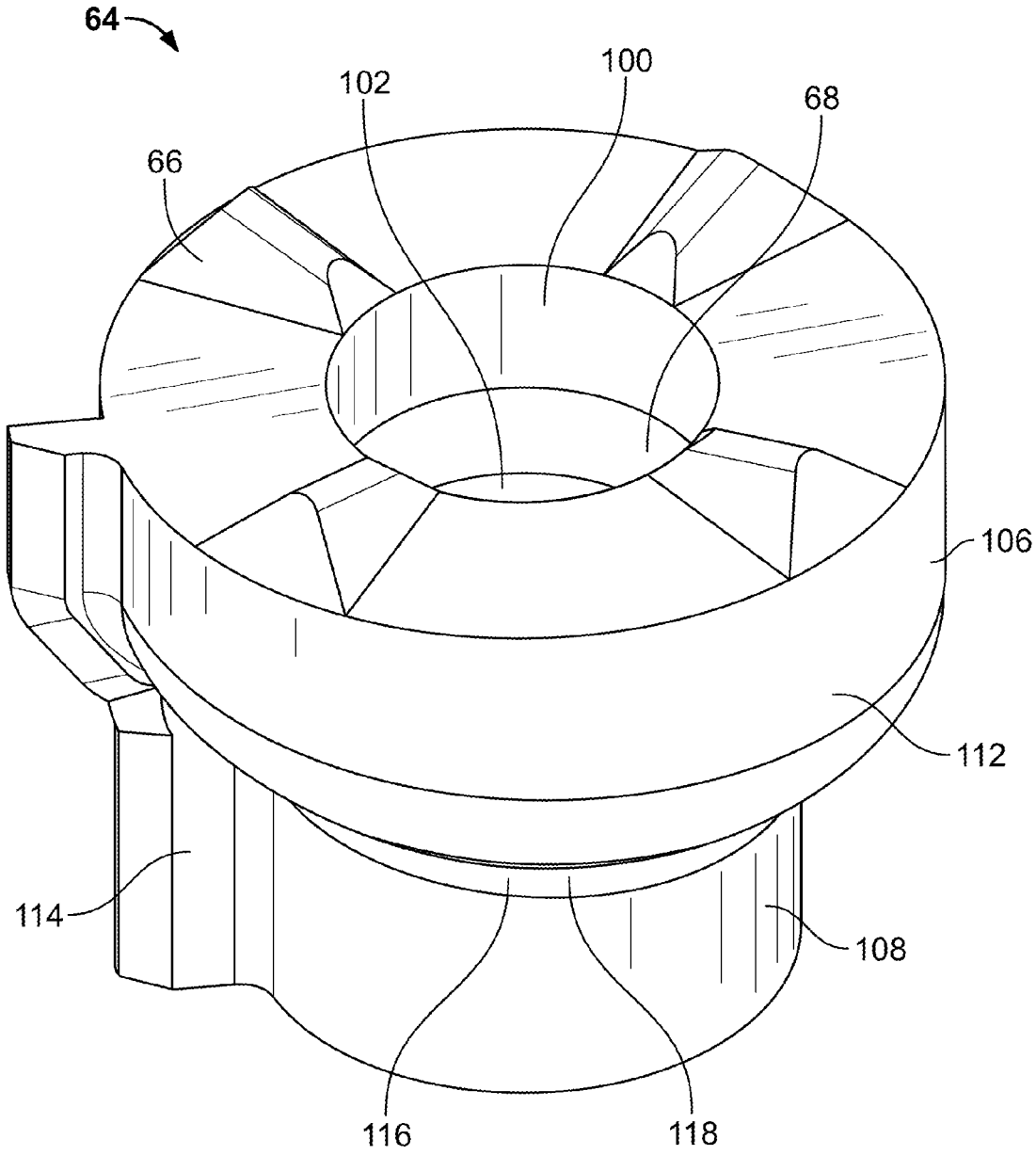
FIG. 6 is a perspective view of the valve sleeve of the sprinkler head of FIG. 1.
Figure 7:
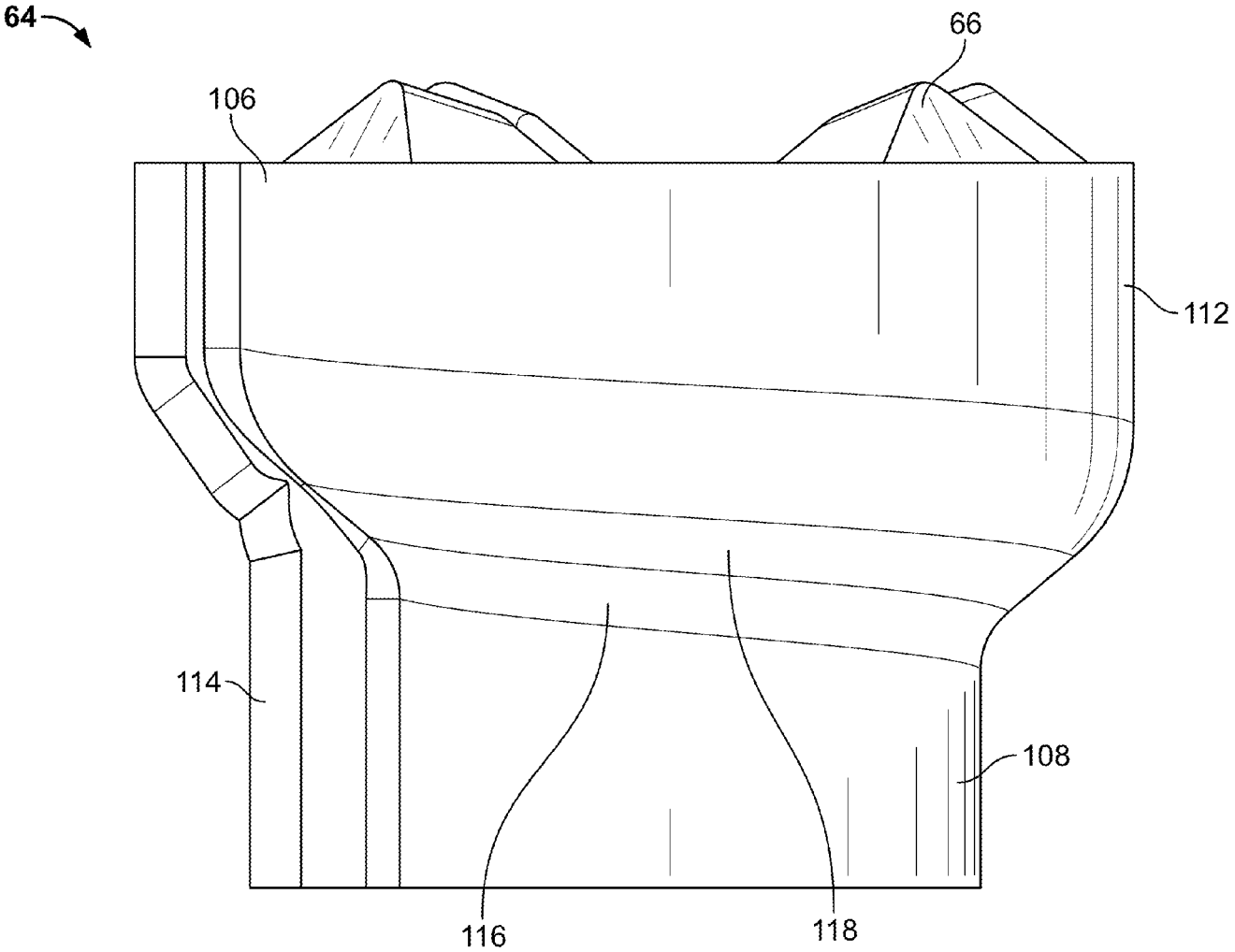
FIG. 7 is a side elevational view of the valve sleeve of the sprinkler head of FIG. 1.
Figure 8:
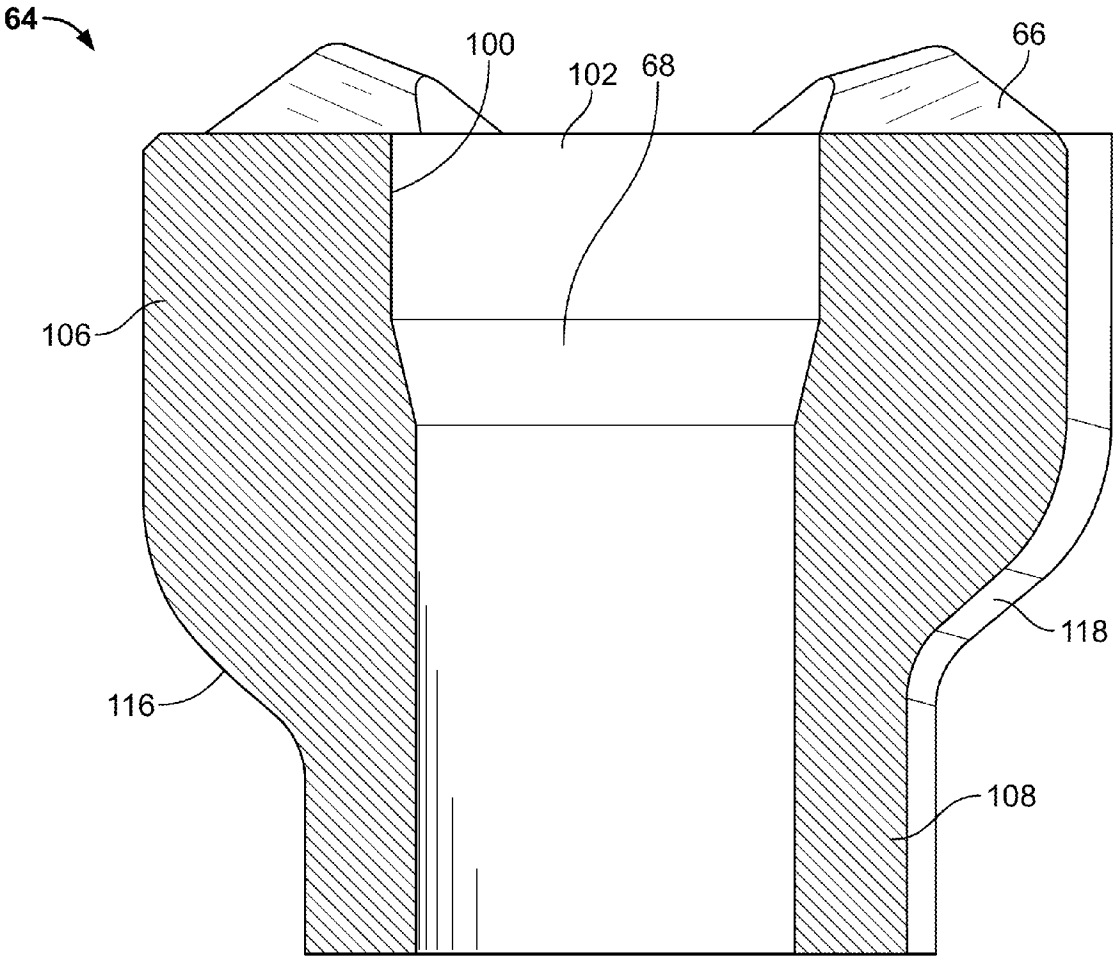
FIG. 8 is a cross-sectional view of the valve sleeve of the sprinkler head of FIG. 1.

As shown in FIGS. 6-8, the valve sleeve 64 has a generally cylindrical shape. The valve sleeve 64 includes a central hub 100 defining a bore 102 therethrough for insertion of the shaft 34. The downward biasing force of spring 186 against shaft 34 results in a friction press fit between an inclined shoulder 69 of the shaft 34 and an inclined inner wall 68 of the valve sleeve 64. The valve sleeve 64 preferably includes an upper cylindrical portion 106 and a lower cylindrical portion 108 having a smaller diameter than the upper portion 106. The upper portion 106 preferably has a top surface with teeth 66 formed therein for engagement with the deflector teeth 37. The valve sleeve 64 also includes an external helical surface 118 that engages and cams against a corresponding helical surface of the nozzle cover 62 to form the arc adjustment valve 14.

The valve sleeve 64 preferably includes additional structure to improve fluid flow through the arc adjustment valve 20. For example, a fin 114 projects radially outwardly and extends axially along the outside of the valve sleeve 64, i.e., along the outer wall 112 of the upper portion 106 and lower portion 108. In addition, the lower portion 108 extends upwardly into a gently curved, radiused segment 116 to allow upwardly directed fluid to be redirected slightly toward the nozzle cover 62 with a relatively insignificant loss in energy and velocity, as described further below.

As shown in FIGS. 9-12, the nozzle cover 62 includes a top generally cylindrical portion 71 and a bottom hub portion 50. The top portion 71 engages the valve sleeve 64 to form the arc adjustment valve 14, and the bottom portion 50 engages a flow control member 130 for flow rate adjustment. Previous designs used multiple separate nozzle pieces to perform some of the functions of these portions. The use of a single nozzle cover 62 has been found to simplify the assembly process. It should be evident that the nozzle portions described herein may be separated into multiple bodies or combined into one or more integral bodies. For example, the sprinkler head 10 may include a lower valve piece (having a second helical engagement surface) entirely separate from the nozzle cover and with a spring mounted between the lower valve piece and the nozzle cover (instead of at the lower end of shaft 34).

The nozzle cover top portion 71 preferably includes a central hub 70 that defines a bore 72 for insertion of the valve sleeve 64 and includes an outer wall 74 having an external knurled surface for easy and convenient gripping and rotating of the sprinkler head 10 to assist in mounting onto the threaded end of a riser. The top portion 71 also preferably includes an annular top surface 76 with circumferential equidistantly spaced bosses 78 extending upwardly from the top surface 76. The bosses 78 engage corresponding circumferential equidistantly spaced apertures 80 in a rubber collar 82 mounted on top of the nozzle cover 62. The rubber collar 82 includes an annular portion 84 that defines a central bore 86, the apertures 80, and a raised cylindrical wall 88 that extends upwardly but does not engage the deflector 22. The rubber collar 82 is retained against the nozzle cover 62 by a rubber collar retainer 90, which is preferably an annulus that engages the tops of the bosses 78.

Figure 9:
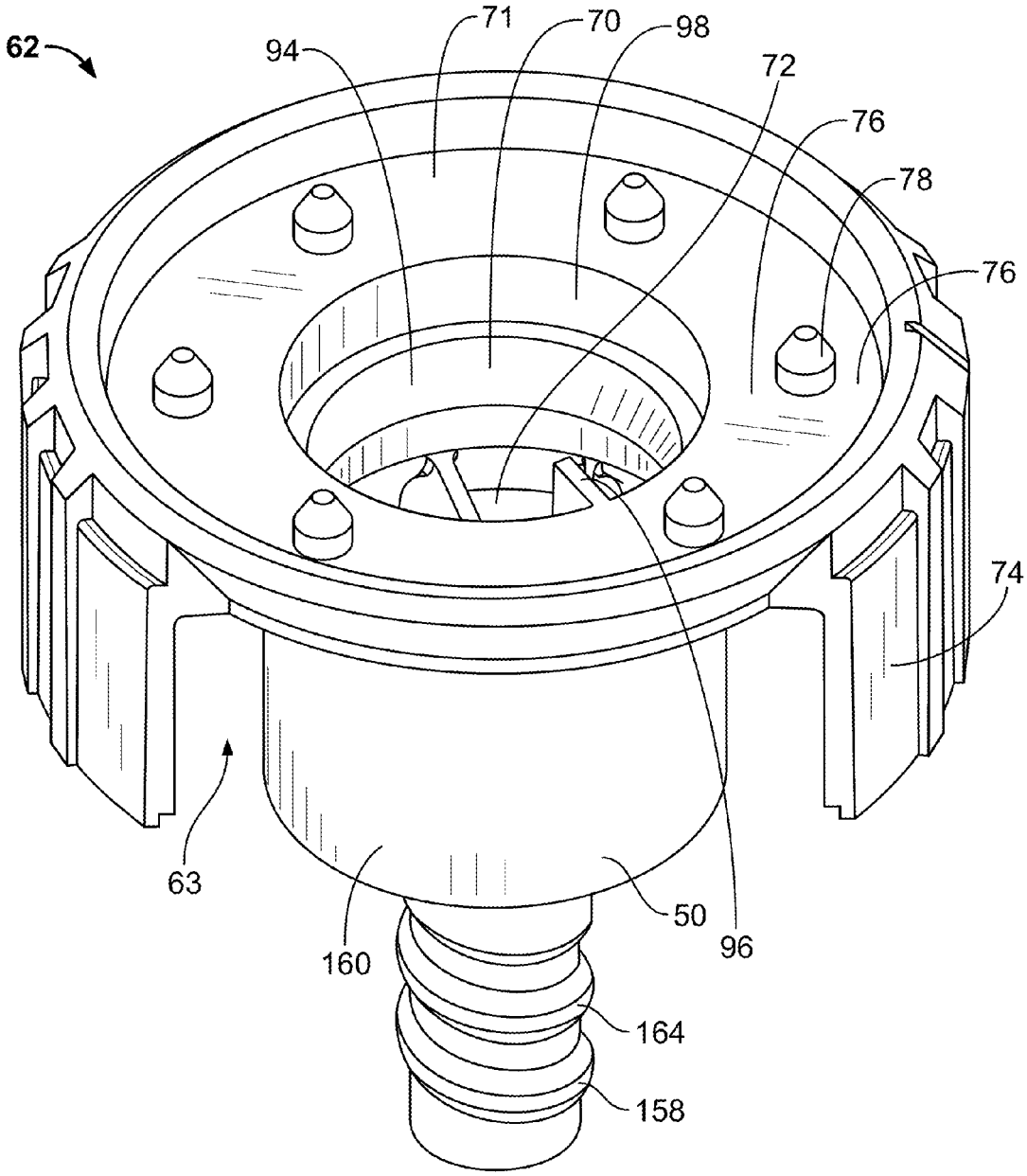
FIG. 9 is a top perspective view of the nozzle cover of the sprinkler head of FIG. 1.
Figure 12:
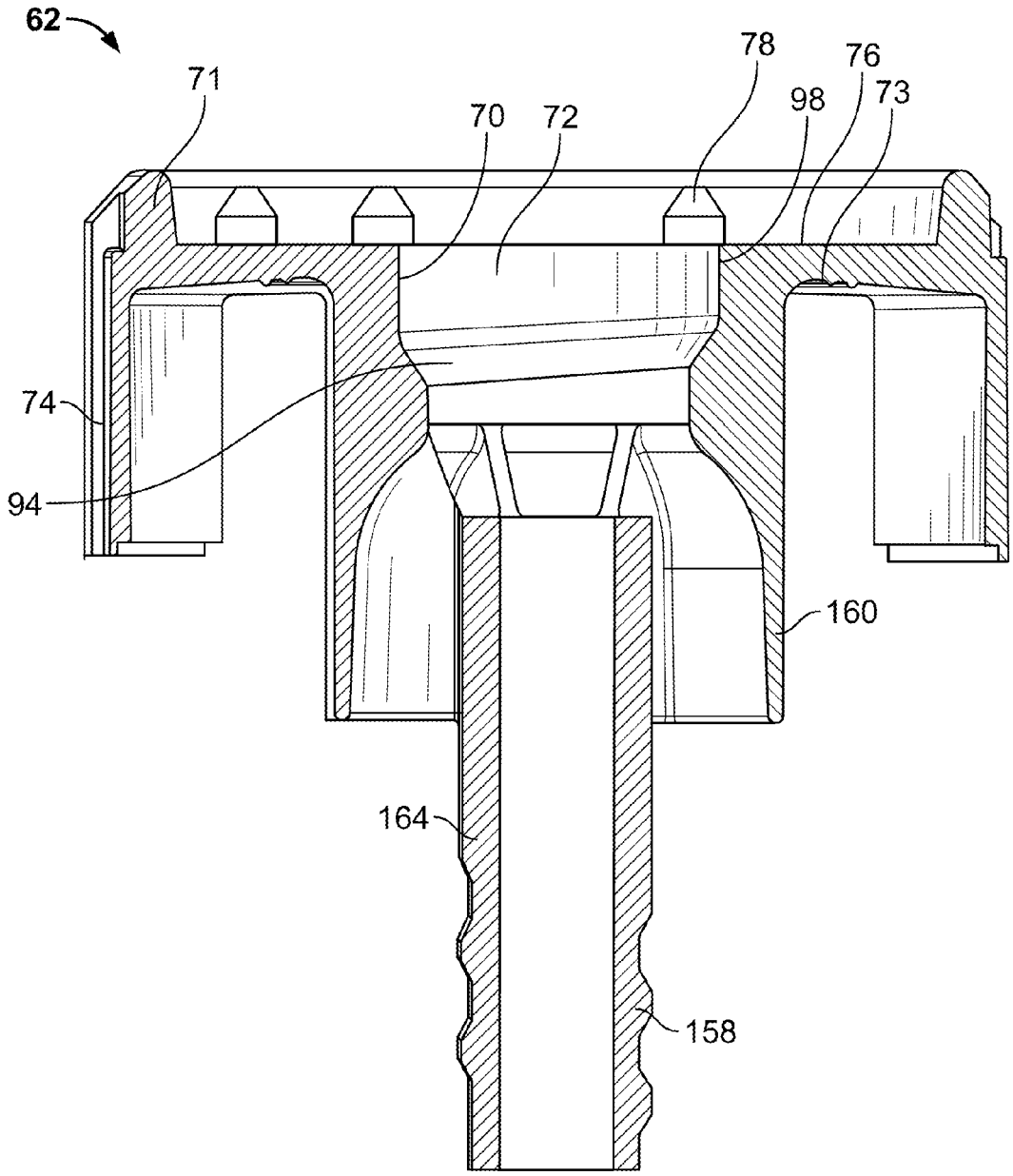
FIG. 12 is a cross-sectional view of the nozzle cover of the sprinkler head of FIG. 1.
Figure 13:
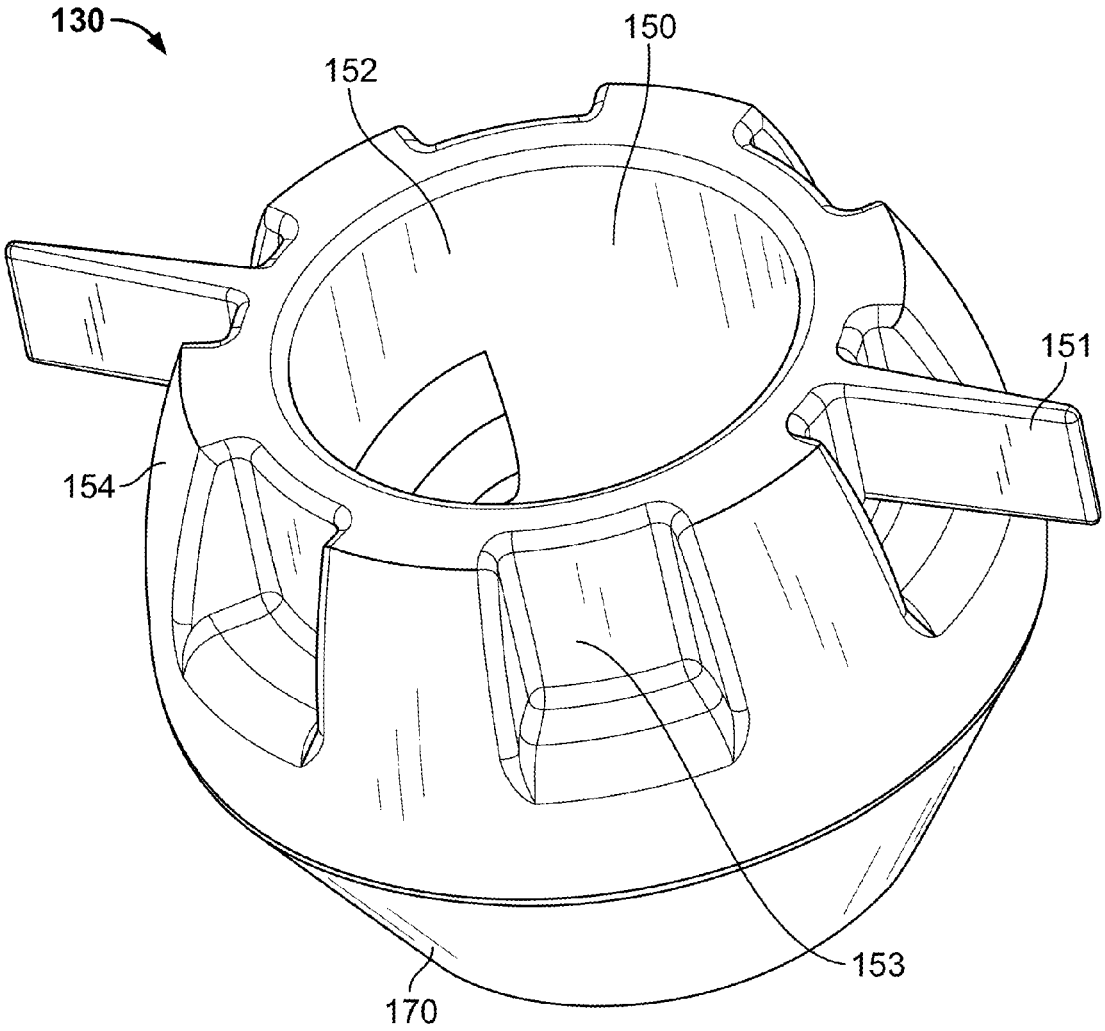
FIG. 13 is a top perspective view of the flow control member of the sprinkler head of FIG. 1.

As shown in FIGS. 9 and 12, the central hub 70 of the non-rotating nozzle cover 62 has an internal helical surface 94 that defines approximately one 360 degree helical revolution, or pitch. The ends are axially offset and joined by a fin 96, which projects radially inwardly from the central hub 70. The central hub 70 extends upwardly from the internal helical surface 94 into a raised cylindrical wall 98 with the fin 96 extending axially along the cylindrical wall 98.

Figure 2:
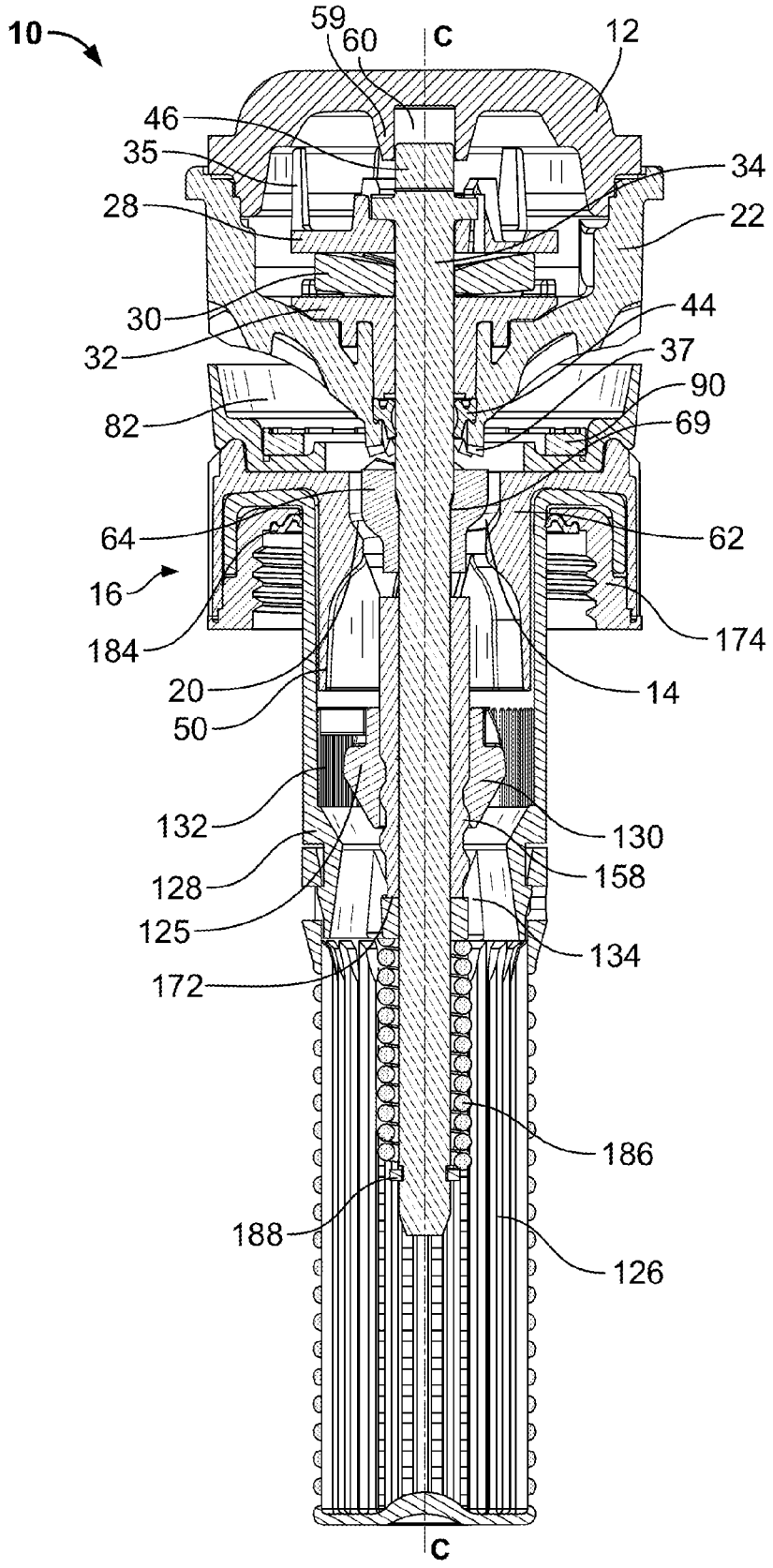
FIG. 2 is a cross-sectional view of the sprinkler head of FIG. 1.

The arcuate span of the sprinkler head 10 is determined by the relative positions of the internal helical surface 94 of the nozzle cover 62 and the complementary external helical surface 118 of the valve sleeve 64, which act together to form the arcuate slot 20. The camming interaction of the valve sleeve 64 with the nozzle cover 62 forms the arcuate slot 20, as shown in FIG. 2, where the arc is open on both sides of the C-C axis. The length of the arcuate slot 20 is determined by push down and rotation of the cap 12 (which in turn rotates the valve sleeve 64) relative to the non-rotating nozzle cover 62. The valve sleeve 64 may be rotated with respect to the nozzle cover 62 along the complementary helical surfaces through approximately one helical pitch to raise or lower the valve sleeve 64. The valve sleeve 64 may be rotated through approximately one 360 degree helical pitch with respect to the nozzle cover 62. The valve sleeve 64 may be rotated relative to the nozzle cover 62 to any arc desired by the user and is not limited to discrete arcs, such as quarter-circle and half-circle. As indicated above, although the arcuate slot 20 is generally adjustable through an entire 360 degree range, water flowing through the slot 20 may not be adequate to impart sufficient force for desired rotation of the deflector 22 when the slot 20 is set at relatively low angles.

In an initial lowermost position, the valve sleeve 64 is at the lowest point of the helical turn on the nozzle cover 62 and completely obstructs the flow path through the arcuate slot 20. As the valve sleeve 64 is rotated in the clockwise direction, however, the complementary external helical surface 118 of the valve sleeve 64 begins to traverse the helical turn on the internal surface 94 of the nozzle cover 62. As it begins to traverse the helical turn, a portion of the valve sleeve 64 is spaced from the nozzle cover 62 and a gap, or arcuate slot 20, begins to form between the valve sleeve 64 and the nozzle cover 62. This gap, or arcuate slot 20, provides part of the flow path for water flowing through the sprinkler head 10. The angle of the arcuate slot 20 increases as the valve sleeve 64 is further rotated clockwise and the valve sleeve 64 continues to traverse the helical turn. The valve sleeve 64 may be rotated clockwise until the rotating fin 114 on the valve sleeve 64 engages the fixed fin 96 on the nozzle cover 62. At this point, the valve sleeve 64 has traversed the entire helical turn and the angle of the arcuate slot 20 is substantially 360 degrees. In this position, water is distributed in a full circle arcuate span from the sprinkler head 10.

When the valve sleeve 64 is rotated counterclockwise, the angle of the arcuate slot 20 is decreased. The complementary external helical surface 118 of the valve sleeve 64 traverses the helical turn in the opposite direction until it reaches the bottom of the helical turn. When the surface 118 of the valve sleeve 64 has traversed the helical turn completely, the arcuate slot 20 is closed and the flow path through the sprinkler head 10 is completely or almost completely obstructed. Again, the fins 96 and 114 prevent further rotation of the valve sleeve 64. It should be evident that the direction of rotation of the valve sleeve 64 for either opening or closing the arcuate slot 20 can be easily reversed, i.e., from clockwise to counterclockwise or vice versa, such as by changing the thread orientation.

The sprinkler head 10 preferably allows for over-rotation of the cap 12 without damage to sprinkler components, such as fins 96 and 114. More specifically, the deflector teeth 37 and valve sleeve teeth 66 are preferably sized and dimensioned such that continued rotation of the cap 12 past the point of engagement of the fins 96 and 114 results in slippage of the teeth 37 out of the teeth 66. Thus, the user can continue to rotate the cap 12 without resulting in increased, and potentially damaging, force on fins 96 and 114.

When the valve sleeve 64 has been rotated to form the open arcuate slot 20, water passes through the arcuate slot 20 and impacts the raised cylindrical wall 98. The wall 98 redirects the water exiting the arcuate slot 20 in a generally vertical direction. Water exits the slot 20 and impinges upon the deflector 22 causing rotation and distribution of water through an arcuate span determined by the angle of the arcuate slot 20. The valve sleeve 64 may be adjusted to increase or decrease the angle and thereby change the arc of the water distributed by the sprinkler head 10, as desired. Where the valve sleeve 64 is set to a low angle, however, the sprinkler may be in a condition in which water passing through the slot 20 is not sufficient to cause desired rotation of the deflector 22.

In the embodiment shown in FIGS. 1-4, the valve sleeve 64 and nozzle cover 62 preferably engage each other to permit water flow with relatively undiminished velocity as water exits the arcuate slot 20. More specifically, the valve sleeve 64 includes a gently curved, radiused segment 116 that is preferably oriented to curve gradually radially outward to reduce the loss of velocity as water impacts the segment 116. As water passes through the arcuate slot 20, it impacts the segment 116 obliquely and then the cylindrical wall 98 obliquely, rather than at right angles, thereby reducing the loss of energy to maximize water velocity. The cylindrical wall 98 then redirects the water generally vertically to the underside of the deflector 22, where it is, in turn, redirected to surrounding terrain.

As shown in FIGS. 6-10, the sprinkler head 10 employs fins 96 and 114 to enhance and create uniform water distribution at the edges of the angular slot 20. As described above, one fin 96 projects inwardly from the nozzle cover 62 and the other fin 114 projects outwardly from the valve sleeve 64. The valve sleeve fin 114 rotates with the valve sleeve 64 while the nozzle cover fin 62 does not rotate. Each fin 96 and 114 extends both radially and axially a sufficient length to increase the axial flow component and reduce the tangential flow component, producing a well-defined edge to the water passing through the angular slot 20. The fins 96 and 114 are sized to allow for rotatable adjustment of the valve sleeve 64 within the bore 72 of the nozzle cover 62 while maintaining a seal.

The fins 96 and 114 define a relatively long axial boundary to channel the flow of water exiting the arcuate slot 20. This long axial boundary reduces the tangential components of flow along the boundary formed by the fins 96 and 114. Also, as shown in FIGS. 6-10, the fins 96 and 114 extend radially to reduce the tangential flow component. The valve sleeve fin 114 extends radially outwardly so that it preferably engages the inner surface of the nozzle cover hub 70. The nozzle cover fin 96 extends radially inwardly so that it preferably engages the outer surface of the valve sleeve 64. By extending the fins radially, water substantially cannot leak into the gaps that would otherwise exist between the valve sleeve 64 and nozzle cover 62. Water leaking into such gaps would otherwise provide a tangential flow component that would interfere with water flowing in an axial direction to the deflector 22. The fins 96 and 114 therefore reduce this tangential component.

Unlike previous designs, the sprinkler head 10 includes a spring 186 mounted near the lower end of the shaft 34 that downwardly biases the shaft 34. In turn, the shaft shoulder 69 exerts a downward force on the valve sleeve 64 for pressed fit engagement with the nozzle cover 62, as can be seen in FIGS. 2-4. Spring 186 is preferably a coil spring mounted about the lower end of the shaft 34, although other types of springs or elastic members may be used. The spring 186 preferably extends between a retaining ring 188 at one end and the inlet 134 at the other end. Optionally, the sprinkler head may include a washer mounted between the spring 186 and the retaining ring 188. The spring 186 provides a downward biasing force against the shaft 34 that is transmitted to the valve sleeve 64. In this manner, the spring 186 functions to energize the engagement between the helical surfaces that form the arc adjustment valve 14.

Spring 186 also allows for a convenient way of flushing the sprinkler head 10. More specifically, a user may pull up on the cap 12 and deflector 22 to compress the spring 186 and run fluid through the sprinkler head 10. This upward force by the user on the cap 12 and deflector 22 allows the valve sleeve 64 to be spaced above the nozzle cover 62. The fluid will flush grit and debris that is trapped in the body of the sprinkler head 10, especially debris that may be trapped in the narrow arcuate slot 20 and between the valve sleeve 64 and the upper cylindrical wall of the nozzle cover 62. Following flushing, spring 186 returns valve sleeve 64 to its non-flushing position.

This arrangement of parts also prevents removal and possible misplacement of the cap 12 and deflector 22.

This flushing aspect of the sprinkler also reduces a water hammer effect that may cause damage to sprinkler components during start up or shut down of the sprinkler. This water hammer effect can result due to the decrease in flow area as water approaches valve 20, which may be in a completely closed position. This decrease in flow area can cause a sudden pressure spike greater than the upstream pressure. More specifically, the pressure spike in the upstream pressure can be caused as the motion energy in the flowing fluid is abruptly converted to pressure energy acting on the valve 20. This pressure spike can cause the valve 20 to experience a water hammer effect, which can undesirably result in increased stress on the components of the valve 20, as well as other components of the irrigation system, and can lead to premature failure of the components. The elasticity of the spring 186 is preferably selected so that the valve sleeve 64 can overcome the bias of the spring 186 in order to be spaced above the nozzle cover 62 during a pressure spike to relieve a water hammer effect. In other words, the sprinkler head 10 essentially self-flushes during a pressure spike.

This spring arrangement also improves the concentricity of the valve sleeve 64. More specifically, the valve sleeve 64 has a long axial boundary with the shaft 34 and is in press fit engagement with the shaft 34. This spring arrangement thereby provides a more uniform radial width of the arcuate slot 20, regardless of the arcuate length of the slot 20. It makes the sprinkler head 10 more resistant to side load forces on the valve 20 that might otherwise result in a non-uniform radial width and an uneven water distribution. In addition, the mounting of the spring 186 at the bottom of the sprinkler head 10 also allows for easier assembly, unlike previous designs.

Figure 28:
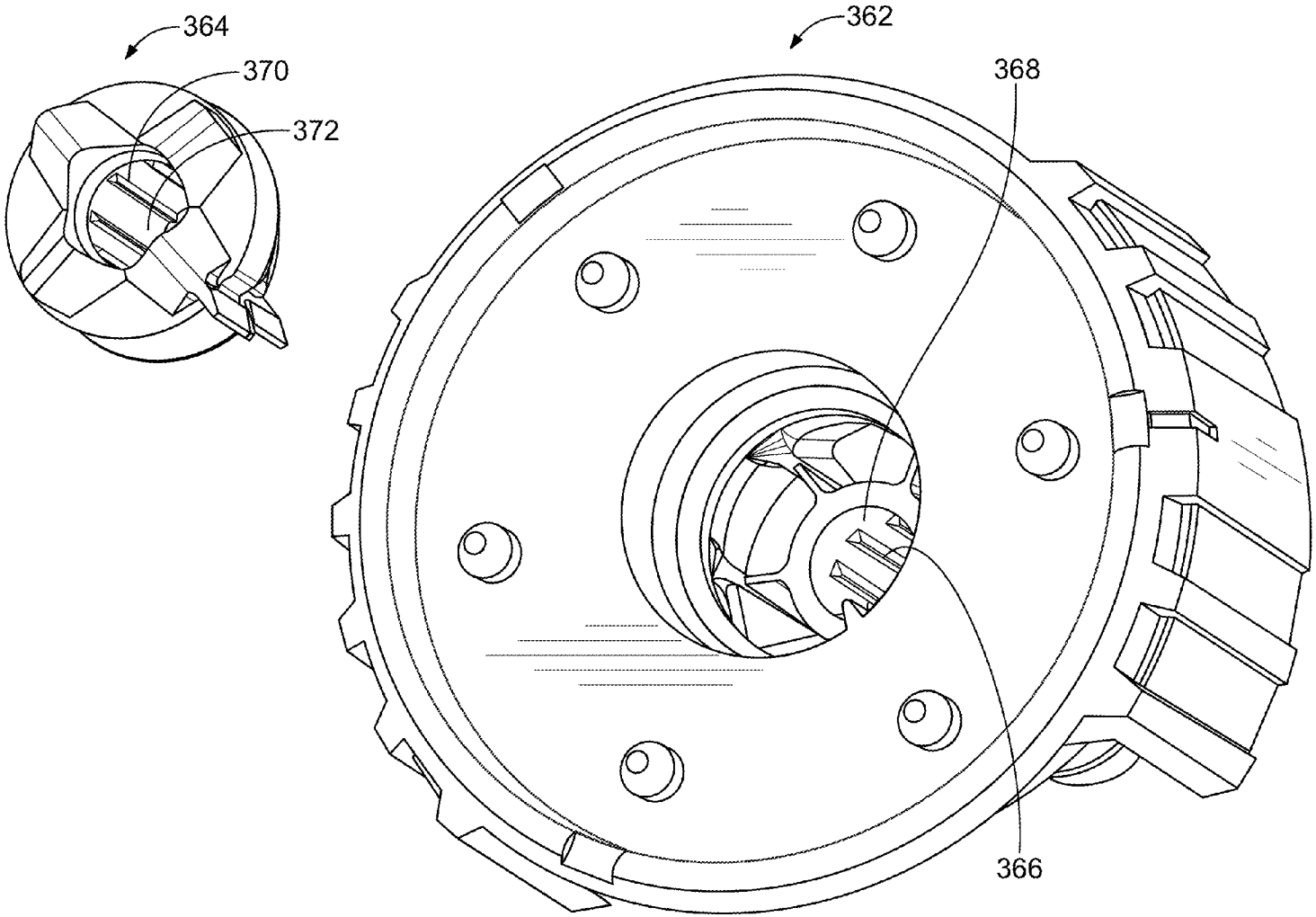
FIG. 28 is a top perspective view of an alternative valve sleeve and alternative nozzle cover for use with the sprinkler head of FIG. 1.
Figure 29:
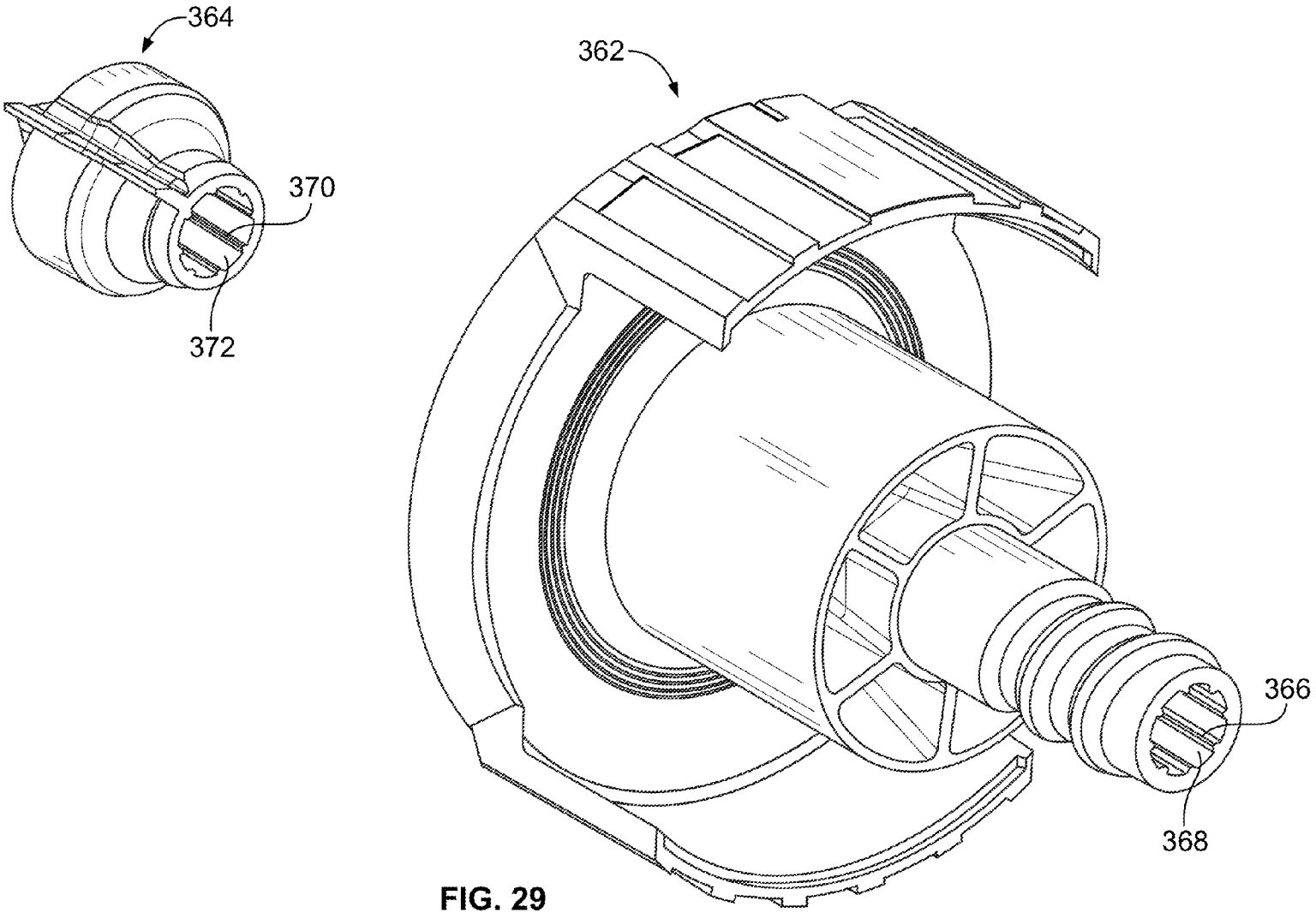
FIG. 29 is a bottom perspective view of the alternative valve sleeve and alternative nozzle cover of FIG. 28.

Alternative preferred forms of nozzle cover 362 and valve sleeve 364 for use with sprinkler head 10 are shown in FIGS. 28 and 29 and provide additional improved concentricity. As can be seen, nozzle cover 362 includes circumferentially-arranged and equidistantly-spaced crush ribs 366 that extend axially along the inside of the central hub 368. Similarly, valve sleeve 364 includes circumferentially-arranged and equidistantly-spaced crush ribs 370 that extend axially along the inside of the central hub 372. These crush ribs 366 and 370 engage the shaft 34 and help keep the nozzle cover 362 and valve sleeve 364 centered with respect to the shaft 34. These crush ribs 366 and 370 allow for variations in manufacturing and allow for greater tolerances in the manufacture of the nozzle cover 362 and valve sleeve 364. It is desirable to have the nozzle cover 362 and valve sleeve 364 centered as much as practicable with respect to the shaft 34 to maintain a uniform width of the arcuate slot 20. The nozzle cover 362 and valve sleeve 364 are otherwise generally similar in structure to nozzle cover 62 and valve sleeve 64, except as shown in FIGS. 28 and 29.

Figure 33:
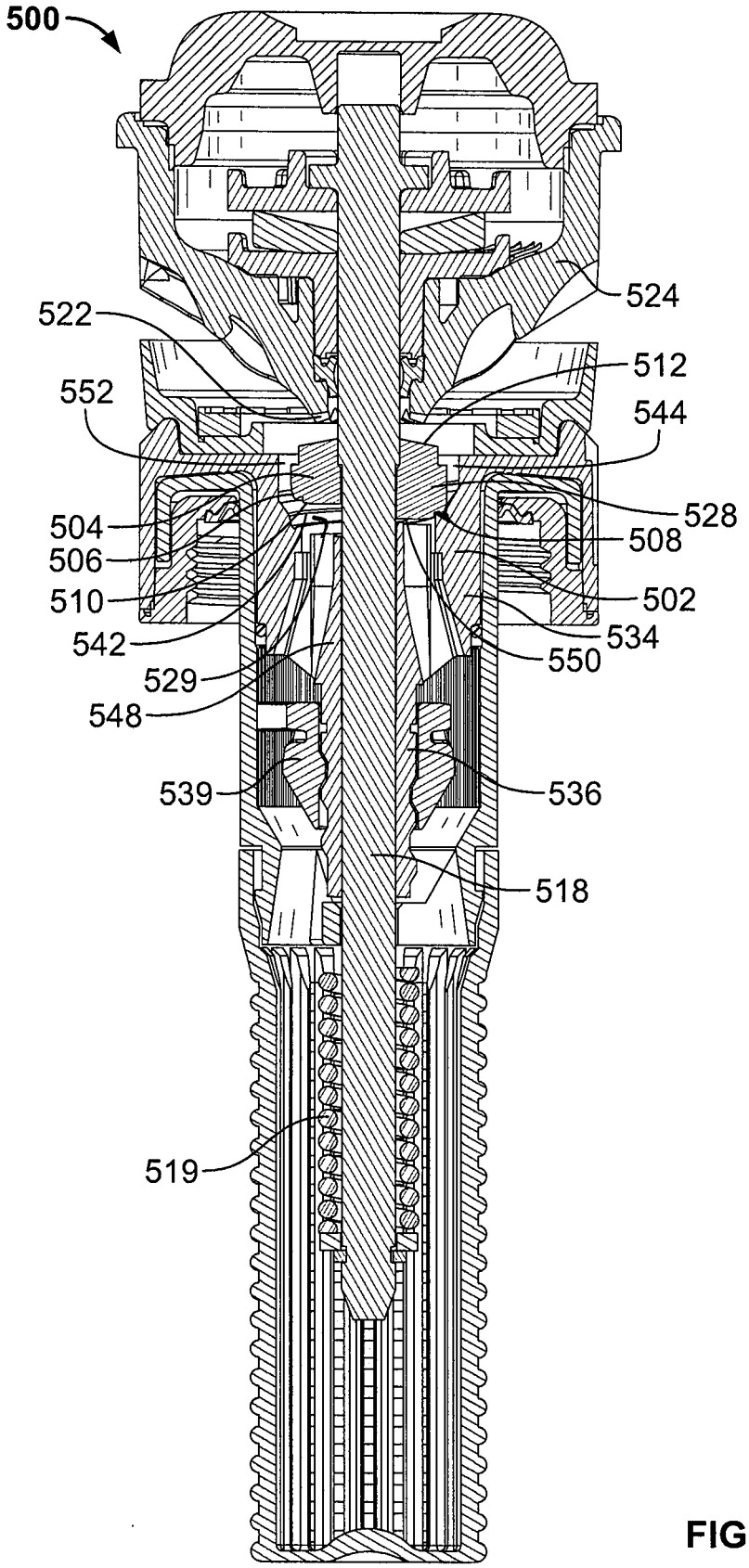
FIG. 33 is a cross-sectional view of a third embodiment of a sprinkler head having an alternative notched valve sleeve and an alternative corresponding nozzle cover.
Figure 34:
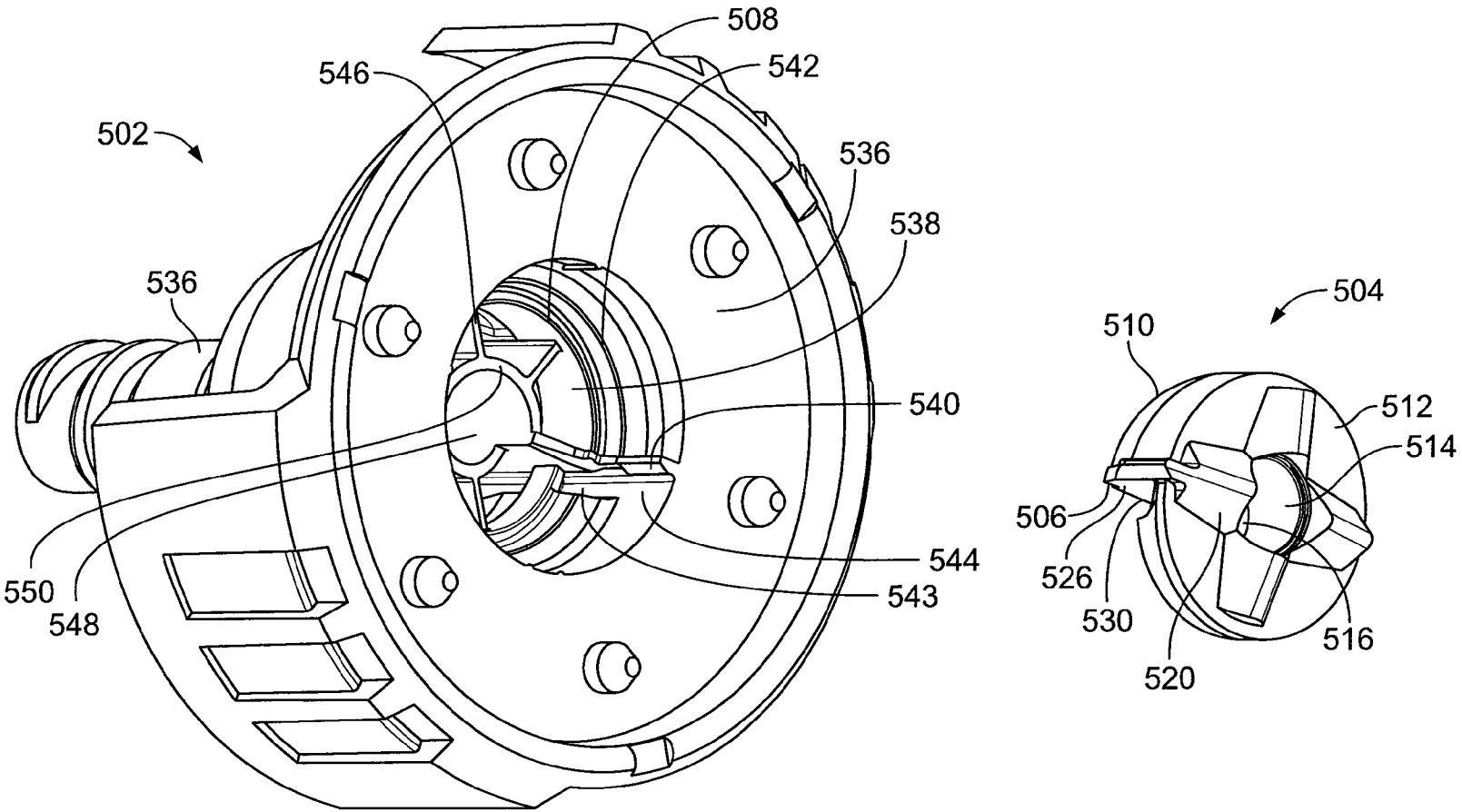
FIG. 34 is a top perspective view of the valve sleeve and nozzle cover of FIG. 33.
Figure 35:
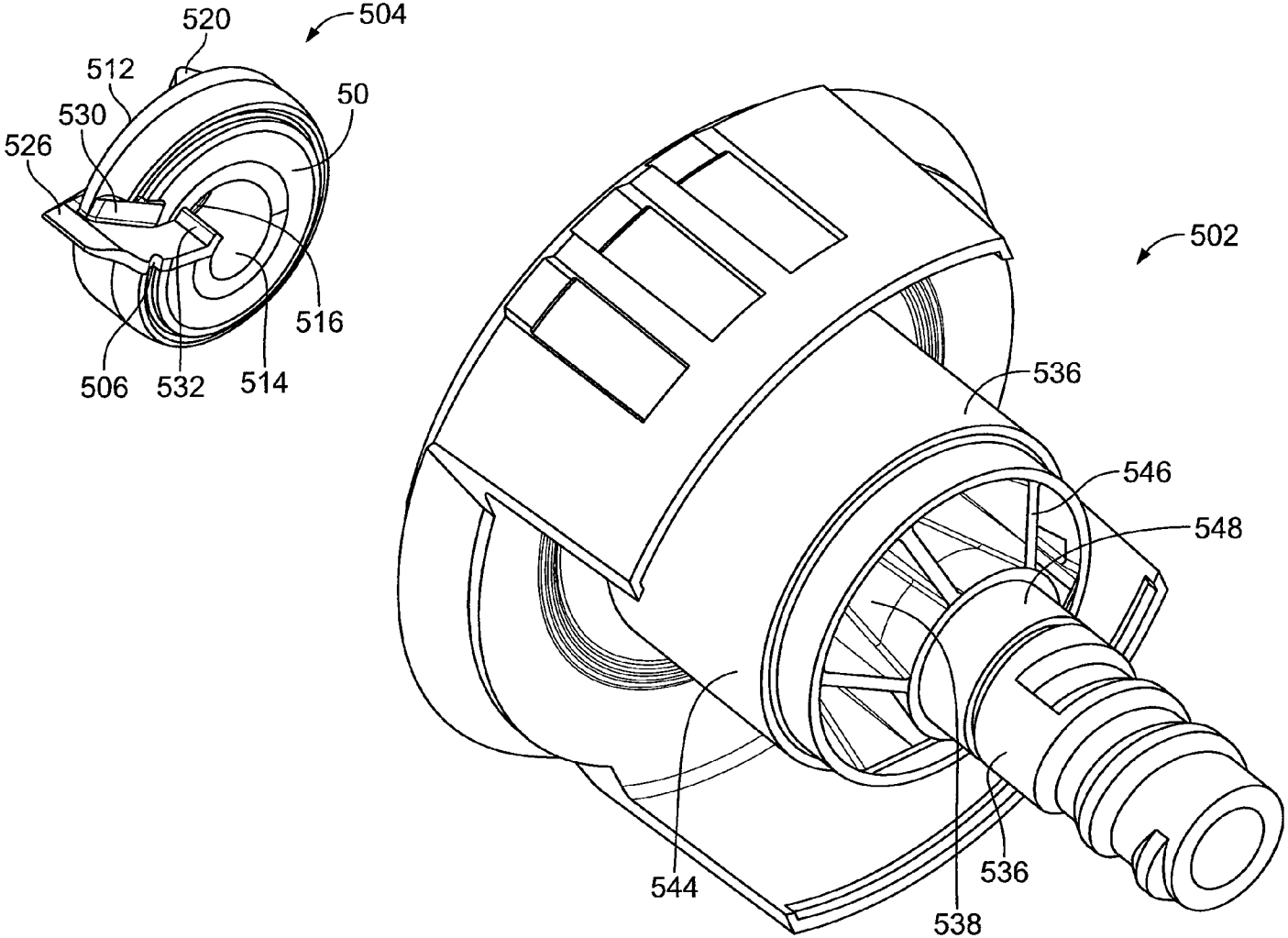
FIG. 35 is a bottom perspective view of the valve sleeve and nozzle cover of FIG. 33.

A second alternative preferred form of the nozzle cover 502 and valve sleeve 504 for use with sprinkler head 500 is shown in FIGS. 33-35. The nozzle cover 502 and valve sleeve 504 have additional support surfaces 506 and 508 that improve concentricity by limiting radial movement of the valve sleeve 504 that might position the valve sleeve 504 off-center and that improve the seal between the nozzle cover 502 and valve sleeve 504. More specifically, as described further below, the valve sleeve 504 preferably has a helical notch 506 that extends along the outer helical circumference of its bottom surface 510. Also as described further below, this helical notch 506 preferably engages a corresponding helical ledge 508 in the nozzle cover 502 to provide additional support for improved concentricity and an improved seal to reduce leakage.

As shown in FIGS. 33-35, the valve sleeve 504 preferably has a different profile than those valve sleeves described above. More specifically, the valve sleeve 504 has a flatter, ring-like profile, i.e., it has reduced spacing between its top surface 512 and bottom surface 510. Like the valve sleeves described above, the valve sleeve 504 includes a central hub 514 that defines a bore 516 for insertion of the shaft 518. In this form, the shaft preferably has three segments having different diameters with transitions from one segment to the next to increase engagement between the shaft 518 and other components of the sprinkler head. Again, the spring 519 exerts a downward biasing force against the shaft 518, which in turn results in a force pushing the valve sleeve 504 downwardly against the nozzle cover 502.

In this preferred form, the top surface 512 includes teeth 520 for engagement with corresponding teeth 522 of the deflector 524. A user pushes down the deflector 524 causing the deflector teeth 522 to engage the valve sleeve teeth 520. The user then rotates the deflector 524 causing rotation of the valve sleeve 504 to the desired distribution arc.

The valve sleeve 504 preferably has a fin 526 joining the helical ends of the bottom surface 510 (described below) that improves fluid flow at a first edge of the valve 528. The fin 526 extends both radially outward and axially to allow increased fluid flow along the valve edge. The valve sleeve 504 preferably also includes an indented portion 530 extending upwardly from the bottom surface 510 and adjacent the fin 526 to allow increased fluid flow along the valve edge, and the central hub 514 preferably includes a stop 532. It has been determined that the fin 526 and indented portion 530 assist in increasing fluid flow along one edge of the distribution arc and result in a more well-defined spray pattern edge.

The stop 532 preferably is sized to engage the nozzle cover 502 to limit rotation of the valve sleeve 504 to arc settings below a predetermined minimum arc, preferably about 60°. As described above, at low arc settings, the fluid passing upwardly through the valve 528 may have insufficient force to effect proper rotation of the deflector 524. Thus, in this preferred form, the arc setting is adjustable from a predetermined minimum arc, preferably about 60°, to a maximum arc, about 360°. It should be evident, however, that the range of coverage could be modified to different predetermined minimum and maximum arc settings.

In this preferred form, the valve sleeve 504 also includes a helical bottom surface 510. Unlike the valve sleeves described above, the lower portion of the valve sleeve 504 is not cylindrical, but instead defines a helical surface 510. The helical bottom surface 510 also preferably includes a helical notch 506 that extends along the outer circumference thereof. When valve sleeve 504 is rotated, the helical bottom surface 510 cams against the nozzle cover 502 (described below) to determine the length of the arcuate opening 529 of the valve 528. The valve 528 can be seen to be open on the left and closed on the right in FIG. 33.

The engagement of the notch 506 with the corresponding ledge 508 of the nozzle cover 502 (described below) has been found to minimize "rocking" of the valve sleeve 504. This "rocking" effect has been found to become pronounced for wider arc distribution settings, such as greater than 180°, with the effect becoming especially pronounced for very wide distribution settings, such as 270° to 360° (all the way open). Fluid flowing through the valve 528 exerts upwardly-directed and radially-directed forces against the valve sleeve 504, and this "rocking" effect has been found to occur at wide settings because there is less engagement between the surfaces of the valve sleeve 504 and nozzle cover 502. At lower angular settings, the engagement between the surfaces results in inwardly directed forces that tend to cancel out one another. At wider settings, however, this engagement tends to exert an increasingly unbalanced inwardly directed force that tends to cause the valve sleeve 504 to become off-center. The addition of the notch 506 and ledge 508 provide greater support to resist the unbalanced force occurring at wide distribution settings. By maintaining the engagement of valve sleeve 504 and nozzle cover 502, the notch 506 and ledge 508 also provide a good seal between valve sleeve 504 and nozzle cover 502.

As shown in FIGS. 33-35, the nozzle cover 502 preferably has some of the same structure as those nozzle covers described above. It has a generally cylindrical top portion 534 and a bottom hub portion 536. The top portion 534 preferably defines an outer bore 538 for insertion of the valve sleeve 504 to form the arc adjustment valve 528, and the bottom portion 536 preferably engages a flow control member 539 for flow rate adjustment. The nozzle cover 502 preferably includes a fin 540 that joins ends of helical surface 542 (described below) and extends axially and radially inward to improve fluid flow at a second edge of the valve 528. The nozzle cover 502 also preferably has a channel 543 adjacent the fin 540 to increase fluid flow along the second edge. The nozzle cover 502 generally includes the same features as the previously-described embodiments, except as described further herein.

In this preferred form, the top portion 534 includes a central hub 544 that defines the outer bore 538 for insertion of the valve sleeve 504. The central hub 544 includes an outer helical surface 542 for engagement with the outer helical circumference of the valve sleeve bottom surface 510. In this preferred form, the ribs 546 are spaced from the valve sleeve bottom surface 510 but extend further downstream than in the previously-described nozzle covers. The ribs 546 join the central hub 544 to inner cylinder 548. Inner cylinder 548 forms a helical top surface 550 that is preferably spaced upstream from the valve sleeve bottom surface 510. Again, during rotation of the valve sleeve 504, the valve sleeve 504 cams against the helical surface 542 to define the size of the valve 528. Fluid flowing through the valve 528 flows generally upwardly to impact the bottom helical surface 510 of the valve sleeve 504, is then redirected to impact a cylindrical wall 552 of the nozzle cover 502, and is then redirected upwardly to impact the deflector 524.

As shown in FIGS. 33 and 34, the nozzle cover central hub 544 also preferably includes a helical ledge 508 (or helical protrusion) located just upstream of the outer helical surface 542. This helical ledge 508 is sized for reception within the valve sleeve helical notch 506. As described above, this engagement of notch 506 and ledge 508 provides support to limit "rocking" of the valve sleeve 504 at wide valve settings, thereby improving concentricity of the valve sleeve 504 and improving sealing between valve sleeve 504 and nozzle cover 502.

The helical notch 506 and ledge 508 may have different dimensions and characteristics depending on design convenience. For example, the helical ledge 508 may have different angles of inclination from approximately horizontal (directed radially inward) to vertical (directed axially downstream). Similarly, the corresponding notch 506 may be inclined at the same angle or may have an intentionally different mismatched angle to limit "rocking" and/or a better seal to limit leakage. In one preferred form, the angle of inclination of the helical ledge 508 is about 30° while the notch inclination is mismatched by about 10° from that angle. Additionally, the helical ledge 508 may have any of various cross-sections, such as triangular or rectangular. Further, the width and depth of the protruding ledge 508 may be adjusted as desired. Similarly, the valve sleeve notch 506 may be sized to receive a ledge 508 of various cross-sections, may be deeper or shallower to receive ledges 508 of different depths, and may be wider or narrower to receive ledges 508 of different widths. It should also be evident that the ledge 508 and notch 506 may be switched such that the valve sleeve 504 has the ledge 508 and the nozzle cover 502 has the notch 506.

Figure 36:
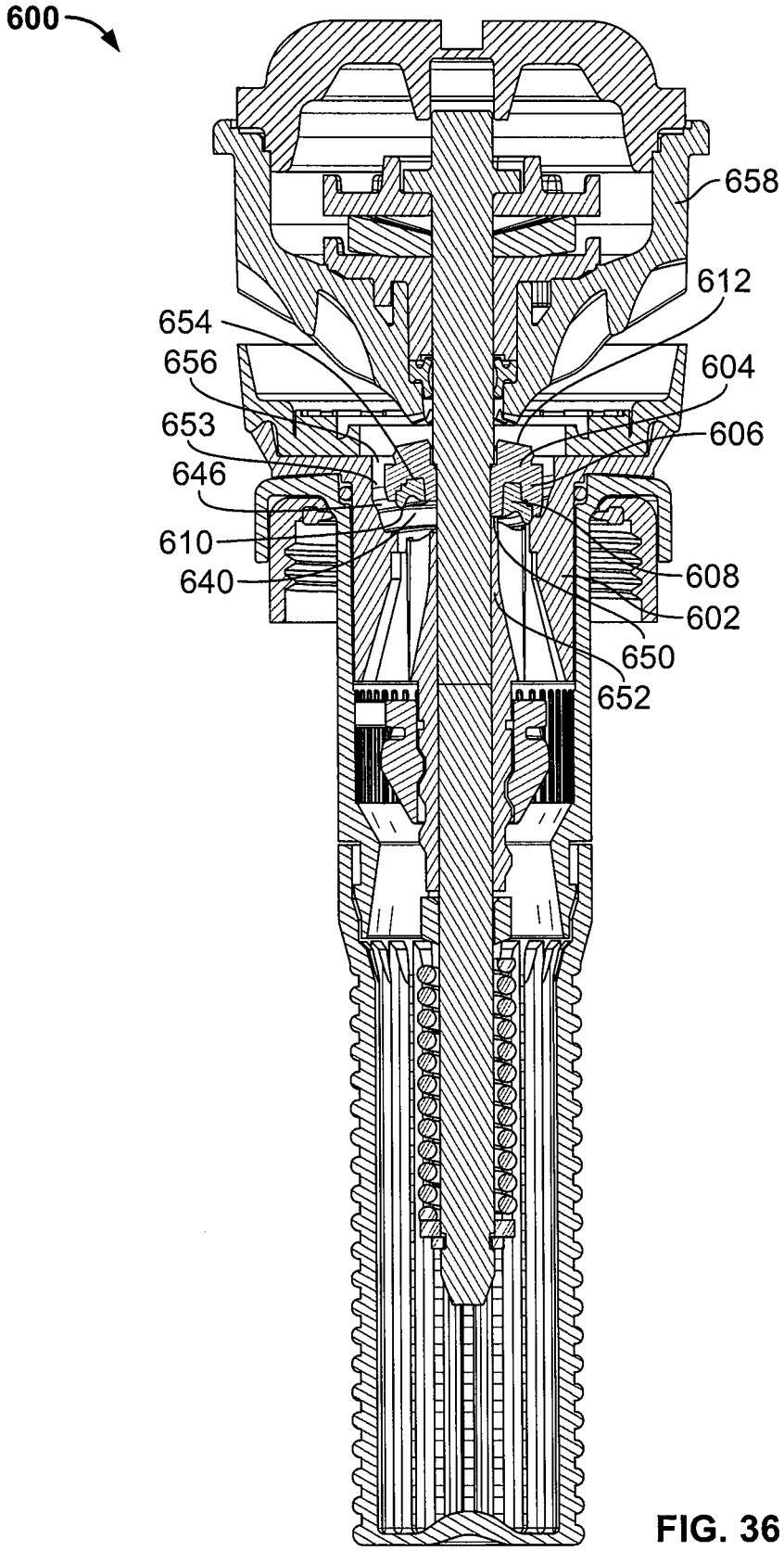
FIG. 36 is a cross-sectional view of a fourth embodiment of a sprinkler head of FIG. 1 having an alternative valve sleeve with an overmolded portion and an alternative nozzle cover.
Figure 37:
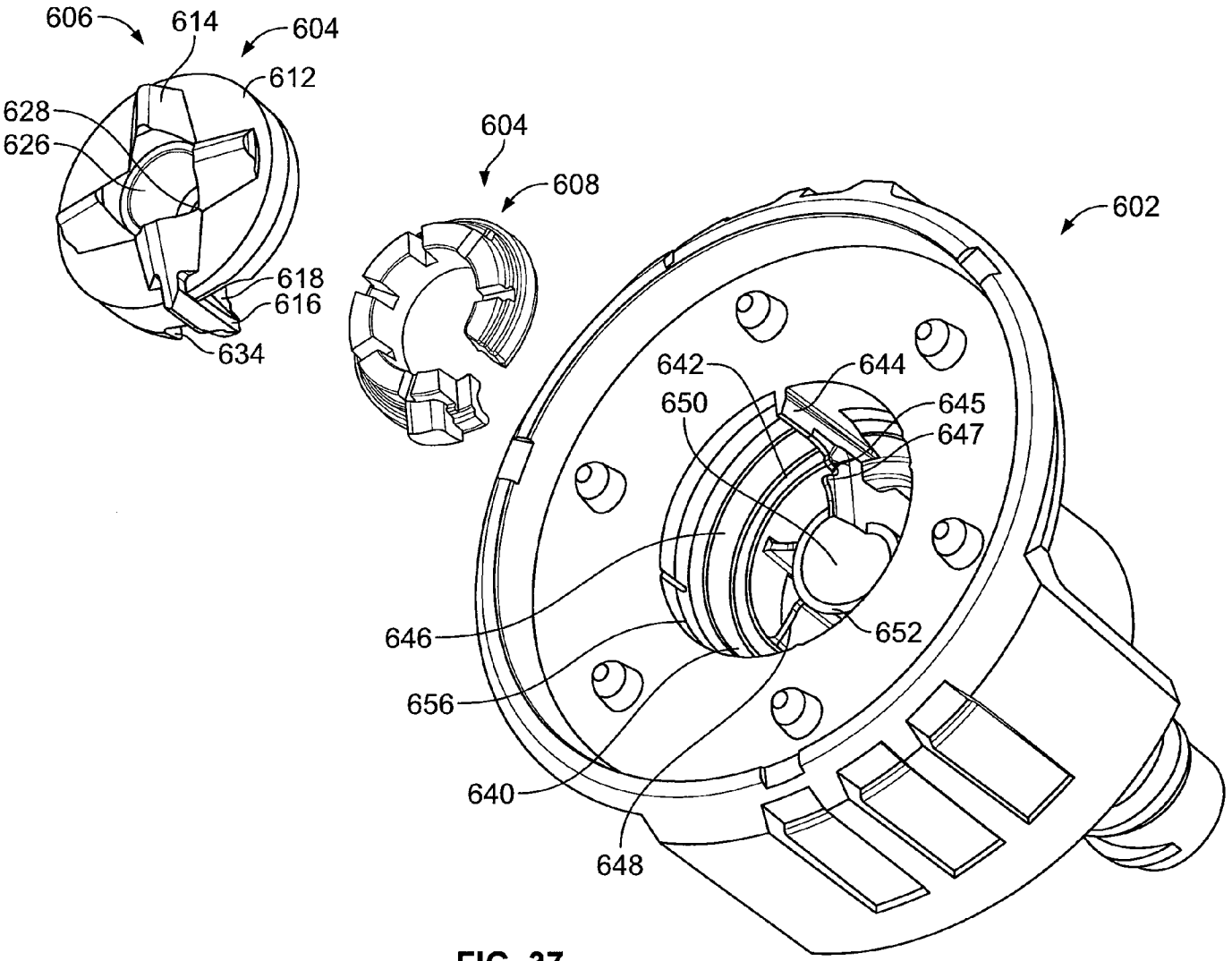
FIG. 37 is a top perspective view of the valve sleeve, the overmolded portion, and nozzle cover of FIG. 36.
Figure 38:
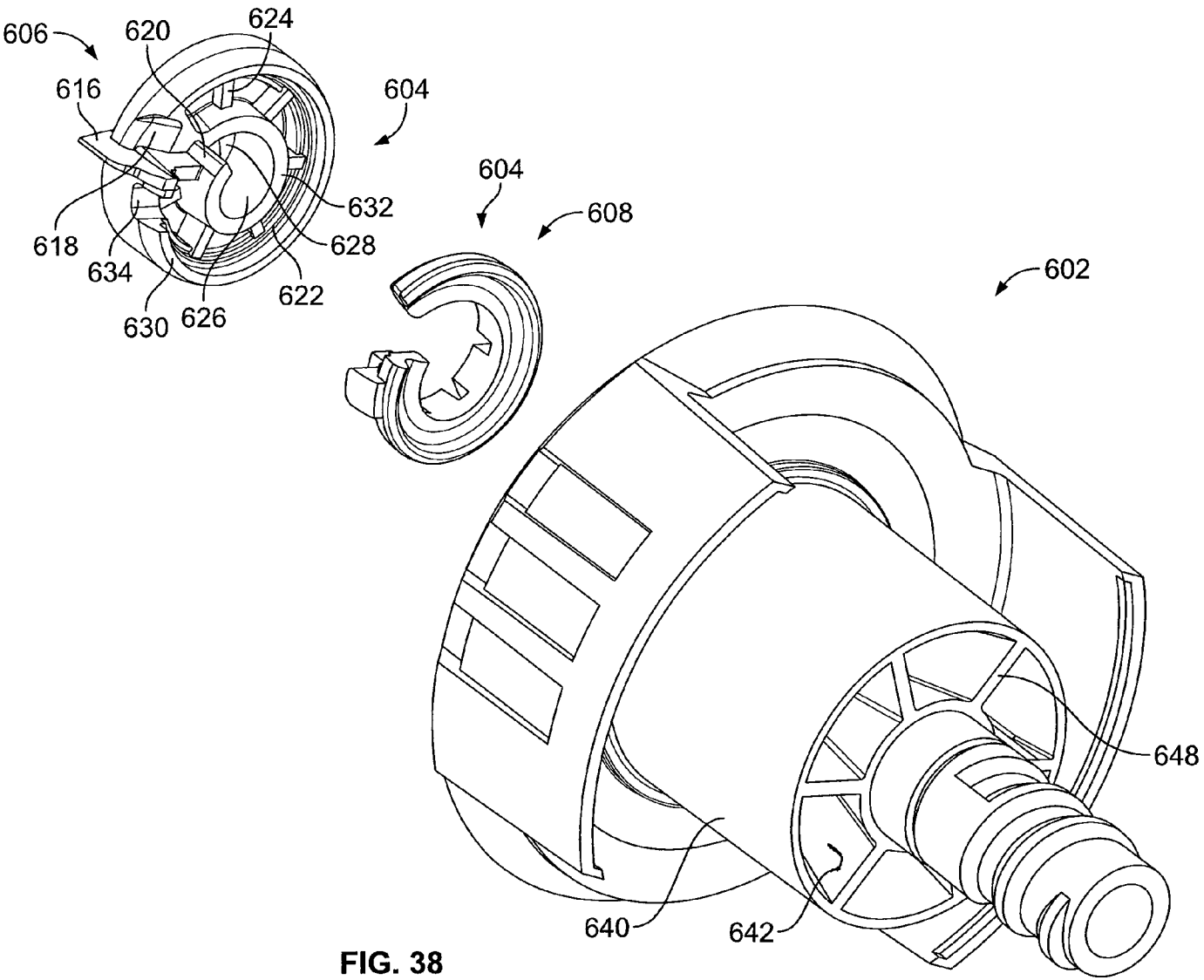
FIG. 38 is a bottom perspective view of the valve sleeve, the overmolded portion, and the nozzle cover of FIG. 36.

A third alternative preferred form of the nozzle cover 602 and valve sleeve 604 in sprinkler head 600 is shown in FIGS. 36-38. This third alternative form is similar in some ways to the second alternative form described above. The valve sleeve 604, however, is not formed of a single integral piece. Instead, the valve sleeve 604 includes a valve sleeve body 606 (or base portion) and an overmolded portion 608 to form the valve sleeve bottom surface 610. As described further below, the overmolded portion 608 engages the nozzle cover 602 and provides a good seal to limit leakage.

Like the second alternative form, the valve sleeve body 606 preferably includes a top surface 612 with upwardly directed teeth 614. Also, like the second alternative form, the valve sleeve body 606 preferably includes a fin 616 that extends radially outward and axially, an indented portion 618, and a stop 620. Unlike the second alternative form, however, the valve sleeve body 606 includes a hollow underside for overmolding of the overmolded portion 608. For ease of overmolding, the valve sleeve body 606 preferably includes a grooved outer wall 622 and ribs 624 joining the outer wall 622 to a central hub 626 that defines bore 628. The bottom surfaces 630 and 632 of the outer wall 622 and central hub 626 are preferably helical. For overmolding purposes, the valve sleeve body 606 also preferably includes a gate 634 formed in the outer wall 622 adjacent the fin 616.

In this preferred form, the overmolded portion 608 is shown in FIGS. 36-38. It is preferably formed of an elastomeric material, such as a thermoplastic elastomer (TPE). It is overmolded onto the underside of the valve sleeve body 606, which is preferably a thermoplastic substrate. A two-shot molding process is preferably used for molding and then overmolding the valve sleeve 604, although other molding processes may also be used. After overmolding, the overmolded portion 608 forms, in part, a helical bottom surface 610 for engagement with the nozzle cover 602. The TPE material provides elasticity to provide a good sealing engagement between the overmolded portion 608 and nozzle cover 602.

In this preferred form, the nozzle cover 602 is similar in structure to that described above for the second alternative preferred form. The nozzle cover 602 preferably includes a central hub 640 defining a bore 642 for insertion of the valve sleeve 604 and a fin 644 that extends axially and radially inward. The fin 644 preferably includes a cutout 645 adjacent a lip 647 for reception of the overmolded portion 608 to improve sealing at the fin 644 and prevent leakage. The central hub 640 also includes a helical surface 646 for engagement with the valve sleeve 604 and ribs 648 spaced upstream of the valve sleeve 604. The valve sleeve 604 also preferably engages the top helical surface 650 of the inner cylinder 652. When the valve sleeve 604 is rotated, its bottom surface 610 cams against the nozzle cover 602 to define the length of the arcuate opening 653 of the valve 654. In FIG. 36, the valve 654 is shown open on the left and closed on the right. Fluid flowing through the valve 654 flows generally upwardly to impact the underside of the valve sleeve 604, is redirected to impact against the cylinder wall 656, and is then redirected upwardly to strike the deflector 658.

As shown in FIGS. 39-42, the sprinkler head 700 may also include a lock-out feature 702 to prevent incidental or intentional manipulation of the arc adjustment setting. When in a locked position, this feature 702 would prevent slight or unintentional contact with the sprinkler head 700 from causing alteration of the length of the arcuate opening 704. In addition, when in a locked position, it would also make it more difficult for intentional alteration of the arc setting, such as, for example, by a mischievous passerby.

Figure 18:
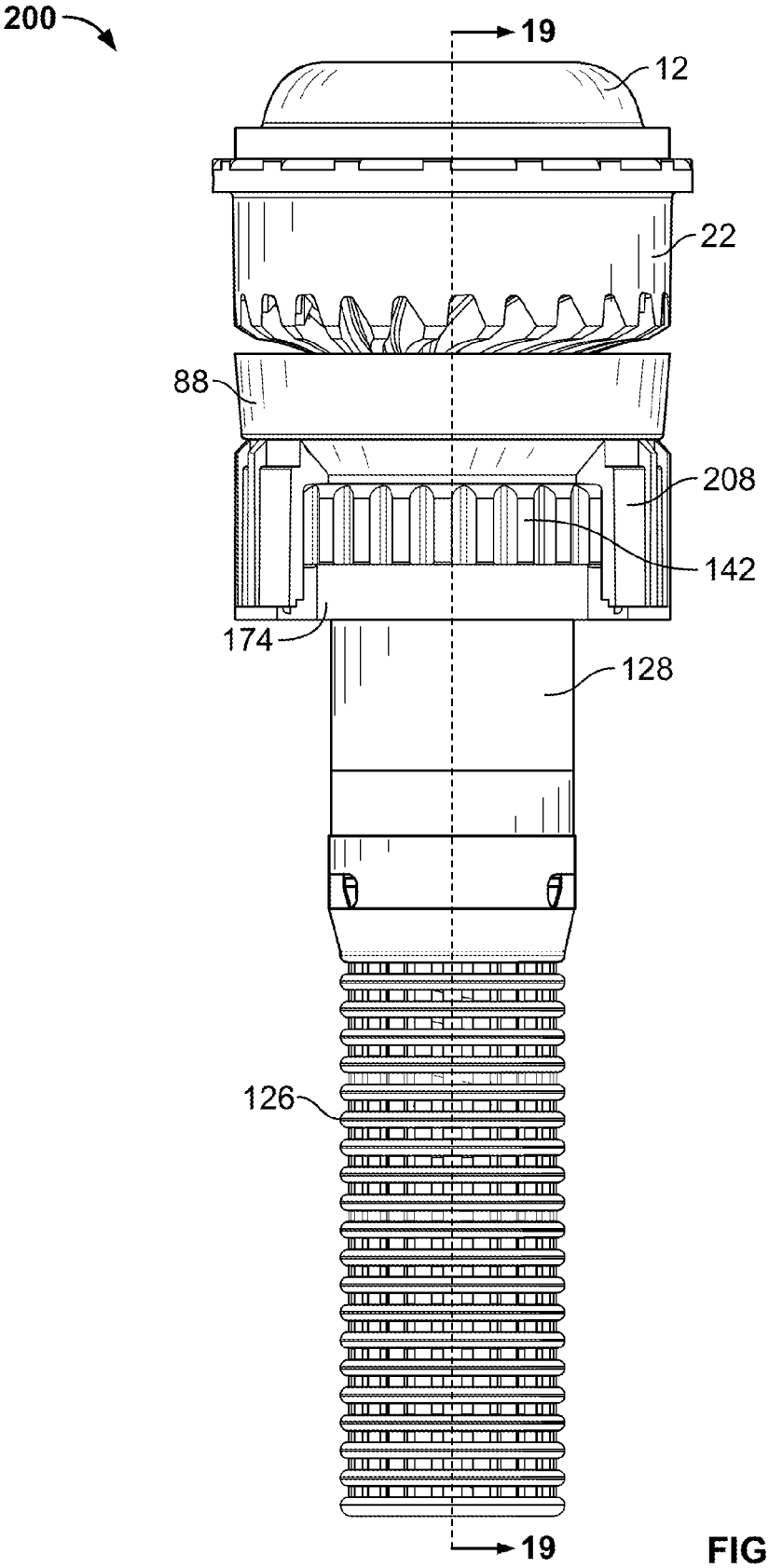
FIG. 18 is a perspective view of a second embodiment of a sprinkler head embodying features of the present invention.
Figure 19:
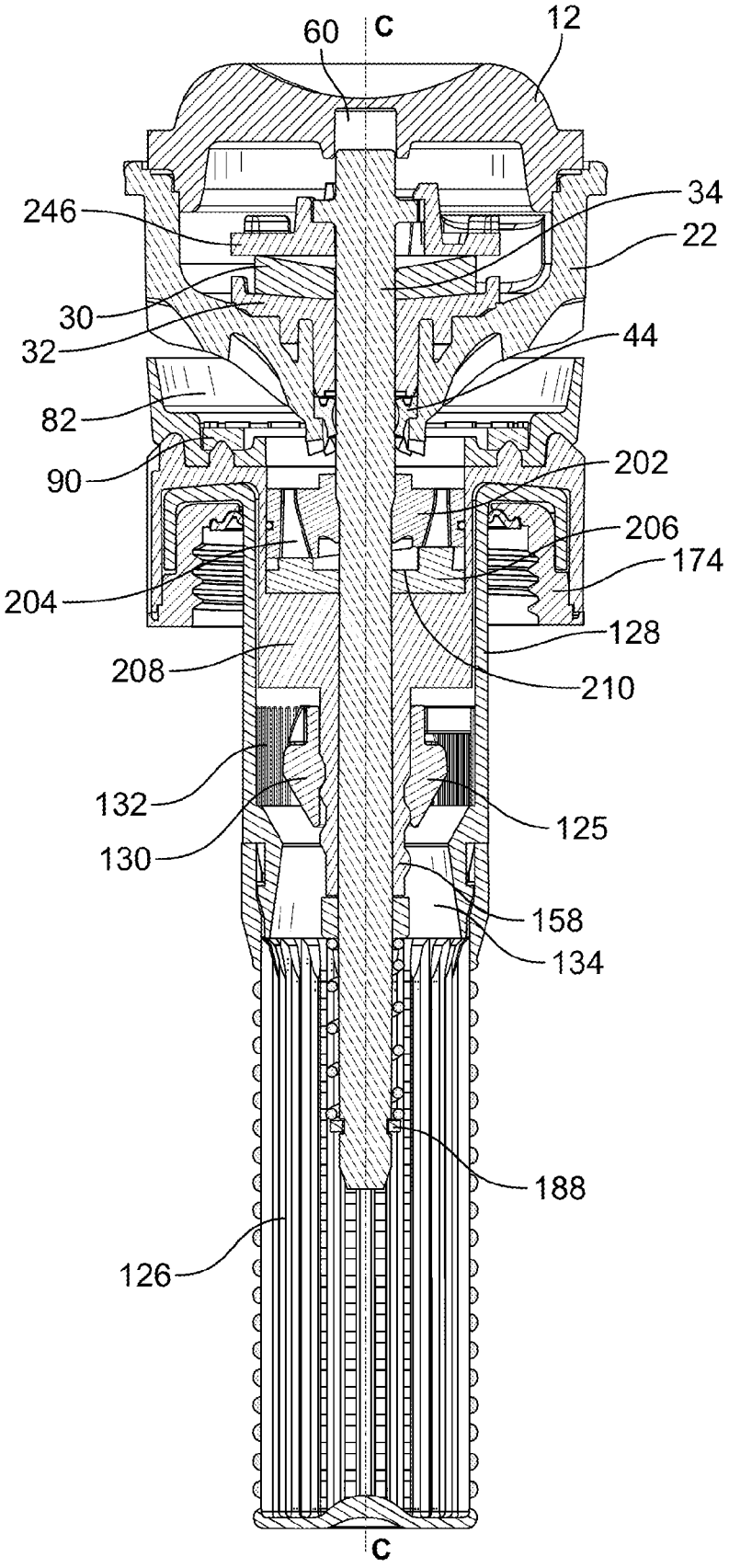
FIG. 19 is a cross-sectional view of the sprinkler head of FIG. 18.

As described further below, an irrigation sprinkler head 700 with a lock-out feature 702 generally includes: a deflector 706 movable between an operational position and an adjustment position; a lock-out member 708 movable between an unlocked position and a locked position; a valve 710 adjustable to change the length of an arcuate opening 704 for the distribution of fluid in a predetermined arcuate span; a flow path from an inlet 134 (FIG. 2) through the valve 710 to the deflector 706 and outwardly away from the deflector 706 within the predetermined arcuate span; and a nozzle body 16 (FIGS. 1 and 2) defining the valve 710 and inlet 134 (FIG. 2). In this preferred form, the deflector 706 is adapted for engagement with the valve 710 for setting the length of the arcuate opening 704 in the adjustment position and for the distribution of fluid in the operational position, and the lock-out member 708 is operatively coupled to the deflector 706 such that the deflector 706 is movable to the adjustment position when the lock-out member 708 is in an unlocked position and is not movable to the adjustment position when the lock-out member 708 is in a locked position. In the operational position, fluid is directed against the deflector 706 and distributed outwardly, and in the adjustment position, the teeth 714 and 716 of the deflector 706 and the valve 710 engage to set the size of the distribution arc. In preferred forms, the sprinkler head 700 may be generally similar in structure to sprinkler head 10 (FIGS. 1 and 2), sprinkler head 200 (FIGS. 18 and 19), sprinkler head 500 (FIG. 33), and sprinkler head 600 (FIG. 36), except for the addition of lock-out feature 702.

The lock-out feature 702 preferably includes modification to the deflector 22 and cap 12 described above and shown in FIGS. 2-4. Except as otherwise described, the deflector 706 and cap 718 are generally similar in structure to those previously described. In one preferred form, the lock-out feature 702 includes deflector 706, cap 718, and a seal 720. The deflector 706 preferably includes internal threading 722 on the cylindrical wall 724 defining the interior of the deflector 706. The deflector 706 may also include a knurled external surface 725 along its top circumference to provide for better gripping by a user making an arc adjustment.

The cap 718 preferably includes external threading 726 for engagement with the deflector internal threading 722. The cap 718 also preferably includes a slot 728 in its top surface 730 for reception of a tool or coin, and the top surface 730 preferably has two concave surfaces 732 to either side of the slot 728 forming a pinched grip 733 for rotation of the cap 718. In this preferred form, the cap 718 generally functions as the lock-out member 708 and is threadedly movable up and down relative to the deflector 706 between unlocked and locked positions, respectively.

The deflector 706 and cap 718 are preferably configured for reception of a seal 720 therebetween, preferably an o-ring. The cap 718 preferably includes a groove 734 formed in the top circumferential portion 736 of the outer wall 738 above the external threading 726. The groove 734 is configured to receive the seal 720. The seal 720 engages the cap groove 734 and the inside of the deflector cylindrical wall 724 above the internal threading 722. The seal 720 limits the entry of fluid, grit, and debris that might otherwise damage sensitive internal components, such as the speed brake 742.

Figure 39:
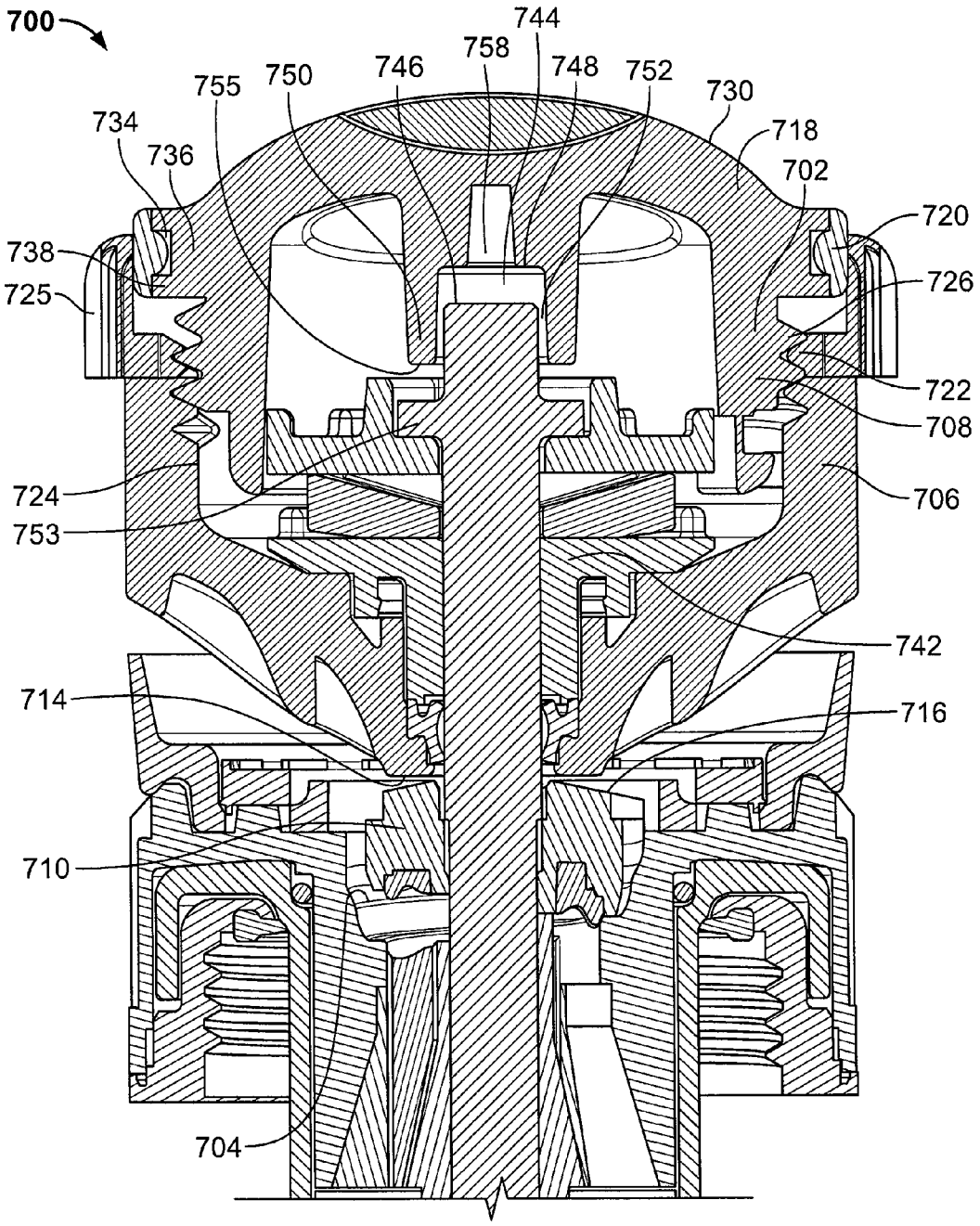
FIG. 39 is a partial enlarged cross-sectional view of the sprinkler head of FIG. 36 with a lock-out feature in an unlocked position.

FIG. 39 shows the sprinkler head 700 with the lock-out feature 702 in an unlocked position. In this unlocked position, the cap 718 is at a relatively high position with respect to the deflector 706. When in this position, as can be seen in FIG. 39, a spacing 744 exists between the end of shaft 746 and the cylindrical interface 750. In other words, in this position, the shaft 746 does not completely occupy the cylindrical recess 752 formed by the interface 750. The spacing 744 is preferably about the same between the top of shaft 746 and the top 748 of cylindrical interface 750 and between the lock flange 753 and the bottom 755 of cylindrical interface 750. The amount of spacing 744 is coordinated with the distance between the deflector teeth 714 and the valve sleeve teeth 716 so that a user may depress the cap 718 to have the teeth 714 and 716 engage one another before the shaft 746 engages the cylindrical interface 750. Thus, the amount of spacing 744 allows a user enough room to depress the cap 718 to engage the teeth 714 and 716, and the user may depress the cap 718 to change the arc distribution setting.

Figure 40:
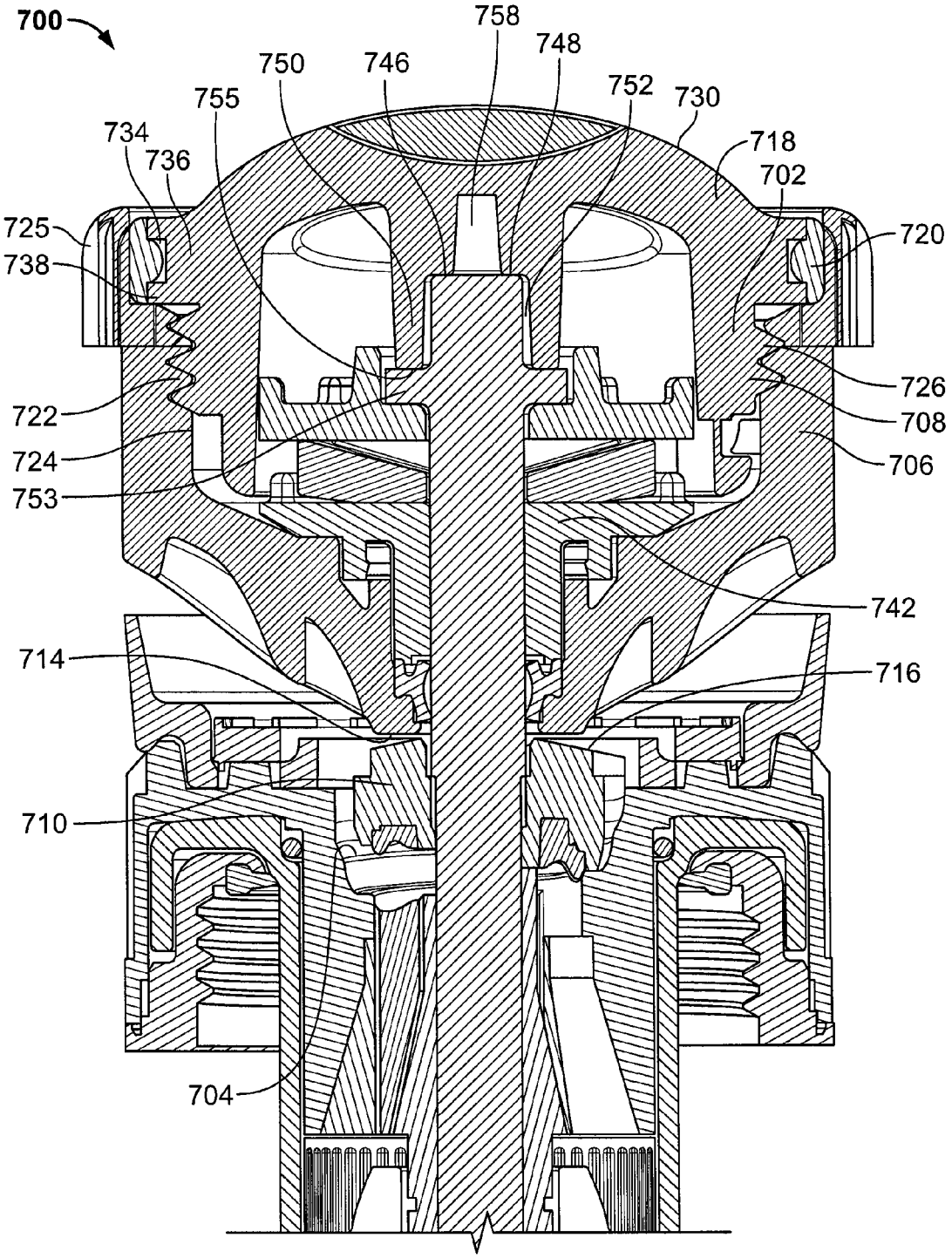
FIG. 40 is a partial enlarged cross-sectional view of the sprinkler head and lock-out feature of FIG. 39 in a locked position.
Figure 41:
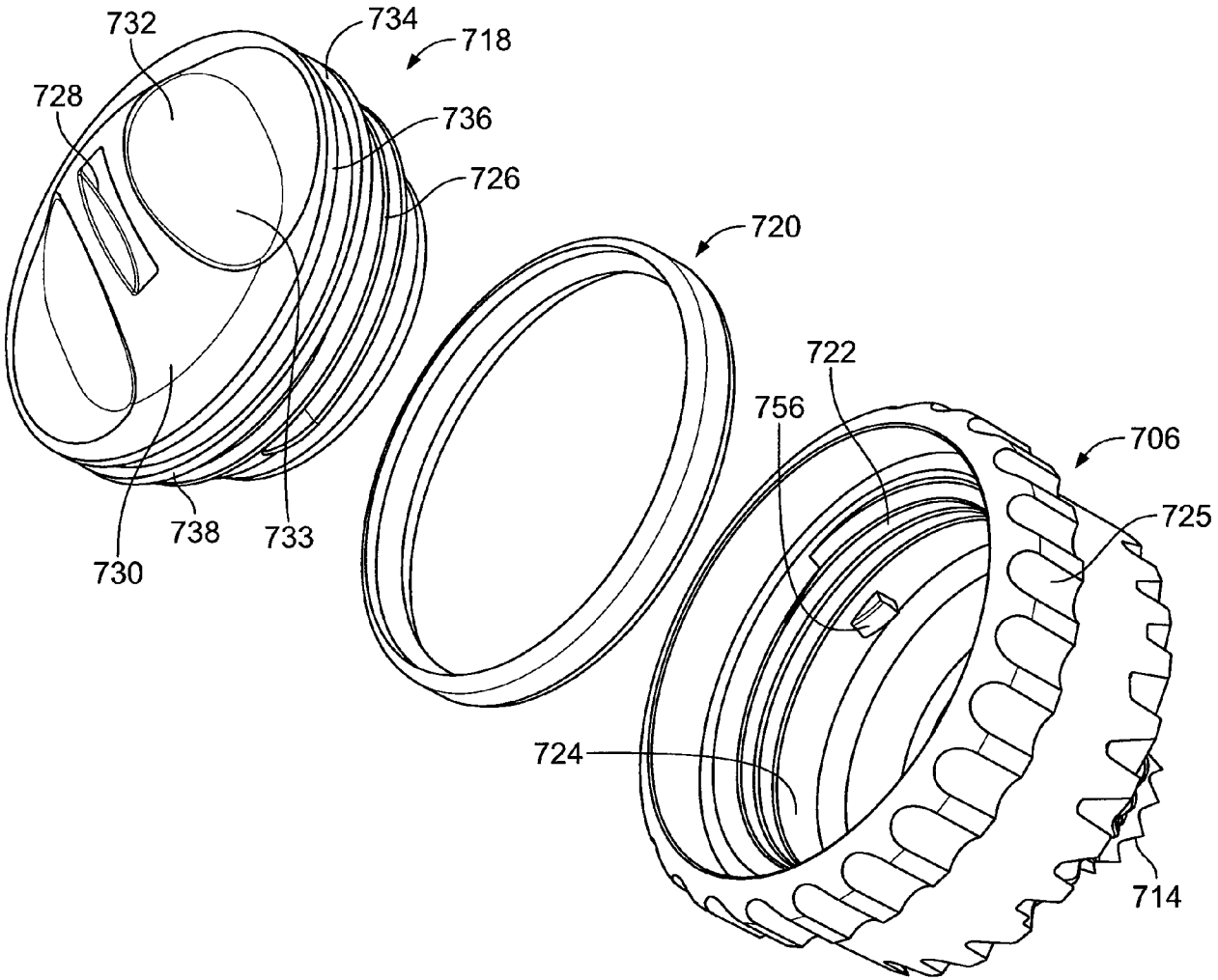
FIG. 41 is a top perspective view of the threaded cap and deflector of FIG. 39.
Figure 42:
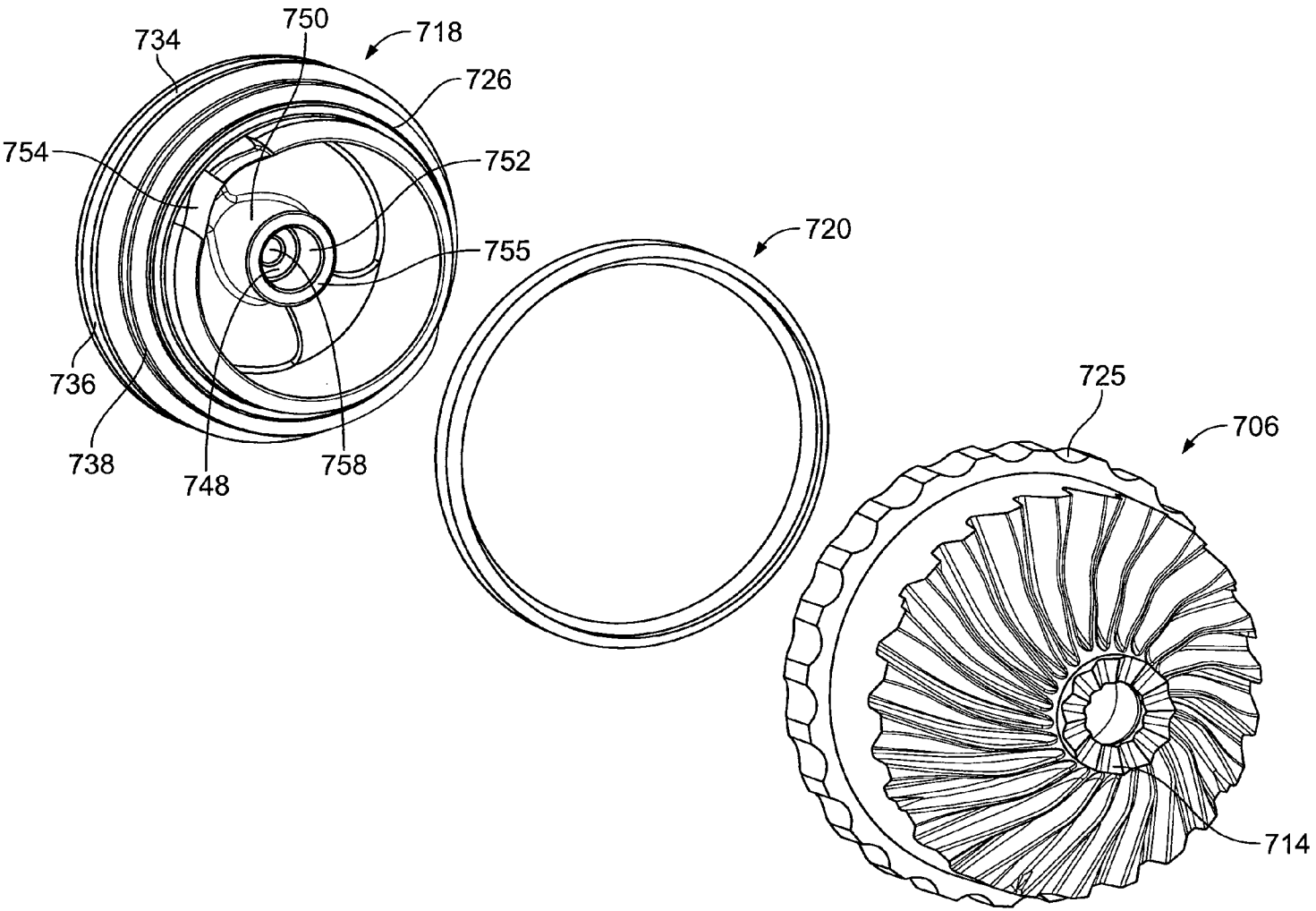
FIG. 42 is a bottom perspective view of the threaded cap and deflector of FIG. 39.

FIG. 40 shows the sprinkler head 700 in a locked position. A user employs a coin or tool to rotate the cap 718 relative to the deflector 706 via the threading 722 and 726 so that the cap 718 is at a relatively low position relative to the deflector 706. Alternatively, as shown in FIG. 41, the user may use his fingers to manipulate the pinched grip 733 to rotate the cap 718 to this relatively low position. As should be evident, the user may rotate the cap 718 in opposite directions to shift the cap 718 between the relatively high (unlocked) and relatively low (locked) positions. Also, as can be seen from FIGS. 42 and 43, the cap 718 preferably includes a thin flexible wall portion 754 for engagement with deflector tab 756 to prevent unthreading and removal of the cap 718 from the sprinkler head 700. Alternatively, the cap 718 or the deflector 706 preferably includes one or more stops in the threading 722 and 726 to prevent removal of the cap 718.

In this locked position, much of the spacing 744 between the end of the shaft 746 and the top 748 of the cylindrical interface 750 is removed. In this preferred form, the cap 718 includes a cavity 758 for molding purposes, and the top surface 748 is generally annular in shape. The amount of remaining spacing 744 is coordinated with the distance between the deflector teeth 714 and the valve sleeve teeth 716 such that the teeth 714 and 716 do not engage one another when the cap 718 is depressed. In other words, when the cap 718 is depressed, the shaft 746 will engage the engagement surface 748 and prevent further downward movement before the teeth 714 and 716 engage one another. As can be seen in FIG. 40, the cap 718 has been depressed and has engaged the shaft 746 preventing further downward movement before the teeth 714 and 716 engage. Thus, in this locked position, a user cannot change the arc distribution setting.

In this locked position, the cap 718 includes an engagement surface for engagement with the shaft 746 prior to engagement of the teeth 714 and 716. In this form, as can be seen in FIG. 40, the engagement surface includes both the top and bottom surfaces 748 and 755 of cylindrical interface 750 because they both engage the top of shaft 746 and the lock flange 753, respectively. In other forms, however, the engagement surface may be selected to be either one of these two surfaces or may be a different surface.

Thus, the lock-out feature 702 functions by coordinating the relative spacing between various structures and surfaces. More specifically, as should be evident, the vertical spacing between the shaft 746 and top and bottom surfaces 748 and 755 of the cylindrical surface 750 is greater when the cap 718 is in the unlocked position (first distance) than when it is in the locked position (second distance). Preferably, in the locked position, some minimal spacing exists between the shaft 746 and cylindrical interface surfaces to prevent interference with rotation of the deflector 706. Also, these distances are coordinated with the spacing of the deflector 706 between the operational position and the adjustment position (third distance). In order to prevent the deflector 706 from reaching the adjustment position (locked position), the third distance must be greater than the second distance. Conversely, in order to allow the deflector 706 to reach the adjustment position (unlocked position), the third distance must be equal to or less than the second distance.

As described above, when in a locked position, this lock-out feature 702 prevents an accidental contact with the cap 718 from causing an unintended change in the arc setting. In addition, this lock-out feature 702 provides some protection against intentional mischief. A vandal or other individual would be required to have knowledge as to how to unlock the lock-out feature 702 in order to change the arc setting.

Figure 43:
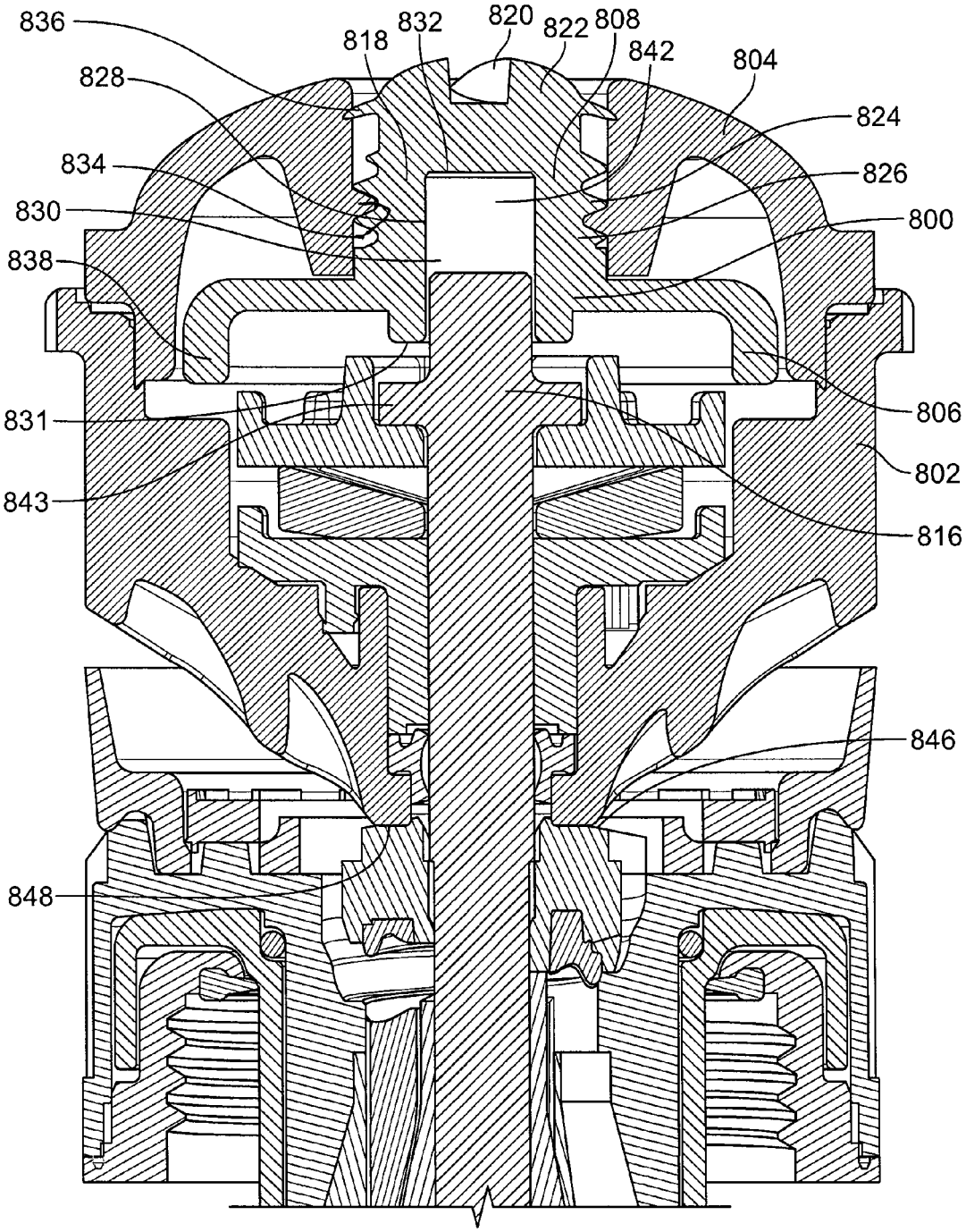
FIG. 43 is a partial enlarged cross-sectional view of the sprinkler head of FIG. 36 with an alternative lock-out feature in an unlocked position.
Figure 44:
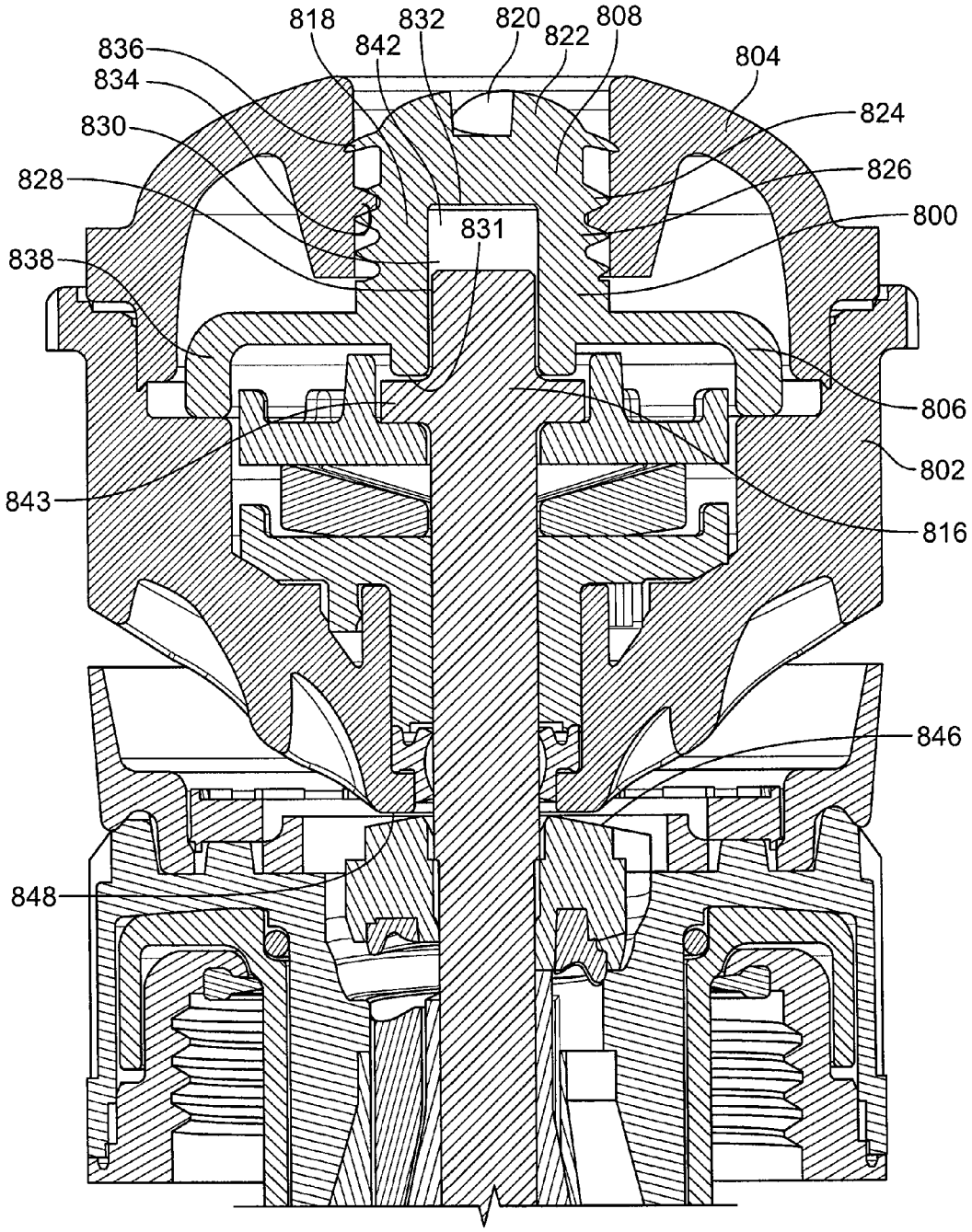
FIG. 44 is a partial enlarged cross-sectional view of the sprinkler head and alternative lock-out feature of FIG. 43 in a locked position.
Figure 45:
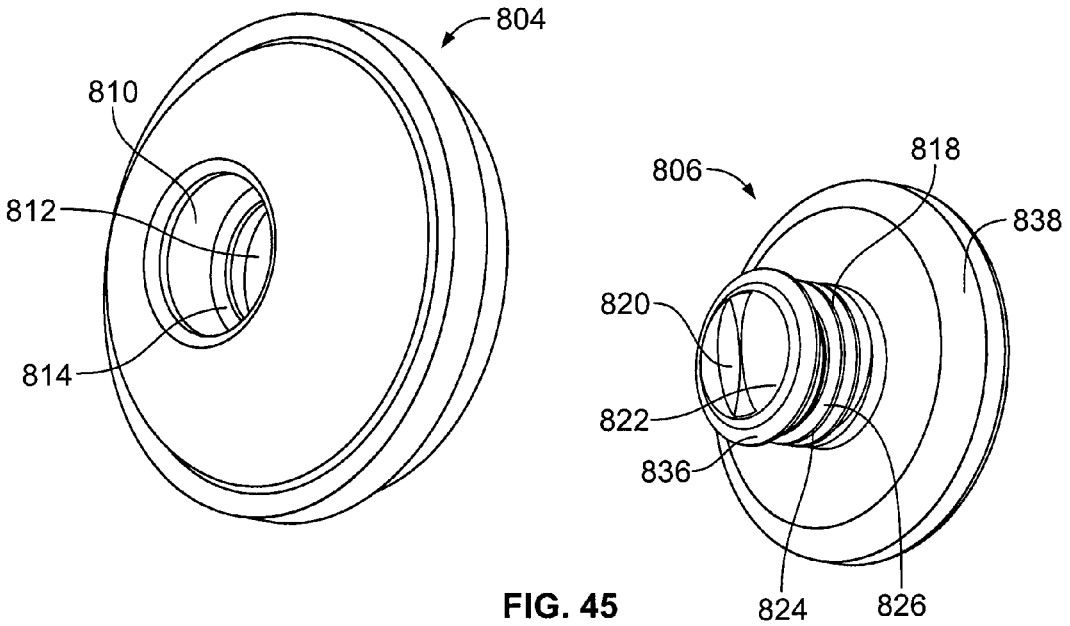
FIG. 45 is a top perspective view of the threaded cap and screw of FIG. 43.
Figure 46:
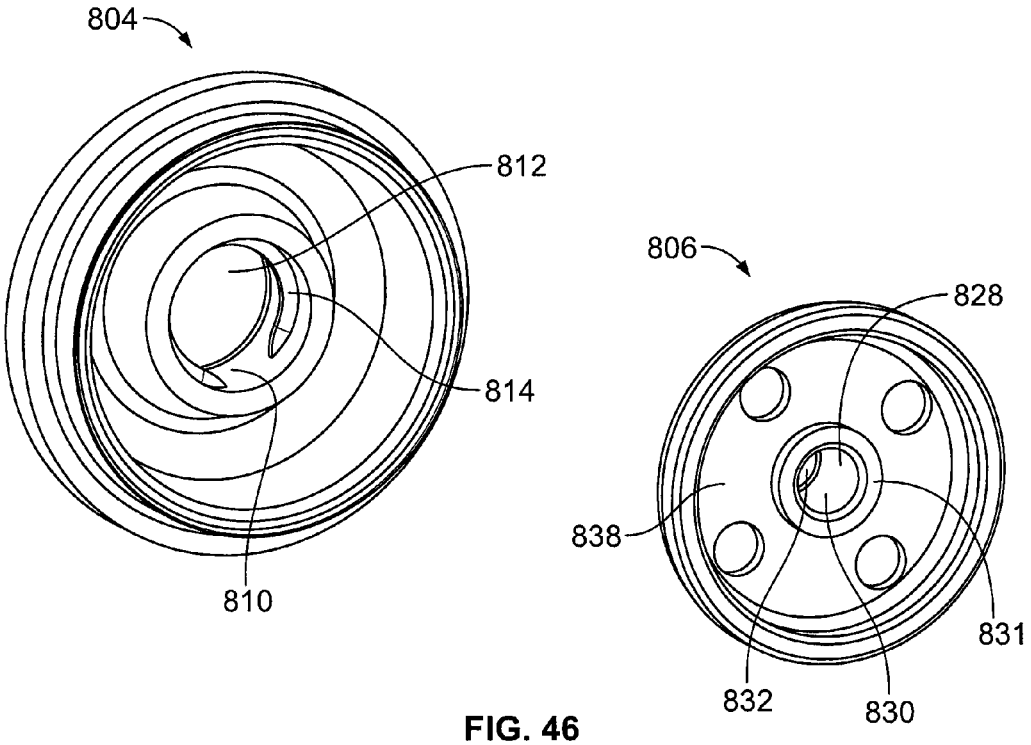
FIG. 46 is a bottom perspective view of the threaded cap and screw of FIG. 43.

An alternative preferred form of the lock-out feature 800 is shown in FIGS. 43-46. In this form, the lock-out feature 800 does not include a threading modification to the deflector 802, but instead includes a modified cap 804 and a lock-out screw 806. In this form, the lock-out screw 806 generally functions as the lock-out member 808. As shown in FIGS. 45 and 46, the modified cap 804 includes a central hub 810 defining a bore 812 therethrough with the central hub 810 having internal threading 814. The lock-out screw 806 is sized for reception between the modified cap 804, shaft 816, and deflector 802. The cap 804 is preferably welded, or fastened in some other manner, to the deflector 802 so that the screw 806 cannot be removed.

As shown in FIGS. 43 and 44, the lock-out screw 806 includes a generally cylindrical portion 818 that has a slot 820 in its top surface 822, external threading 824 along its outer wall 826, and a cylindrical interface 828 defining a cylindrical recess 830 with a bottom surface 831 and top surface 832. The cylindrical portion 818 is sized such that the external threading 824 engages the cap internal threading 834. The lock-out screw 806 also preferably includes a seal 836 just above the threading 824 and a skirt 838. The skirt 838 preferably flares radially outwardly and, in an unlocked position, is spaced above the deflector 802 to allow the lock-out screw 806 to be threadedly adjusted downward, as described further below. When the screw 806 is lowered to a locked position, the skirt 838 preferably bottoms out against the deflector 802 to prevent further downward movement.

FIG. 43 shows the lock-out feature 800 in an unlocked position. In this position, the screw 806 is at a relatively high position with respect to the cap 804 such that a spacing 842 exists between the top of the shaft 816 and the top surface 832 of the cylindrical interface 828 and between lock flange 843 and the bottom surface 831 of the cylindrical interface 828. The amount of spacing 842 is coordinated with the distance between the teeth 846 and 848 such that a user may depress the cap 804 to cause the teeth 846 and 848 to engage one another. In other words, as a general matter, the distance between shaft 816 and the cylindrical interface 828 is greater than the distance between the teeth 846 and 848. In this position, the user may depress the cap 804 to cause the teeth 846 and 848 to engage and allow adjustment of the arcuate setting.

FIG. 44 shows the lock-out feature 800 in a locked position. A user employs a tool or coin in the slot 820 to rotate the lock-out screw 806 via the threading 814 and 824 to a position in which the screw 806 is relatively low with respect to the cap 804. As should be evident, a user may easily rotate the screw 806 to shift the screw 806 between the locked and unlocked positions.

In the low (locked) position, the amount of spacing 842 between the shaft 816 and cylindrical interface 828 is reduced. The amount of spacing 842 is coordinated with the distance between the teeth 846 and 848 so that the spacing 842 is less than the distance between the teeth 846 and 848. Thus, when a user depresses the cap 804, the shaft 816 will contact a surface of the cylindrical interface 828 and prevent further downward movement before the teeth 846 and 848 can engage one another. In this locked position, the user cannot depress the cap 804 to change the arcuate setting.

The general spacing relationships between the shaft 816, the engagement surface of the lock-out screw 806, and the deflector operational and adjustment positions are similar to those described for the first lock-out feature 702. In a locked position, the lock-out screw 806 includes an engagement surface for engagement with the shaft 816 prior to engagement of the teeth 846 and 848. In the form shown in FIG. 44, the engagement surface is the bottom surface 831 of cylindrical interface 828 because it will engage lock flange 843 before the teeth 846 and 848 will engage once the cap 804 is depressed. In other forms, however, the engagement surface may be selected to be the top surface 832, both surfaces 831 and 832, or other surfaces of the cylindrical interface 828.

As shown in FIG. 2, the sprinkler head 10 also preferably includes a flow rate adjustment valve 125. The flow rate adjustment valve 125 can be used to selectively set the water flow rate through the sprinkler head 10, for purposes of regulating the range of throw of the projected water streams. It is adapted for variable setting through use of a rotatable segment 124 located on an outer wall portion of the sprinkler head 10. It functions as a second valve that can be opened or closed to allow the flow of water through the sprinkler head 10. Also, a filter 126 is preferably located upstream of the flow rate adjustment valve 125, so that it obstructs passage of sizable particulate and other debris that could otherwise damage the sprinkler components or compromise desired efficacy of the sprinkler head 10.

As shown in FIGS. 9-17, the flow rate adjustment valve structure preferably includes a nozzle collar 128, a flow control member 130, and the hub portion 50 of the nozzle cover 62. The nozzle collar 128 is rotatable about the central axis C-C of the sprinkler head 10. It has an internal engagement surface 132 and engages the flow control member 130 so that rotation of the nozzle collar 128 results in rotation of the flow control member 130. The flow control member 130 also engages the hub portion 50 of the nozzle cover 62 such that rotation of the flow control member 130 causes it to move in an axial direction, as described further below. In this manner, rotation of the nozzle collar 128 can be used to move the flow control member 130 axially closer to and further away from an inlet 134. When the flow control member 130 is moved closer to the inlet 134, the flow rate is reduced. The axial movement of the flow control member 130 towards the inlet 134 increasingly pinches the flow through the inlet 134. When the flow control member 130 is moved further away from the inlet 134, the flow rate is increased. This axial movement allows the user to adjust the effective throw radius of the sprinkler head 10 without disruption of the streams dispersed by the deflector 22.

Figure 16:
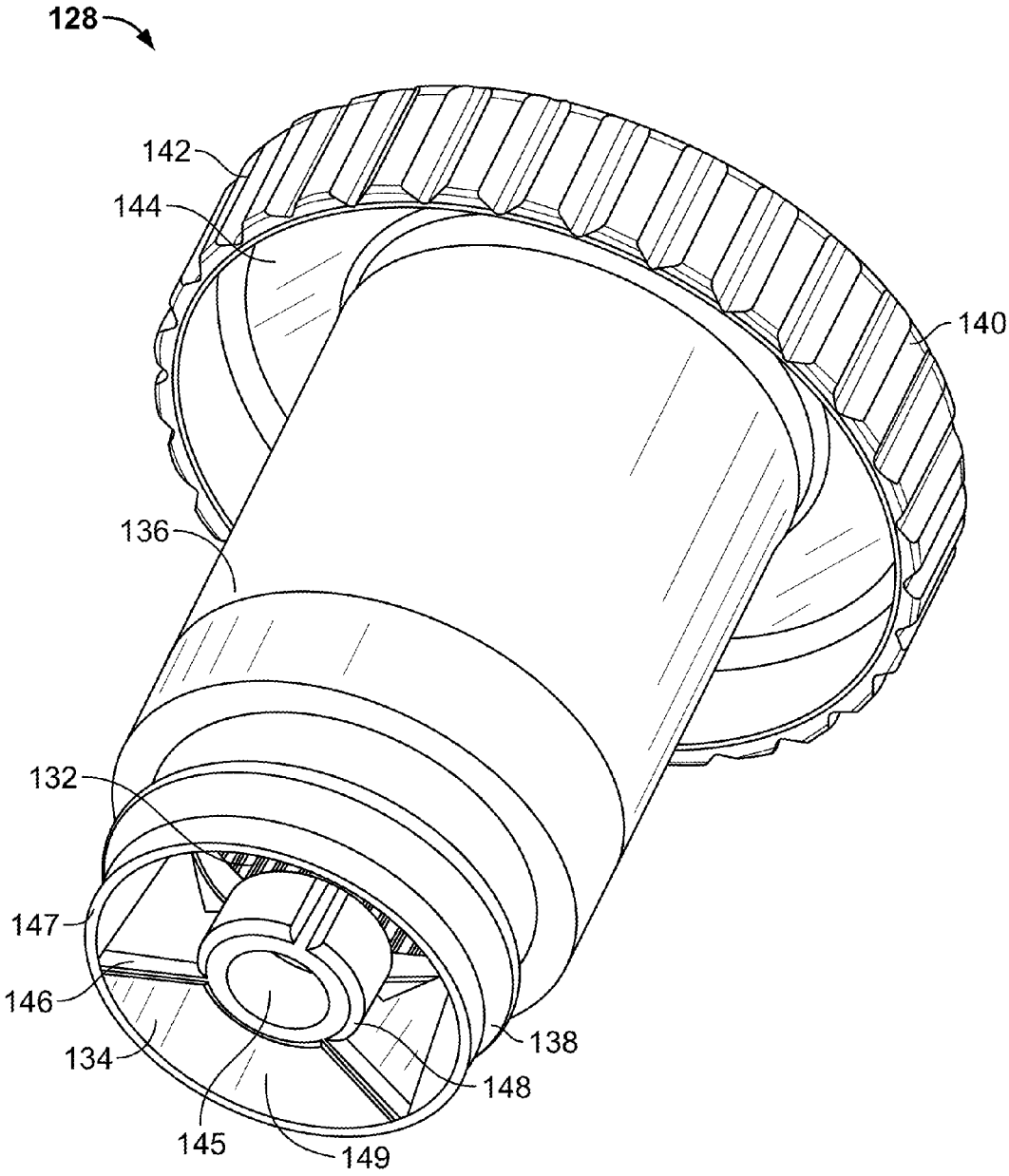
FIG. 16 is a perspective view of the collar of the sprinkler head of FIG. 1.
Figure 17:
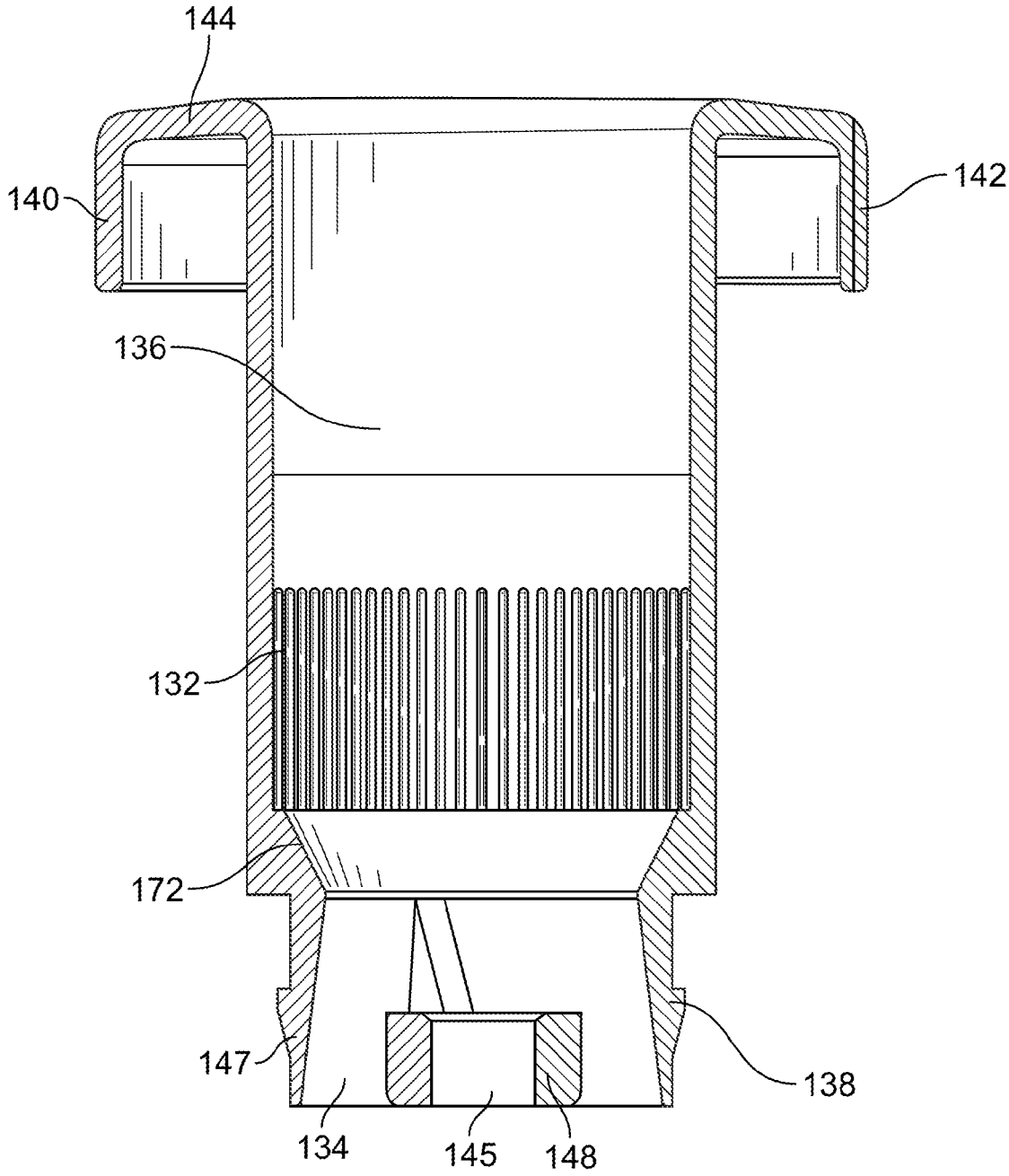
FIG. 17 is a cross-sectional view of the collar of the sprinkler head of FIG. 1.

As shown in FIGS. 16-17, the nozzle collar 128 preferably includes a first cylindrical portion 136 and a second cylindrical portion 138 having a smaller diameter than the first portion 136. The first portion 136 has an engagement surface 132, preferably a splined surface, on the interior of the cylinder. The nozzle collar 128 preferably also includes an outer wall 140 having an external grooved surface 142 for gripping and rotation by a user that is joined by an annular portion 144 to the first cylindrical portion 136. In turn, the first cylindrical portion 136 is joined to the second cylindrical portion 138, which is essentially the inlet 134 for fluid flow into the nozzle body 16. Water flowing through the inlet 134 passes through the interior of the first cylindrical portion 136 and through the remainder of the nozzle body 16 to the deflector 22. Rotation of the outer wall 140 causes rotation of the entire nozzle collar 128.

The second cylindrical portion 138 defines a central bore 145 for insertion of the shaft 34 therethrough. Unlike previous designs, the shaft 34 extends through the second cylindrical portion 138 beyond the inlet 134 and into filter 126. In other words, the spring 186 is mounted on the lower end of the shaft 34 upstream of the inlet 134. The second cylindrical portion 138 also preferably includes ribs 146 that connect an outer cylindrical wall 147 to an inner cylindrical wall 148 that defines the central bore 145. These ribs 146 define flow passages 149 therebetween.

Figure 15:
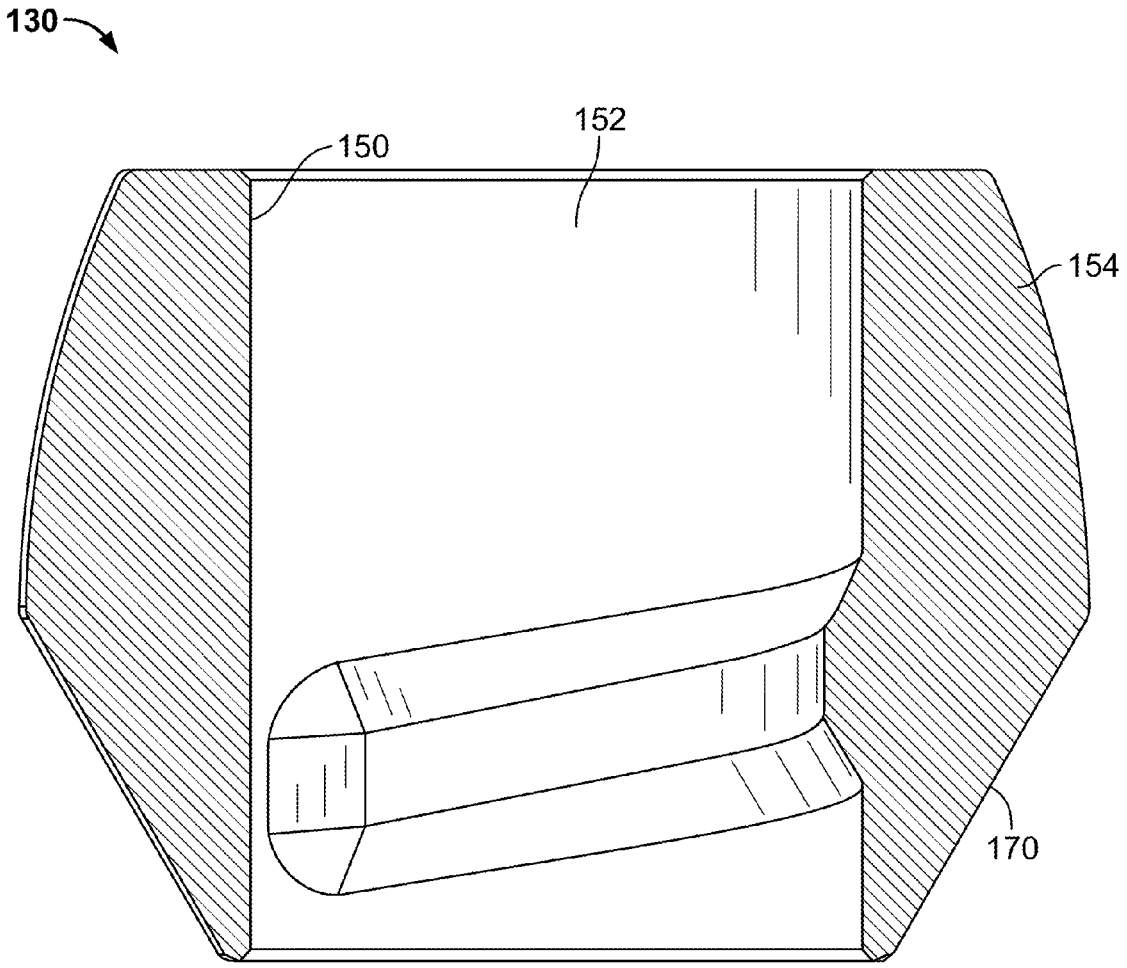
FIG. 15 is a cross-sectional view of the flow control member of the sprinkler head of FIG. 1.

The nozzle collar 128 is coupled to a flow control member 130. As shown in FIGS. 15-17, the flow control member 130 is preferably in the form of a ring-shaped nut with a central hub 150 defining a central bore 152. The flow control member 130 has an external surface 154 with two thin tabs 151 extending radially outward for engagement with the corresponding internal splined surface 132 of the nozzle collar 128. The tabs 151 and internal splined surface 132 interlock such that rotation of the nozzle collar 128 causes rotation of the flow control member 130 about central axis C-C. The external surface 154 has cut-outs 153, preferably six, in the top end of the member 130 to equalize upward fluid flow, as described below. Although certain engagement surfaces are shown in the preferred embodiment, it should be evident that other engagement surfaces, such as threaded surfaces, could be used to cause the simultaneous rotation of the nozzle collar 128 and flow control member 130.

In turn, the flow control member 130 is coupled to the hub portion 50 of the nozzle cover 62. More specifically, the flow control member 130 is internally threaded for engagement with an externally threaded hollow post 158 at the lower end of the nozzle cover 62. Rotation of the flow control member 130 causes it to move along the threading in an axial direction. In one preferred form, rotation of the flow control member 130 in a counterclockwise direction advances the member 130 towards the inlet 134 and away from the deflector 22. Conversely, rotation of the flow control member 130 in a clockwise direction causes the member 130 to move away from the inlet 134. Although threaded surfaces are shown in the preferred embodiment, it is contemplated that other engagement surfaces could be used to effect axial movement.

As shown in FIGS. 9-12, the nozzle cover hub portion 50 preferably includes an outer cylindrical wall 160 joined by spoke-like ribs 162 to an inner cylindrical wall 164. The inner cylindrical wall 164 preferably defines the bore 72 to accommodate insertion of the shaft 34 therein. The lower end forms the external threaded hollow post 158 for insertion in the bore 152 of the flow control member 130, as discussed above. The ribs 162 define flow passages 168 to allow fluid flow upwardly through the remainder of the sprinkler head 10.

The flow passages 168 are preferably spaced directly above the cut-outs 153 of the flow control member 130 when the member 130 is at its highest axial point, i.e., is fully open. This arrangement equalizes fluid flow through the flow passages 168 when the valve 125 is in the fully open position, which is the position most frequently used during irrigation. This equalization is especially desirable given the close proximity of the flow control member 130 to the ribs 162 and flow passages 168 at this highest axial point.

Figure 10:
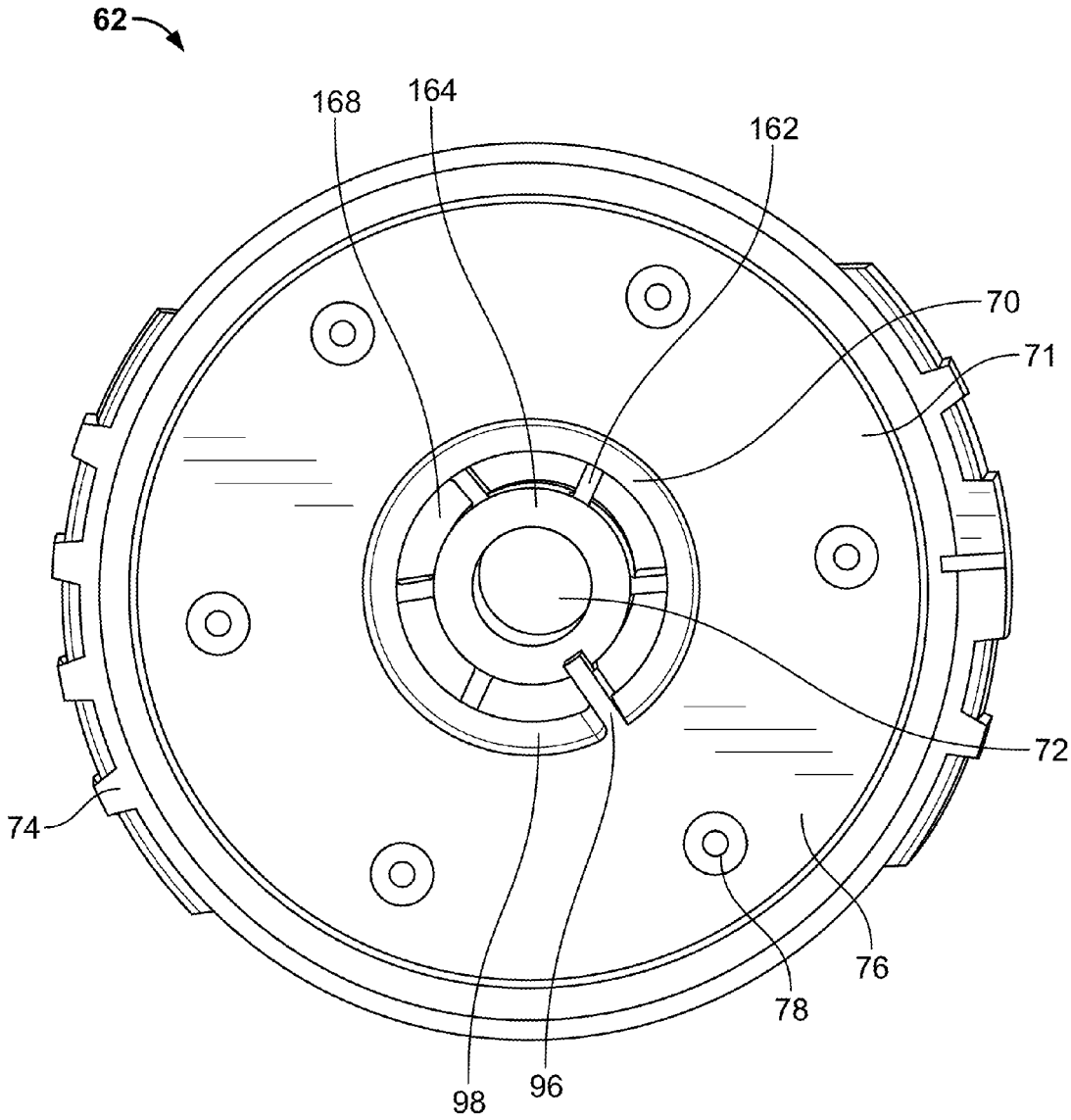
FIG. 10 is a top plan view of the nozzle cover of the sprinkler head of FIG. 1.
Figure 14:
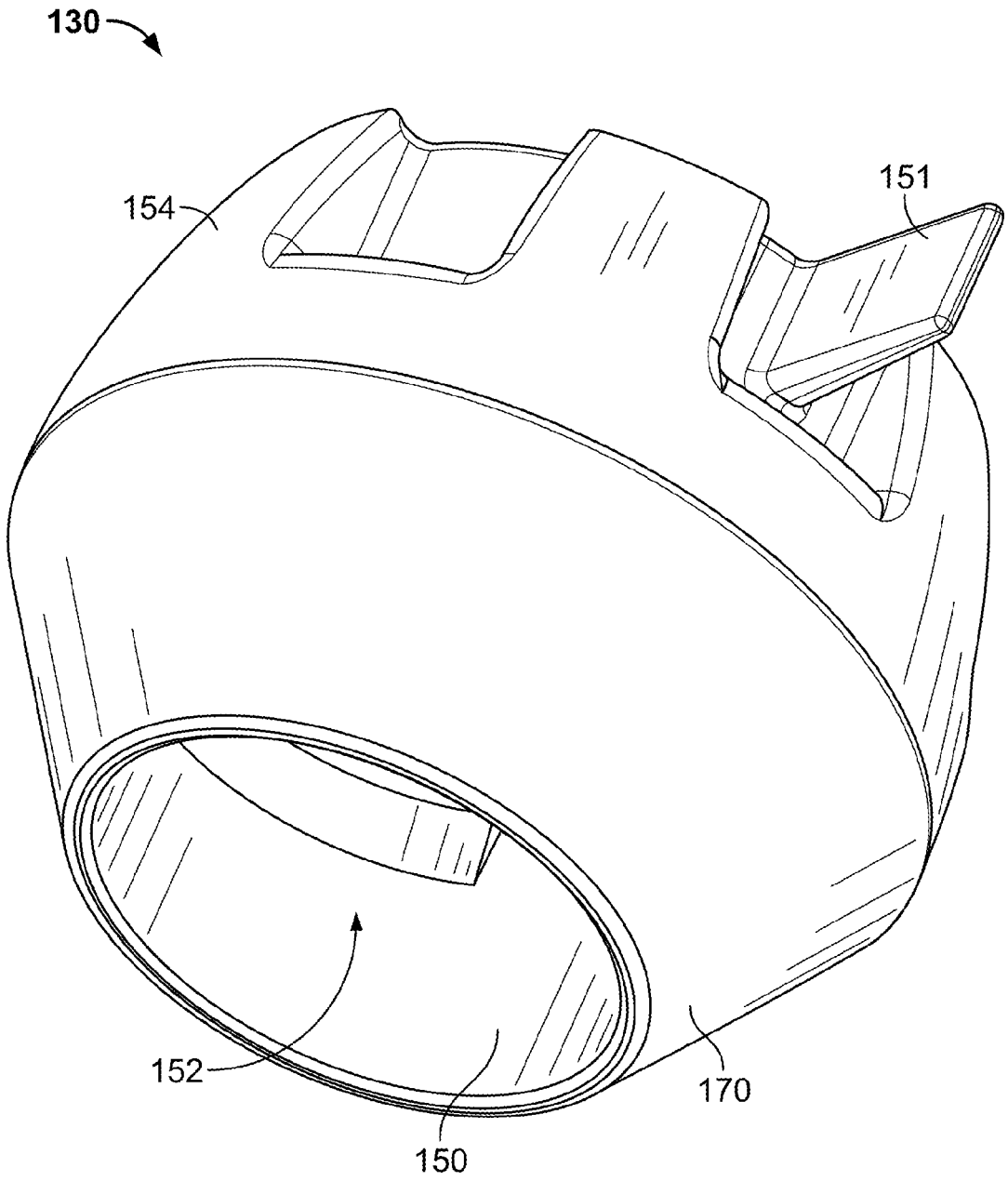
FIG. 14 is a bottom perspective view of the flow control member of the sprinkler head of FIG. 1.

In operation, a user may rotate the outer wall 140 of the nozzle collar 128 in a clockwise or counterclockwise direction. As shown in FIG. 10, the nozzle cover 62 preferably includes one or more cut-out portions 63 to define one or more access windows to allow rotation of the nozzle collar outer wall 140. Further, as shown in FIG. 2, the nozzle collar 128, flow control member 130, and nozzle cover hub portion 50 are oriented and spaced to allow the flow control member 130 and hub portion 50 to essentially block fluid flow through the inlet 134 or to allow a desired amount of fluid flow through the inlet 134. As can be seen in FIGS. 14-15, the flow control member 130 preferably has a contoured bottom surface 170 for engagement with the inlet 134 when fully extended.

Rotation in a counterclockwise direction results in axial movement of the flow control member 130 toward the inlet 134. Continued rotation results in the flow control member 130 advancing to a valve seat 172 formed at the inlet 134 for blocking fluid flow. The dimensions of the radial tabs 151 of the flow control member 130 and the splined internal surface 132 of the nozzle collar 128 are preferably selected to provide over-rotation protection. More specifically, the radial tabs 151 are sufficiently flexible such that they slip out of the splined recesses upon over-rotation. Once the inlet 134 is blocked, further rotation of the nozzle collar 128 causes slippage of the radial tabs 151, allowing the collar 128 to continue to rotate without corresponding rotation of the flow control member 130, which might otherwise cause potential damage to sprinkler components.

Rotation in a clockwise direction causes the flow control member 130 to move axially away from the inlet 134. Continued rotation allows an increasing amount of fluid flow through the inlet 134, and the nozzle collar 128 may be rotated to the desired amount of fluid flow. When the valve is open, fluid flows through the sprinkler head 10 along the following flow path: through the inlet 134, between the nozzle collar 128 and the flow control member 130, through the flow passages 168 of the nozzle cover 62, through the arcuate slot 20 (if set to an angle greater than 0 degrees), upwardly along the upper cylindrical wall 98 of the nozzle cover 62, to the underside surface of the deflector 22, and radially outwardly from the deflector 22. As noted above, water flowing through the slot 20 may not be adequate to impart sufficient force for desired rotation of the deflector 22, when the slot 20 is set at relatively low angles. It should be evident that the direction of rotation of the outer wall 140 for axial movement of the flow control member 130 can be easily reversed, i.e., from clockwise to counterclockwise or vice versa.

The sprinkler head 10 illustrated in FIGS. 2-4 also includes a nozzle base 174 of generally cylindrical shape with internal threading 176 for quick and easy thread-on mounting onto a threaded upper end of a riser with complementary threading (not shown). The nozzle base 174 preferably includes an upper cylindrical portion 178, a lower cylindrical portion 180 having a larger diameter than the upper portion 178, and a top annular surface 182. As can be seen in FIGS. 2-4, the top annular surface 182 and upper cylindrical portion 178 provide support for corresponding features of the nozzle cover 62. The nozzle base 174 and nozzle cover 62 are preferably attached to one another by welding, snap-fit, or other fastening method such that the nozzle cover 62 is relatively stationary when the base 174 is threadedly mounted to a riser. The sprinkler head 10 also preferably includes a seal member 184, such as an o-ring or lip seal, at the top of the internal threading 176 of the nozzle base 174 and about the outer cylindrical wall 140 of the nozzle collar 128 to reduce leaking when the sprinkler head 10 is threadedly mounted on the riser.

Figure 11:
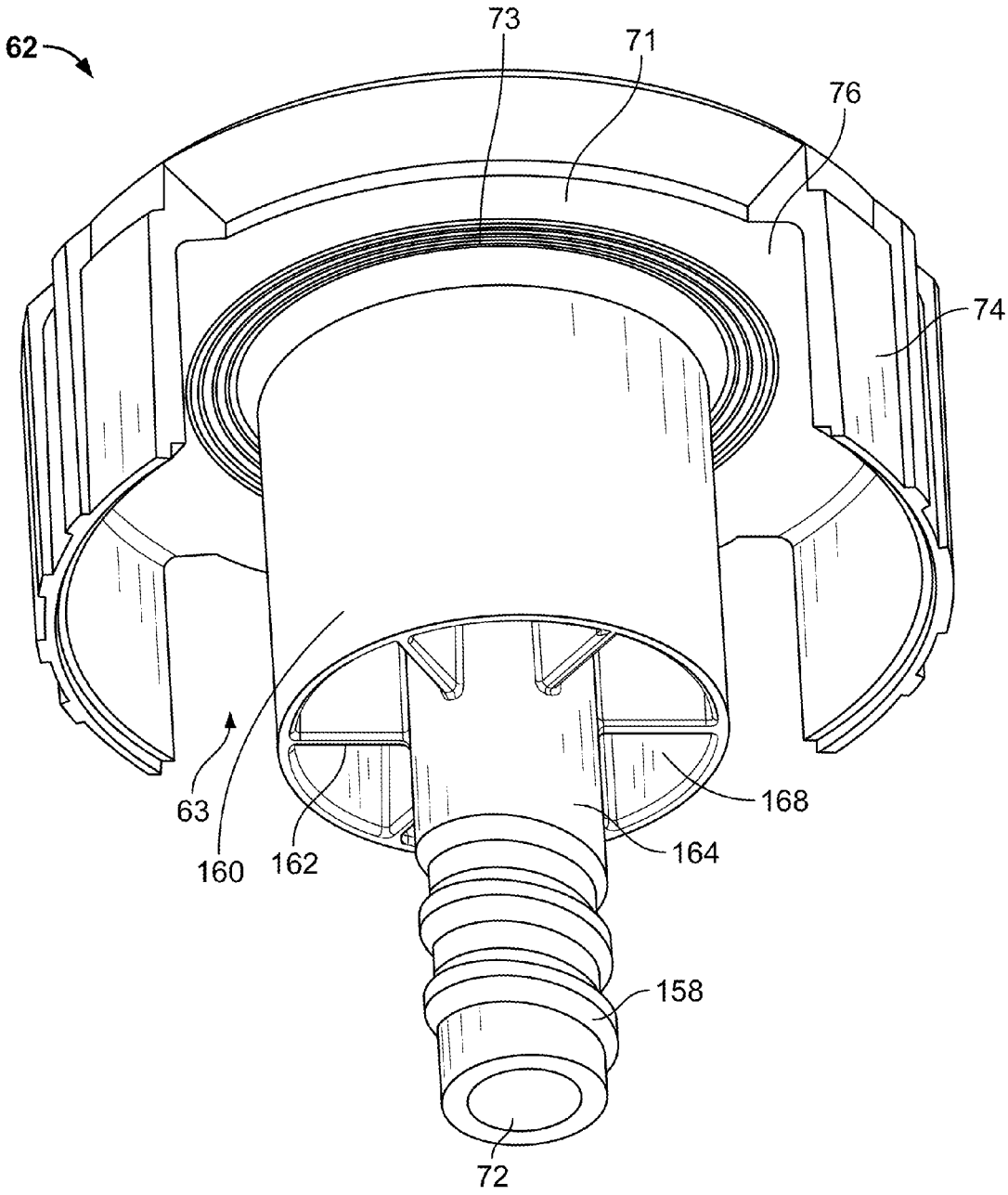
FIG. 11 is a bottom perspective view of the nozzle cover of the sprinkler head of FIG. 1.

The sprinkler head 10 preferably includes additional sealing engagement within the nozzle body 16. More specifically, as shown in FIG. 11, two concentric rings 73 protrude downwardly from the underside of the annular top surface 76 of the nozzle cover 62. These rings 73 engage the corresponding portion of the nozzle collar 128 to form a seal between nozzle cover 62 and nozzle collar 128. This seal is energized by spring 186, which exerts an upward biasing force against the nozzle collar 128 such that the nozzle collar is urged upwardly against the nozzle cover 62. The rings 73 reduce the amount of frictional contact between the nozzle cover 62 and collar 128 to allow relatively free rotation of the nozzle collar 128. The sprinkler head 10 preferably uses a plurality of rings 73 to provide a redundant seal.

Another preferred form of the sprinkler head or nozzle 200 is shown in FIGS. 18-27. This preferred form of the sprinkler head 200 is similar to the ones described above but includes a different arc adjustment valve 202. This embodiment does not include the valve sleeve structure of the first embodiment, and the nozzle cover structure has been modified in this embodiment. The valve sleeve structure has been replaced with two sequential arc valve pieces 204 and 206 having helical interfaces, as described further below. It should be understood that the structure of this embodiment of the sprinkler head 200 is generally the same as that described above for the first embodiment, except to the extent described as follows.

The sequential arc valve 202 is preferably formed of two valve pieces—an upper helical valve portion 204 and a lower helical valve portion 206. Although the preferred form shown in FIGS. 18-27 uses two separate valve pieces, it should be evident that one integral valve piece may be used instead. Alternatively, the lower helical valve portion 206 may be formed as a part of the nozzle cover 208. The two valve pieces of the preferred form shown in FIGS. 18-27 are mounted in the top of the modified nozzle cover 208. The nozzle cover 208 is similar in structure to that of the first embodiment, but it does not include an internal helical surface or internal fin. Instead, the top portion of the nozzle cover 208 defines a substantially cylindrical recess 210 for receiving the upper helical valve portion 204 and the lower helical valve portion 206.

Figure 25:
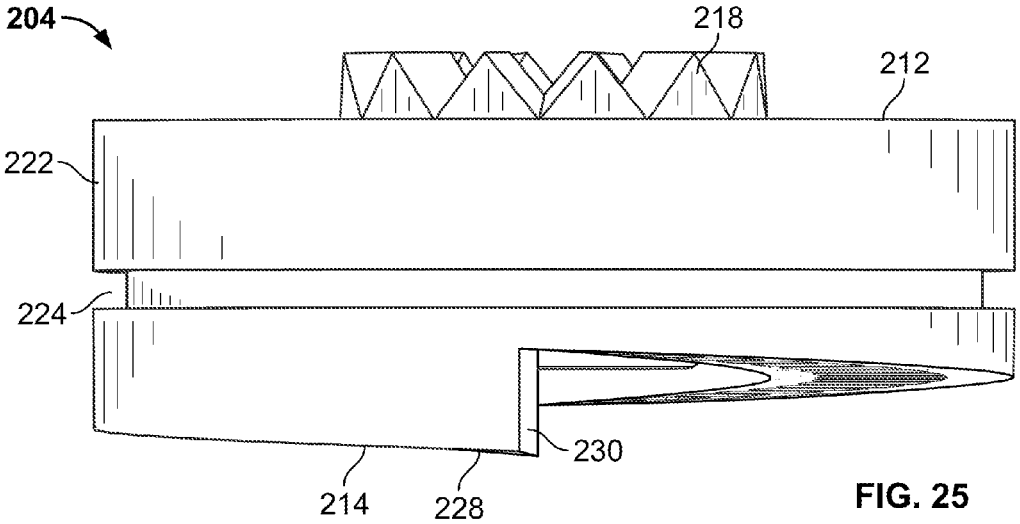
FIG. 25 is a side elevational view of the upper helical valve portion of the sprinkler head of FIG. 18.
Figure 26:
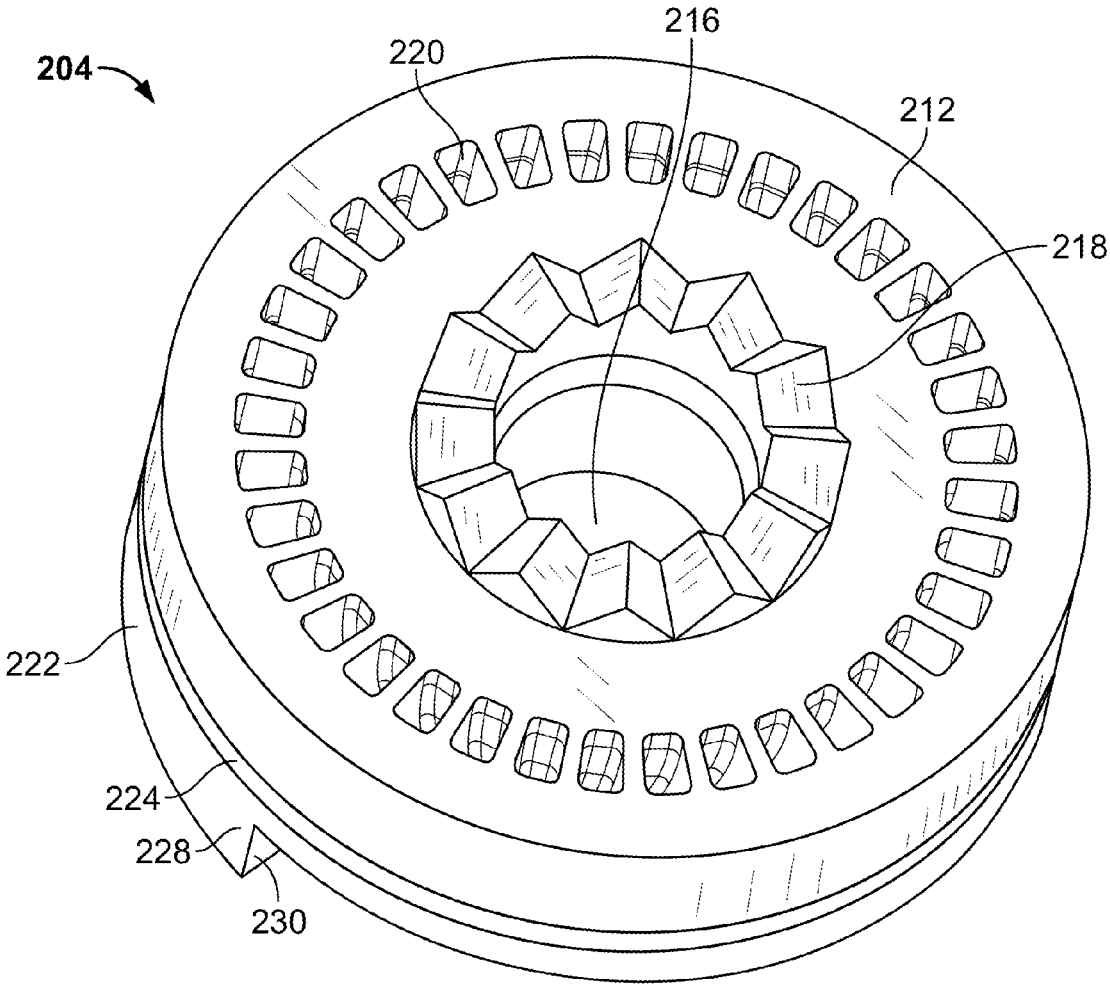
FIG. 26 is a top perspective view of the upper helical valve portion of the sprinkler head of FIG. 18.
Figure 27:
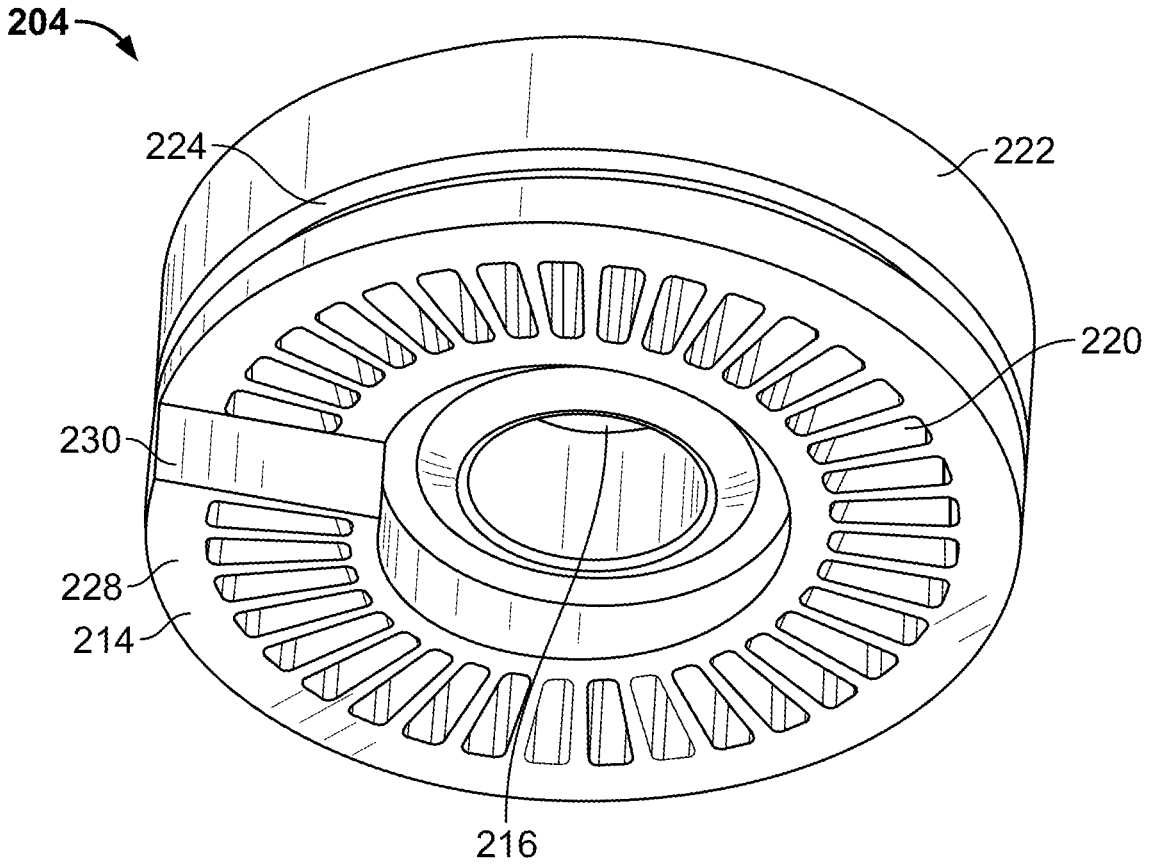
FIG. 27 is a bottom perspective view of the upper helical valve portion of the sprinkler head of FIG. 18.

As shown in FIGS. 25-27, the upper helical valve portion 204 has a substantially disk-like shape with a top surface 212, a bottom surface 214, and with a central bore 216 for insertion of the shaft 34 therethrough. The upper helical valve portion 204 further includes teeth 218 on its top surface 212 for receiving the deflector teeth 37, and, as with the first embodiment, a user pushes down the cap 12, which causes the deflector teeth 37 to engage the teeth 218 of the upper helical valve portion 204. Once engaged, the user rotates the cap 12 to set the arcuate length of the sequential arc valve 202.

The upper helical valve portion 204 also includes multiple apertures 220 that are circumferentially arranged about the disk and that extend through the body of the disk. These apertures 220 define flow passages for fluid flowing upwardly through the valve 202. In one preferred form, the cross-section of the apertures 220 is rectangular and decreases in size as fluid proceeds upwardly from the bottom to the top of the disk. This decrease in cross-section helps maintain relatively high pressure and velocity through the valve 202. In addition, the upper helical valve portion 204 includes an outer cylindrical wall 222, preferably with a groove 224 for receiving an o-ring 226 or other seal member.

As shown in FIGS. 25 and 27, the bottom surface 212 defines a first downwardly-facing, helical engagement surface 228 defining one helical revolution, or pitch. The ends are axially offset and form a vertical wall 230. The first helical engagement surface 228 engages a corresponding upwardly-facing, second helical engagement surface 232 on the lower helical valve portion 206, as described below, for opening and closing the sequential arc valve 202.

Figure 22:
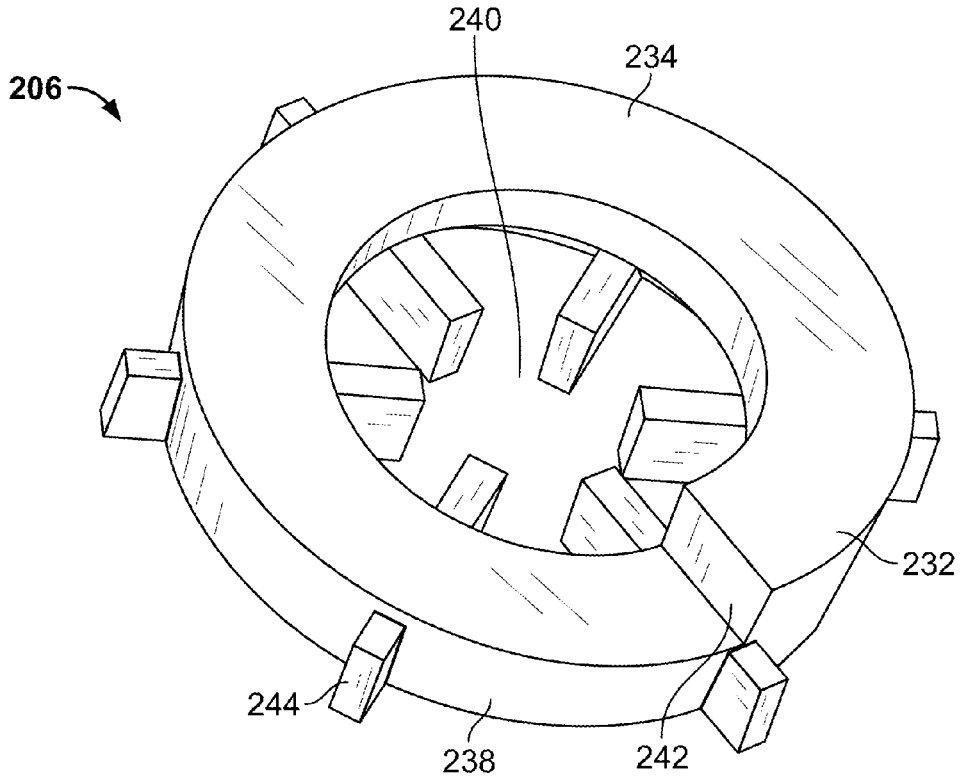
FIG. 22 is a top perspective view of the lower helical valve portion of the sprinkler head of FIG. 18.
Figure 23:
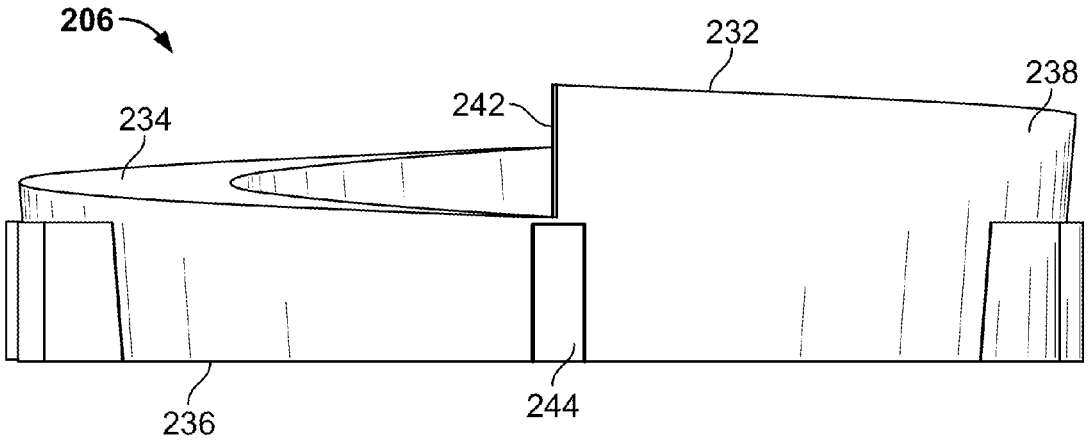
FIG. 23 is a side elevational view of the lower helical valve portion of the sprinkler head of FIG. 18.
Figure 24:
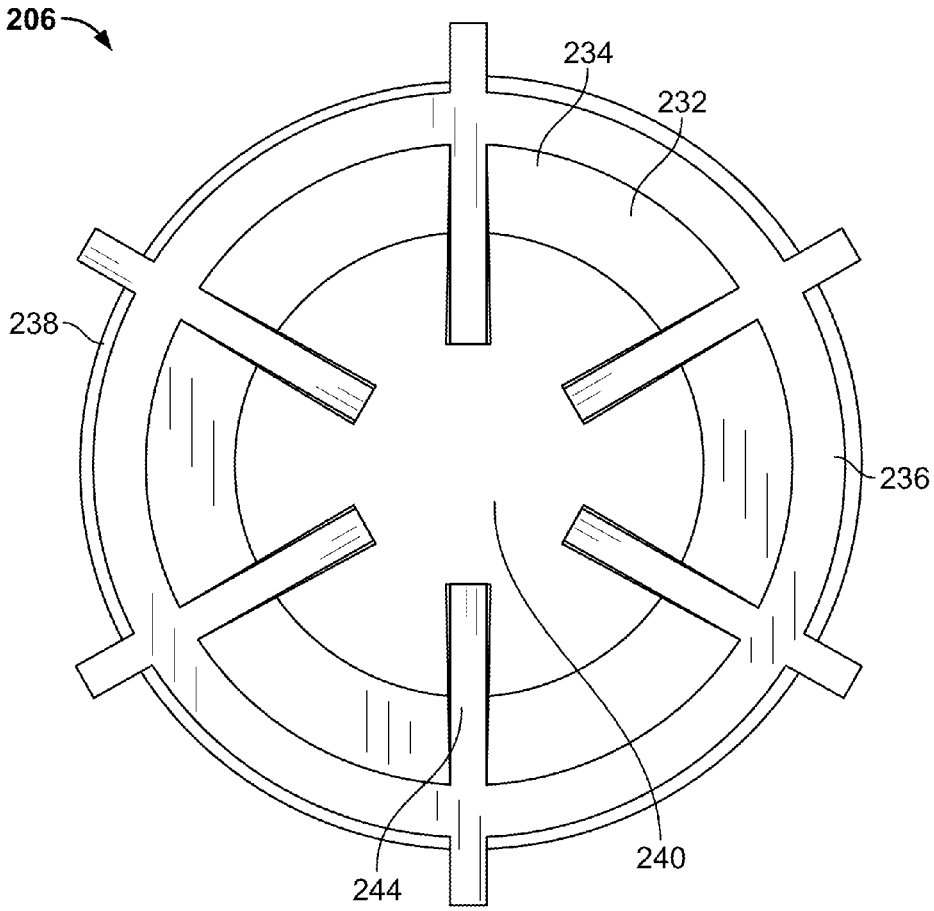
FIG. 24 is a bottom plan view of the lower helical valve portion of the sprinkler head of FIG. 18.

The lower helical valve portion 206 is shown in FIGS. 22-24. It also has a disk-like shape and includes a top surface 234, a bottom surface 236, an outer wall 238, and a central bore 240 for insertion of the shaft 34 therethrough. The top surface 234 defines the second helical engagement surface 232, which has axially offset ends that are joined by a vertical wall 242. The top surface 234 is preferably in the shape of an annular helical ramp. The bottom surface 236 is generally annular and is not helical. The lower helical valve portion 206 also includes spokes 244, preferably six, extending radially through the helical outer wall 238. The spokes 244 are spaced from the central bore 240 to allow insertion of the shaft 34 therethrough and are sized to fit within the recess 210 of the nozzle cover 208.

During a manual adjustment, the user pushes down on the cap 12 so that the deflector teeth 37 engage the corresponding teeth 218 of the upper helical valve portion 204. The upper helical valve portion 204 is rotatable while the lower helical valve portion 206 does not rotate. As the user rotates the cap 12, the sequential arc valve 202 is opened and closed through rotation and camming of the first helical engagement surface 228 with respect to the second helical engagement surface 232. The user rotates the cap 12 to uncover a desired number of apertures 220 corresponding to the desired arc. The vertical walls 230 and 242 of the respective portions engage one another when the valve 202 is fully closed. During this adjustment, the shaft 34 preferably translates a vertical distance corresponding to one helical pitch.

In one preferred form, as can be seen in FIGS. 26 and 27, the upper helical valve portion 204 includes 36 circumferentially-arranged and equidistantly-spaced apertures 220 such that each aperture 220 corresponds to 10° of arc. Thus, for example, the user may rotate the cap 12 to uncover nine apertures 220, which corresponds to 90° (or one-quarter circle) of arc. The sprinkler head 10 preferably includes a feedback mechanism for indicating to the user each 10° of rotation of the cap 12, such as the one described further below.

Fluid flow through the sprinkler head 200 follows a flow path similar to that for the first embodiment: through the inlet 134, between the nozzle collar 128 and the flow control member 130, through the flow passages 168 of the nozzle cover 208, through the open portion of the sequential arc valve 202, upwardly to the underside surface of the deflector 22, and radially outwardly from the deflector 22. Fluid flows through the sequential arc valve 202, however, in a manner different than the valve of the first embodiment. More specifically, fluid flows upwardly through the lower helical valve portion 206 following both an inner and an outer flow path. Fluid flows along an inner flow path between the shaft 34 and second helical engagement surface 232, and fluid flows along an outer flow path between the second helical engagement surface 232 and the nozzle cover 208. Fluid then flows upwardly through the uncovered apertures 220, i.e., the apertures 220 lying between the respective vertical walls 230 and 242. One advantage of this inner and outer flow path through the lower helical valve portion 206 is that the flow stays in a substantially upward flow path, resulting in reduced pressure drop (and relatively high velocity) through the valve 202.

Alternatively, the lower helical valve portion 206 may be modified such that there is only an inner flow path or an outer flow path. More specifically, the second helical engagement surface 232 can be located on the very outside circumference of the lower helical valve portion 206 to define a single inner flow path, or it can be located on an inner circumference adjacent the shaft 34 to define a single outer flow path. Additionally, it will be understood that the lower helical valve portion 206 may be further modified to eliminate the spokes 244.

The sequential arc valve 202 provides certain additional advantages. Like the first embodiment, it uses a spring 186 that is biased to exert a downward force against shaft 34. In turn, shaft 34 exerts a downward force to urge the upper helical valve portion 204 against the lower helical valve portion 206. This downward spring force provides a tight seal of the closed portion of the sequential arc valve 202.

The sequential arc valve 202 also has a concentric design. The structure of the upper and lower helical valve portions 204 and 206 can better resist horizontal, or side load, forces that might otherwise cause misalignment of the valve 202. The different structure of the sequential arc valve 202 is less susceptible to misalignment because there is no need to maintain a uniform radial gap between two valve members. This concentric design makes it more durable and capable of longer life.

Figure 30:
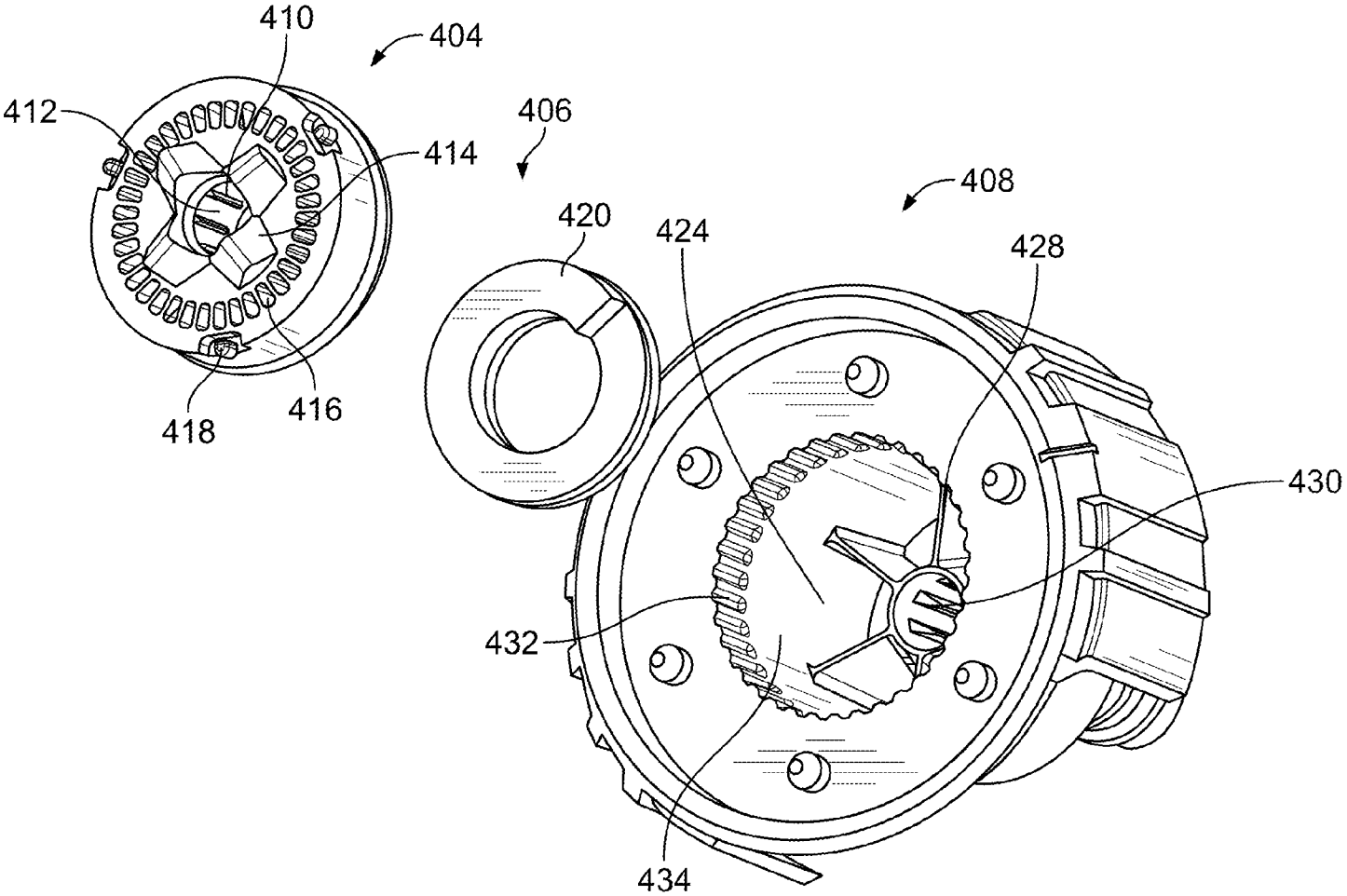
FIG. 30 is a top perspective view of an alternative upper helical valve portion, alternative lower helical valve portion, and alternative nozzle cover for use with the sprinkler head of FIG. 18.
Figure 31:
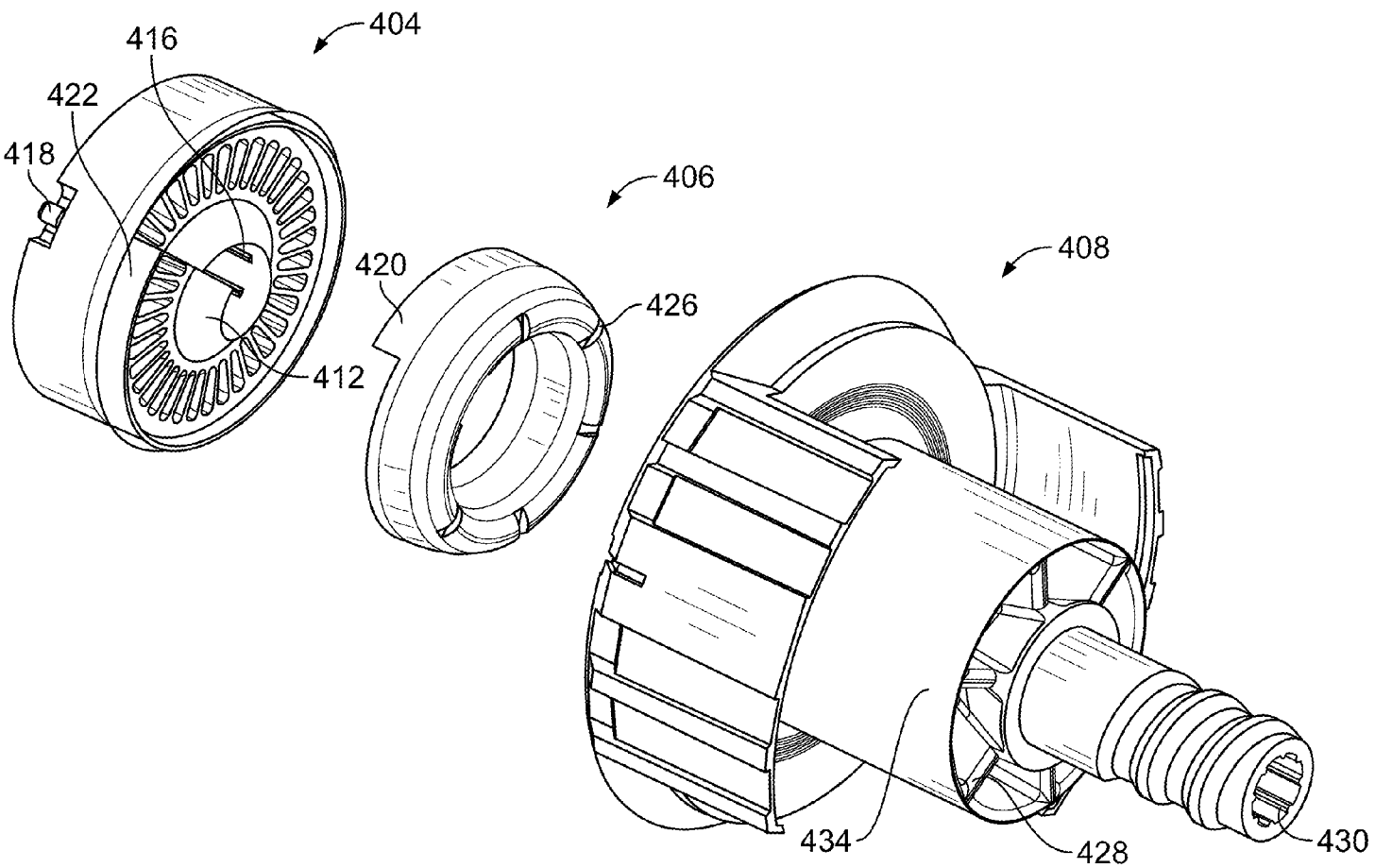
FIG. 31 is a bottom perspective view of the alternative upper helical valve portion, alternative lower helical valve portion, and alternative nozzle cover of FIG. 30.
Figure 32:
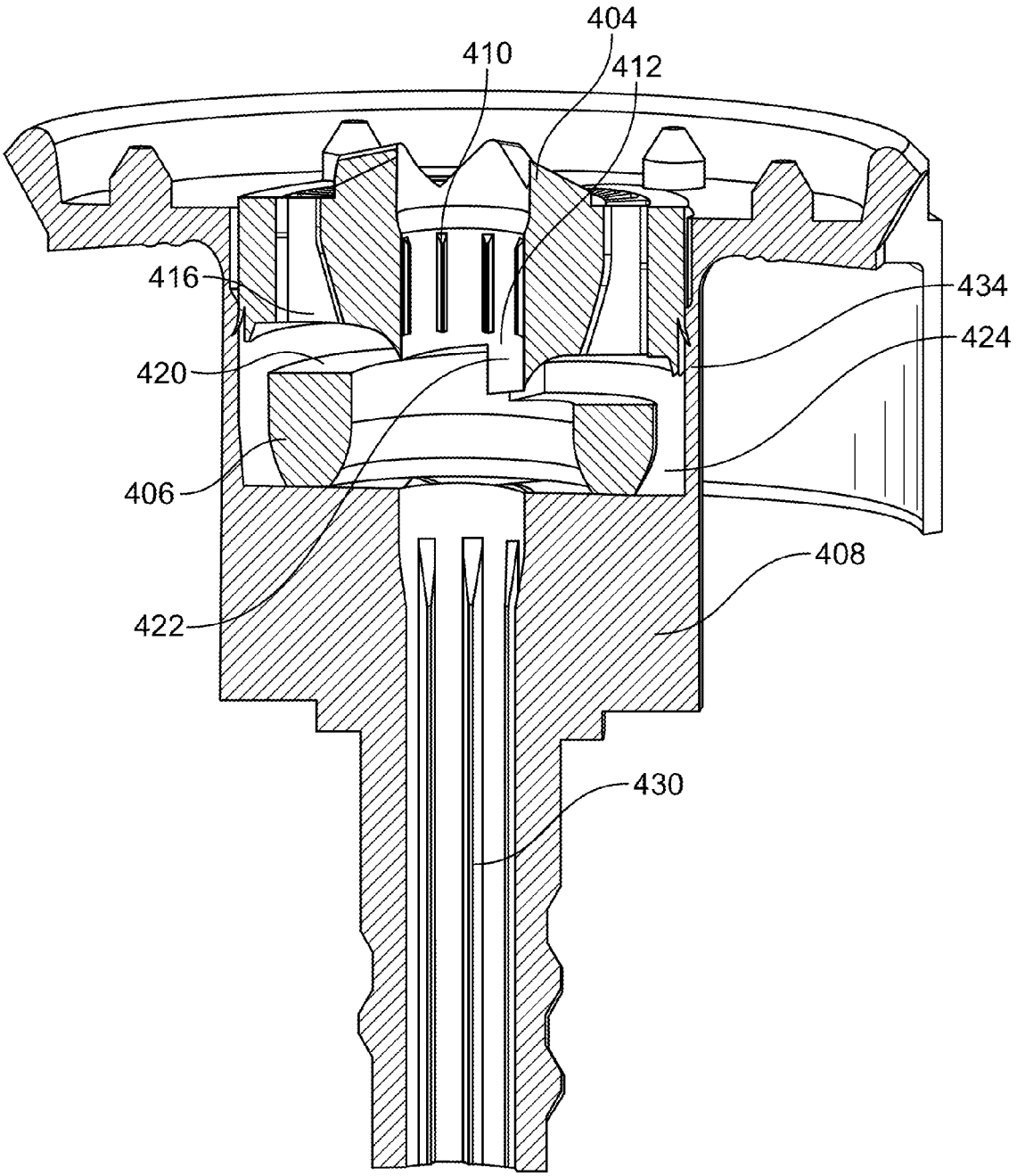
FIG. 32 is a cross-sectional view of the alternative upper helical valve portion and alternative bottom helical valve portion of FIG. 30 mounted in the alternative nozzle cover of FIG. 30.

Alternative preferred forms of upper helical valve portion 404, lower helical valve portion 406, and nozzle cover 408 for use with sprinkler head 200 are shown in FIGS. 30-32. As can be seen, upper helical valve portion 404 includes circumferentially-arranged and equidistantly-spaced crush ribs 410 that extend axially along the inside of the central hub 412. These crush ribs 410 engage the shaft 34 to help keep the upper helical valve portion 404 centered with respect to the shaft 34, i.e., to improve concentricity. As can be seen in FIGS. 30-32, although generally similar in structure, upper helical valve portion 404 includes a few other structural differences from the first preferred version, such as fewer teeth 414, no groove for an o-ring, and a downwardly-projecting helical hub 412.

Upper helical valve portion 404 also includes a feedback mechanism to signal to a user the arcuate setting. Alternative preferred upper helical valve portion 404 includes 36 circumferentially-arranged and equidistantly-spaced apertures 416 such that each aperture 416 corresponds to 10° of arc, and as described above, the user rotates the cap 12 and deflector 22 to increase or decrease the number of apertures 416 through which fluid flows. The upper helical valve portion 404 also preferably includes three detents 418 that are equidistantly spaced on the outer top circumference of the upper helical valve portion 404. These detents 418 cooperate with the nozzle cover 408, as described further below, to indicate to the user each 10° of rotation of the cap 12 and deflector 22 during an arcuate adjustment.

Lower helical valve portion 406 is essentially ring-shaped with a helical top surface 420 for engagement with a helical bottom surface 422 of the upper helical valve portion 404. As shown in FIG. 32, the upper helical valve portion 404 and lower helical valve portion 406 are inserted in a cylindrical recess 424 in the top of nozzle cover 408. The structure of lower helical valve portion 406 has also been modified from the first preferred version 206. Lower helical valve portion 406 preferably does not include radial spokes. Lower helical valve portion 406, however, preferably includes notches 426 in the bottom that engages spokes 428 of the nozzle cover 408 for support and to prevent rotation of lower helical valve portion 406. As can be seen from FIG. 32, fluid flows upwardly through the nozzle cover 408, either through a first outer flow sub-path between the cylinder 434 and the lower helical valve portion 406 or through a second inner flow sub-path between the lower helical valve portion 406 and the shaft (not shown), and then upwardly through the uncovered apertures 416.

Nozzle cover 408 also includes some structural differences from the first preferred version 208. Nozzle cover 408 preferably includes circumferentially-arranged and equidistantly-spaced axial crush ribs 430 for engagement with shaft 34 to improve concentricity. Nozzle cover 408 also preferably includes a ratchet for detents 418, i.e., circumferentially-arranged and equidistantly-spaced grooves 432 formed on the inside of cylinder 434 and positioned to engage detents 418 when the upper helical valve portion 404 is inserted in the cylinder 434. The grooves 432 are preferably spaced at 10° intervals corresponding to the spacing of the apertures 416, although the apertures 416 and grooves 432 may be incrementally spaced at other arcuate intervals.

These grooves 432 cooperate with detents 418 to signal to the user how many apertures 416 the user is covering or uncovering. As the user rotates the cap 12 and deflector 22 during an adjustment, the detents 418 engage the grooves 432 at 10° intervals. Thus, for example, as the user rotates clockwise 90°, the detents 418 will engage the grooves 432 nine times, and the user will feel the engagement and hear a click each time the detents 418 engage different grooves 432. In this manner, the detents 418 and grooves 432 provide feedback to the user as to the arcuate setting of the valve. Optionally, the sprinkler head 200 may include a stop mechanism to prevent over-rotation of the detents 418 beyond 360°.

Figure 20:
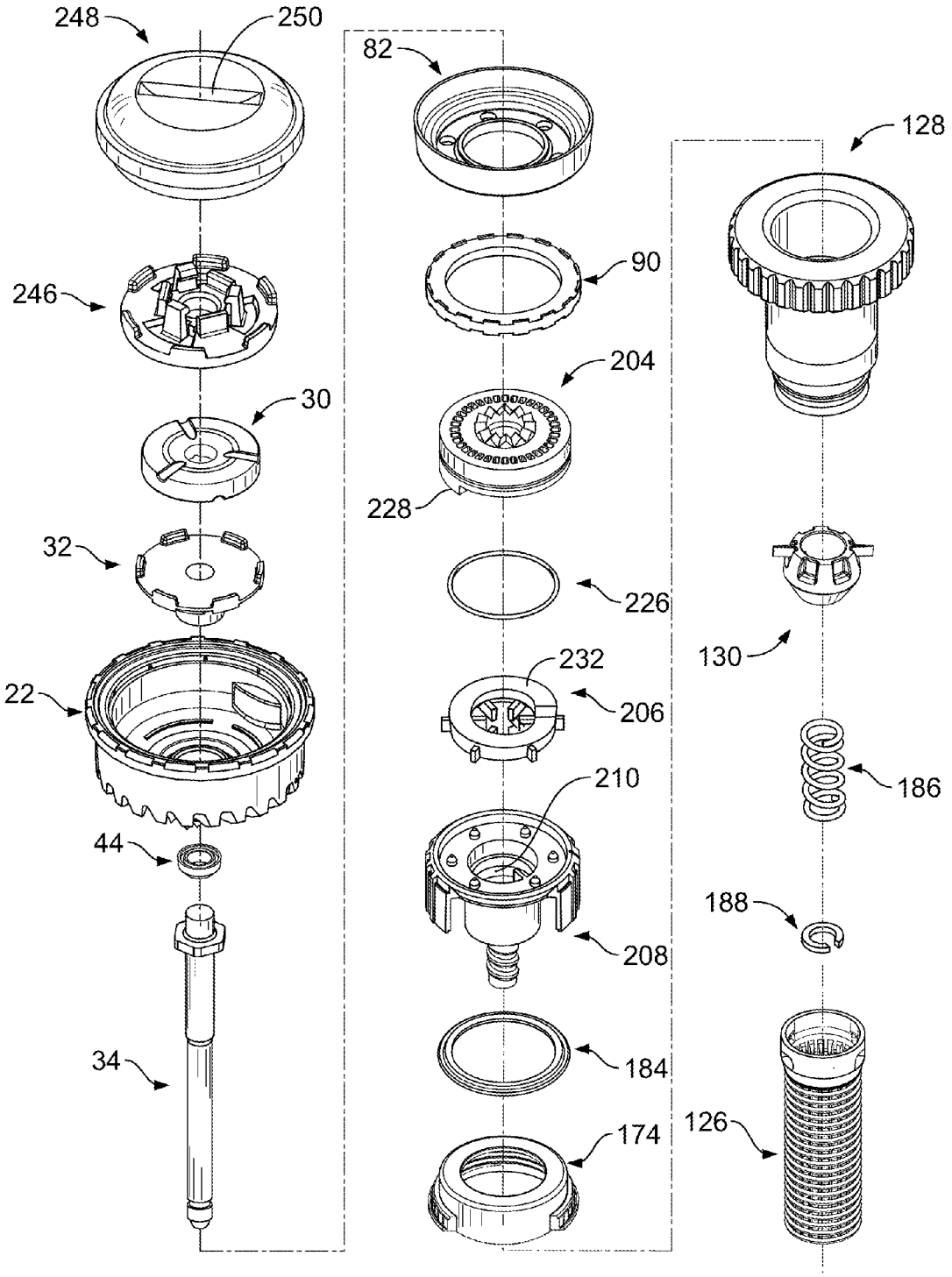
FIG. 20 is a top exploded perspective view of the sprinkler head of FIG. 18.
Figure 21:
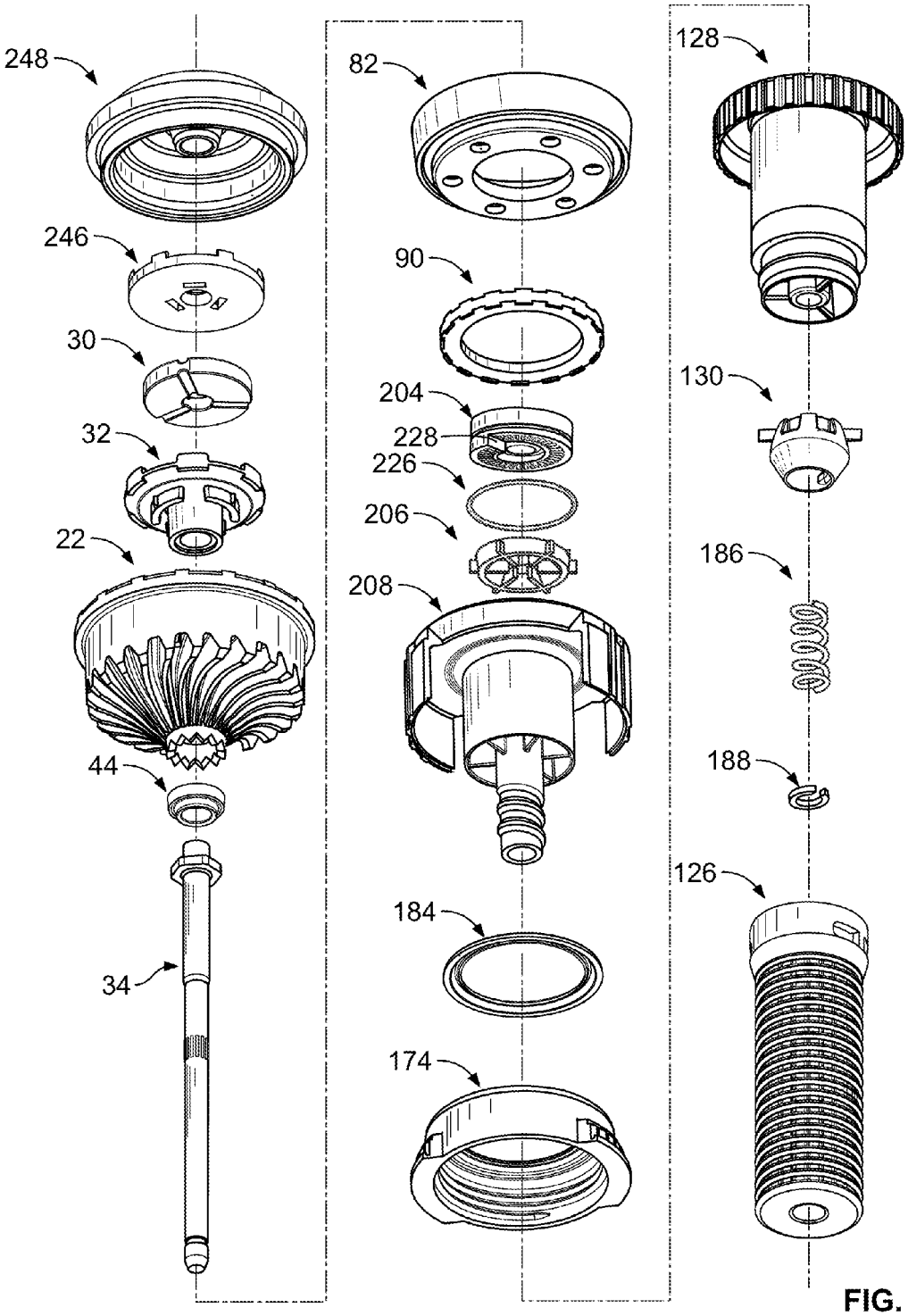
FIG. 21 is a bottom exploded perspective view of the sprinkler head of FIG. 18.

As can be seen in FIG. 20, the sprinkler head 200 may include two other optional modifications. First, the cap 248 may be modified to include a slot 250 in the top surface. As discussed above, the user may directly depress the cap 248 to make an arc adjustment and a hand tool is not necessary to effect the adjustment. Slot 250, however, may be included to signal to the user that an arc adjustment is performed by applying downward pressure to the top part of the cap 248. Second, the brake disk 246 shown in FIG. 20 does not include elastic members that bias the cap 248 and deflector 22 upwardly following an arc adjustment. As should be evident, each of the preferred forms of sprinkler head 10 and sprinkler head 200 may incorporate features from the other.

It should also be evident that the sprinkler heads 10 and 200 may be modified in various other ways. For instance, the spring 186 may be situated at other locations within the nozzle body. One advantage of the preferred forms is that the spring location increases ease of assembly, but it may be inserted at other locations within the sprinkler heads 10 and 200. For example, the spring 186 may be mounted between the lower helical valve portion 206 and the nozzle cover 208, which would result in no upward or downward translation of the shaft 34. As an example of another modification, the shaft 34 may be fixed against any rotation, such as through the use of splined engagement surfaces.

Further, as should be evident, various combinations of features are also possible. The lock-out features, valve sleeves, and nozzle covers described above may be combined with one another in various ways. For example, the notched valve sleeve 504 and corresponding nozzle cover 502 may be combined with either lock-out feature 702 or 800. Similarly, as additional examples, the other valve sleeves and nozzle covers addressed herein may also be combined with either lock-out feature 702 or 800.

Another preferred embodiment is a method of irrigation using a sprinkler head like sprinkler heads 10 and 200. The method uses a sprinkler head having a rotatable deflector and a valve with the deflector movable between an operational position and an adjustment position and with the valve operatively coupled to the deflector and adjustable in arcuate length for the distribution of fluid from the deflector in a predetermined arcuate span. The method generally involves moving the deflector to the adjustment position to engage the valve; rotating the deflector to effect rotation of the valve to open a portion of the valve; disengaging the deflector from the valve; moving the deflector to the operational position; and causing fluid to flow through the open portion of the valve and to impact and cause rotation of the deflector for irrigation through the arcuate span corresponding to the open portion of the valve. The sprinkler head of the method may also have a spring operatively coupled to the deflector and to the valve and with the valve including a first valve body and a second valve body. The method may also include moving the deflector to the operational position; moving the deflector against the bias of the spring and in a direction opposite the adjustment position; spacing the first valve body away from the second valve body; and causing fluid to flow between the first valve body and the second valve body to flush debris from the sprinkler head.

The foregoing relates to preferred exemplary embodiments of the invention. It is understood that other embodiments and methods are possible, which lie within the spirit and scope of the invention as set forth in the following claims.

What is claimed is:

1. An irrigation sprinkler head comprising:

a deflector;

a first valve adjustable to change the length of an arcuate opening for distribution of fluid in a predetermined arcuate span, the first valve comprising a first valve body and a second valve body;

a flow path from an inlet through the first valve to the deflector and outwardly away from the deflector within the predetermined arcuate span;

wherein the first valve body is rotatable about a central axis and has a first helical surface and wherein the second valve body has a second helical surface, the first and second helical surfaces engaging one another and movable with respect to one another for setting the length of the arcuate opening; and wherein the second helical surface has a helical protrusion projecting away from the second helical surface toward the deflector and wherein the first helical surface has a helical notch formed within the first helical surface, the helical notch receiving the helical protrusion therein.

2. The irrigation sprinkler head of claim 1 wherein the deflector is movable between an operational position and an adjustment position, the deflector engaging the first valve body for setting the length of the arcuate opening in the adjustment position and the deflector distributing fluid in the operational position.

3. The irrigation sprinkler head of claim 1 wherein the first valve body comprises a first fin joining ends of the first helical surface and the second valve body comprises a second fin joining ends of the second helical surface, the first and second fins defining the two boundary edges of fluid flowing through the first valve.

4. The irrigation sprinkler head of claim 1 wherein the second valve body comprises a cylindrical wall disposed downstream of the first and second helical surfaces, the first valve body and second valve body configured to define a portion of the flow path wherein fluid impacts the first helical surface, is redirected to impact the cylindrical wall, and is redirected axially to impact the deflector.

5. The irrigation sprinkler head of claim 1 wherein the helical protrusion has a first predetermined angle of inclination configured for reception within the helical notch having a second different predetermined angle of inclination.

6. The irrigation sprinkler head of claim 1 further comprising a shaft positioned along the central axis and a spring mounted to the shaft and biased to urge the first valve body and the second valve body axially into engagement with one another.

7. The irrigation sprinkler head of claim 6 wherein the spring is mounted near an end of the shaft, the spring biased to urge the first valve body axially in a direction opposite the direction of fluid flowing along the flow path.

8. The irrigation sprinkler head of claim 1 further comprising a second valve for adjustment of the flow rate through the sprinkler head.

9. The irrigation sprinkler head of claim 8 wherein the second valve comprises a first valve member operatively coupled to a second valve member, the first and second valve members configured so that rotation of the first valve member causes axial movement of the second valve member either toward or away from the inlet.

* * * * *